US012790151B2

(12) United States Patent
Kondo et al.

(10) Patent No.: US 12,790,151 B2
(45) Date of Patent: Nov. 10, 2026

(54) IMAGE FORMING SYSTEM AND SHEET CONVEYANCE APPARATUS

(71) Applicant: CANON FINETECH NISCA INC., Saitama (JP)

(72) Inventors: Tsukasa Kondo, Yamanashi (JP); Hisashi Osada, Yamanashi (JP); Kei Horiuchi, Yamanashi (JP); Kazunori Hatakawa, Yamanashi (JP)

(73) Assignee: CANON FINETECH NISCA INC., Saitama (JP)

( * ) Notice: Subject to any disclaimer, the term of this patent is extended or adjusted under 35 U.S.C. 154(b) by 57 days.

(21) Appl. No.: 18/748,578

(22) Filed: Jun. 20, 2024

(65) Prior Publication Data

US 2024/0409346 A1 Dec. 12, 2024

Related U.S. Application Data

(63) Continuation of application No. PCT/JP2022/048615, filed on Dec. 28, 2022.

(30) Foreign Application Priority Data

Dec. 28, 2021 (JP) ..... 2021-213825
Dec. 23, 2022 (JP) ..... 2022-206123
(Continued)

(51) Int. Cl.
*B65H 5/02* (2006.01)
*B65H 7/02* (2006.01)

(52) U.S. Cl.
CPC ..... *B65H 5/025* (2013.01); *B65H 7/02* (2013.01); *B65H 2515/10* (2013.01); *B65H 2801/21* (2013.01)

(58) Field of Classification Search
CPC ..... B65H 5/025; B65H 7/02; B65H 2515/10; B65H 2801/21
See application file for complete search history.

(56) References Cited

U.S. PATENT DOCUMENTS 5,540,370 A * 7/1996 Ring ..... B65H 29/60 271/253
5,984,302 A * 11/1999 Garrone ..... B65H 5/025 271/227
(Continued)

FOREIGN PATENT DOCUMENTS

JP 51-048317 Y1 11/1976
JP H10-157884 A 6/1998
(Continued)

OTHER PUBLICATIONS

PCT International Search Report and Written Opinion dated Mar. 20, 2023, in related PCT Patent Application No. PCT/JP2022/048655 (with English translation).

*Primary Examiner* — Thomas A Morrison
(74) *Attorney, Agent, or Firm* — VENABLE LLP

(57) ABSTRACT

An image forming system includes a conveyor belt to convey a sheet in a conveyance direction, rotary members arranged along the conveyance direction, and a regulation portion having a contact portion to come into contact with a side edge of the sheet. A load changing unit changes a load applied from the rotary members to the sheet, and a sheet information recognition unit recognizes information regarding a grammage of the sheet. A control unit controls the load changing unit, and an image forming unit forms an image on the conveyed sheet. The conveyor belt and the rotary members allow a predetermined sheet to move in a direction intersecting the conveyance direction when the regulation portion comes into contact with the side edge of the sheet,
(Continued)

and the control unit operates the load changing unit according to the recognized grammage of the sheet.

6 Claims, 39 Drawing Sheets

(30) Foreign Application Priority Data

Dec. 23, 2022 (JP) ..... 2022-206124
Dec. 23, 2022 (JP) ..... 2022-206125

(56) References Cited

U.S. PATENT DOCUMENTS

| | | | | |
|---|---|---|---|---|
| 7,325,802 | B2 | 2/2008 | Asakawa et al. | |
| 2021/0198065 | A1* | 7/2021 | Kondo | B65H 5/062 |
| 2021/0403261 | A1* | 12/2021 | Iwata | B65H 9/101 |
| 2021/0403263 | A1* | 12/2021 | Iwata | B65H 9/06 |
| 2022/0176715 | A1 | 6/2022 | Yoshimura et al. | |

FOREIGN PATENT DOCUMENTS

| | | | |
|---|---|---|---|
| JP | 2002-370850 | A | 12/2002 |
| JP | 2004-018146 | A | 1/2004 |
| JP | 2007-217096 | A | 8/2007 |
| JP | 2021-107288 | A | 7/2021 |
| JP | 2022-090861 | A | 6/2022 |

* cited by examiner

IMAGE FORMING SYSTEM AND SHEET CONVEYANCE APPARATUS

CROSS-REFERENCE TO RELATED APPLICATIONS

This application is a Continuation of International Patent Application No. PCT/JP2022/048615, filed Dec. 28, 2022, which claims the benefit of Japanese Patent Application No. 2021-213825, filed Dec. 28, 2021, Japanese Patent Application No. 2022-206124, filed Dec. 23, 2022, Japanese Patent Application No. 2022-206123, filed Dec. 23, 2022, and Japanese Patent Application No. 2022-206125, filed Dec. 23, 2022, which are hereby incorporated by reference herein in their entirety.

BACKGROUND OF THE INVENTION

Field of the Invention

The present invention relates to an image forming system that forms an image on a sheet, and a sheet conveyance apparatus that conveys the sheet.

Description of the Related Art

In a sheet conveyance apparatus that conveys a sheet, there is a possibility that sheet misalignment occurs due to various factors during conveyance of sheets. Further, for example, in a case where a sheet is conveyed to an image forming apparatus that forms an image on a sheet in a state where misalignment has occurred, a problem such as deviation of an image with respect to the sheet occurs. For this reason, a sheet conveyance apparatus that corrects misalignment of a sheet being conveyed is known (for example, JP 2007-217096 A).

JP 2007-217096 A discloses a configuration including a fixed reference guide provided on one side in a width direction intersecting a sheet conveyance direction, a conveyor belt provided to be inclined with respect to the reference guide, and a sphere. In the sheet conveyance apparatus described in JP 2007-217096 A, a sheet is conveyed while being nipped between the conveyor belt and the sphere, so that an edge of the sheet in the width direction abuts against the reference guide. Then, side registration (misalignment of the edge of the sheet in the width direction) and side skew (inclination of the edge of the sheet in the width direction with respect to the sheet conveyance direction) of the sheet are simultaneously corrected.

Further, JP 2007-217096 A describes a configuration in which a plurality of spheres are held in each of two rows of holding plates, and a gap between the spheres held by one holding plate and the conveyor belt can be changed by manually adjusting the height of the one holding plate. Therefore, as the spheres come into contact with or do not come into contact with the sheet depending on the thickness of the sheet, a pressing force against the conveyor belt can be automatically changed, and an appropriate conveyance force associated with the type of the sheet can be obtained.

Hitherto, in a sheet conveyance apparatus or an image forming apparatus including a sheet conveyance apparatus, a large quantity of one type of products is output. In recent years, there is an increasing need to output a variety of small quantities of products, and it is required to cope with various types of sheets. For this purpose, it is required to adjust a nip pressure between the spheres and the conveyor belt to an appropriate nip pressure according to the type of the sheet and convey the sheet. However, in a case where the gap between the spheres and the conveyor belt is manually adjusted as in the configuration described in JP 2007-217096 A every time the type of the sheet is changed, it takes time and effort for a user.

SUMMARY OF THE INVENTION

The present invention provides a configuration capable of easily obtaining an appropriate conveyance force associated with a type of a sheet.

According to a first aspect of the present invention, an image forming system includes a conveyance member configured to convey a sheet in a predetermined conveyance direction, an endless conveyor belt having a conveyance surface extending in the predetermined conveyance direction and configured to convey the sheet delivered from the conveyance member to the conveyance surface in the predetermined conveyance direction, a plurality of rotary members arranged in the predetermined conveyance direction at positions facing the conveyance surface, and configured to rotate at least in the predetermined conveyance direction while nipping the sheet with the conveyance surface, a regulation portion having a contact portion configured to come into contact with a side edge that is an edge of the sheet in a sheet width direction, and configured to regulate movement of the sheet in the sheet width direction beyond the contact portion in a case where the side edge of the sheet comes into contact with the contact portion, the sheet being conveyed using the conveyor belt and the rotary members, the sheet width direction being a direction intersecting the predetermined conveyance direction, a load changing unit configured to change a load applied from at least some of the plurality of rotary members to the sheet, a sheet information recognition unit configured to recognize information regarding the sheet to be conveyed, a control unit configured to control the load changing unit, and an image forming unit configured to form an image on the sheet conveyed by the conveyor belt and the rotary members. The conveyor belt and the plurality of rotary members are configured to allow the sheet to move in the direction intersecting the predetermined conveyance direction in a case where the regulation portion comes into contact with the side edge of the sheet in a state where the sheet is conveyed in the predetermined conveyance direction by the conveyor belt and the plurality of rotary members. The control unit is configured to control the load changing unit according to the information regarding the sheet recognized by the sheet information recognition unit.

According to a second aspect of the present invention, a sheet conveyance apparatus that receives and conveys a sheet conveyed by a conveyance member that conveys the sheet in a predetermined conveyance direction, the sheet conveyance apparatus includes an endless conveyor belt having a conveyance surface extending in the predetermined conveyance direction and configured to convey the sheet delivered from the conveyance member to the conveyance surface in the predetermined conveyance direction, a plurality of rotary members arranged in the predetermined conveyance direction at positions facing the conveyance surface, and configured to rotate at least in the predetermined conveyance direction while nipping the sheet with the conveyance surface, a regulation portion having a contact portion configured to come into contact with a side edge that is an edge of the sheet in a sheet width direction, and configured to regulate movement of the sheet in the sheet width direction beyond the contact portion in a case where the side edge of the sheet comes into contact with the contact portion, the sheet being conveyed using the conveyor belt and the rotary members, the sheet width direction being a direction intersecting the predetermined conveyance direction, a load changing unit configured to change a load applied from at least some of the plurality of rotary members to the sheet, a sheet information recognition unit configured to recognize information regarding the sheet to be conveyed, and a control unit configured to control the load changing unit. The conveyor belt and the plurality of rotary members are configured to allow the sheet to move in the direction intersecting the predetermined conveyance direction in a case where the regulation portion comes into contact with the side edge of the sheet in a state where the sheet is conveyed in the predetermined conveyance direction by the conveyor belt and the plurality of rotary members. The control unit is configured to control the load changing unit according to the information regarding the sheet recognized by the sheet information recognition unit.

According to a third aspect of the present invention, a sheet conveyance apparatus that receives a sheet conveyed by a conveyance member that conveys the sheet in a predetermined conveyance direction, and conveys the received sheet toward an image forming apparatus, the sheet conveyance apparatus includes an endless conveyor belt having a conveyance surface extending in the predetermined conveyance direction and configured to convey the sheet delivered from the conveyance member to the conveyance surface in the predetermined conveyance direction, a plurality of rotary members arranged in the predetermined conveyance direction at positions facing the conveyance surface, and configured to rotate at least in the predetermined conveyance direction while nipping the sheet with the conveyance surface, a regulation portion having a contact portion configured to come into contact with a side edge that is an edge of the sheet in a sheet width direction, and configured to regulate movement of the sheet in the sheet width direction beyond the contact portion in a case where the side edge of the sheet comes into contact with the contact portion, the sheet being conveyed using the conveyor belt and the rotary members, the sheet width direction being a direction intersecting the predetermined conveyance direction, a reception unit configured to receive a command from the image forming apparatus, a load changing unit configured to change a load applied from at least some of the plurality of rotary members to the sheet, and a control unit configured to control the load changing unit. The conveyor belt and the plurality of rotary members are configured to allow the sheet to move in the direction intersecting the predetermined conveyance direction in a case where the regulation portion comes into contact with the side edge of the sheet in a state where the sheet is conveyed in the predetermined conveyance direction by the conveyor belt and the plurality of rotary members. The control unit is configured to control the load changing unit according to the command received by the reception unit.

Further features of the present invention will become apparent from the following description of exemplary embodiments with reference to the attached drawings.

DESCRIPTION OF THE EMBODIMENTS

First Embodiment

A first embodiment will be described with reference to FIGS. 1 to 10. First, an image forming system of the present embodiment will be described with reference to FIG. 1.

Image Forming System

Figure 1:
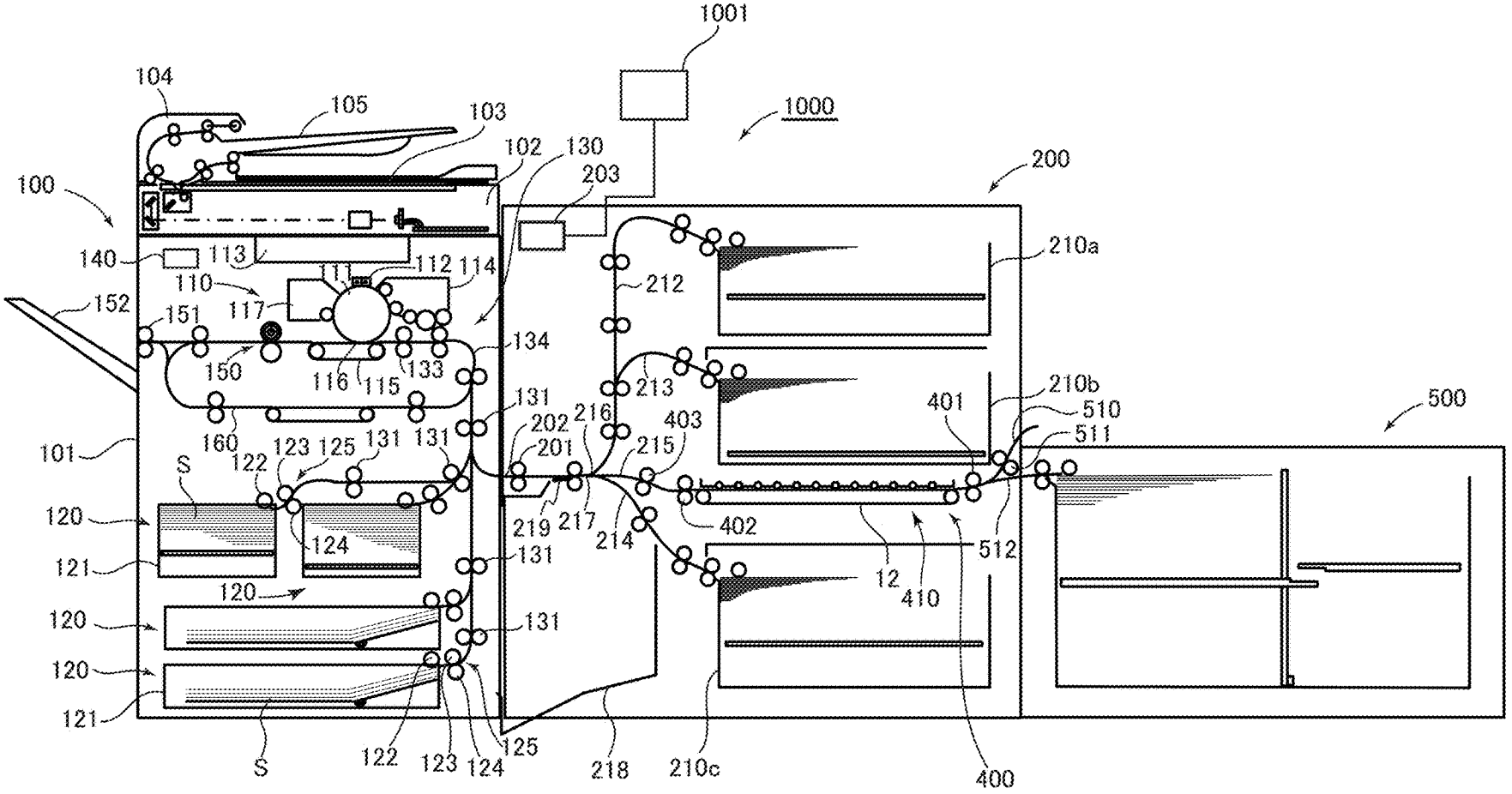
FIG. 1 is a schematic cross-sectional view of a configuration of an image forming system according to a first embodiment.

FIG. 1 is a cross-sectional view schematically illustrating an example of an image forming system including a multistage feeding apparatus and an image forming apparatus according to the present embodiment. In the following description, a laser printer system using an electrophotographic system (hereinafter, simply referred to as a printer) will be described as an example of the image forming apparatus including an image forming unit. The image forming apparatus included in the image forming system may be a copier, a facsimile, a multifunction peripheral, or the like, in addition to a printer. Further, the image forming apparatus is not limited to the electrophotographic system and may have a configuration of another system such as an inkjet system.

An image forming system 1000 of the present embodiment includes an image forming apparatus 100, a multistage feeding apparatus 200 serving as a sheet feeding apparatus connected to the image forming apparatus 100, and a feeding deck 500. As described in detail below, the multistage feeding apparatus 200 includes a plurality of storage compartments each capable of storing a plurality of sheets, and can feed sheets from each storage compartment to the image forming apparatus 100. The feeding deck 500 also includes a storage compartment capable of storing a plurality of sheets, and is disposed upstream of the multistage feeding apparatus 200 in a sheet conveyance direction. Further, a sheet fed from the feeding deck 500 is conveyed to the image forming apparatus 100 via a relay conveyance apparatus 400 provided in the multistage feeding apparatus 200. Examples of the sheet include paper such as plain paper, thin paper, and thick paper, and a plastic sheet.

The image forming apparatus 100 forms a toner image (image) on the sheet according to an image signal from a document reading device 102 connected to an image forming apparatus body 101 or a host device such as a personal computer communicably connected to the image forming apparatus body 101. In the present embodiment, the document reading device 102 is disposed above the image forming apparatus body 101.

When reading a document, the document reading device 102 reads a document image by irradiating the document placed on a platen glass 103 with light by a scanning optical system light source and inputting reflected light to a charge-coupled device (CCD). The document reading device 102 includes an automatic document feeder (ADF) 104, and can also read a document image by automatically conveying a document placed on a tray 105 to a reading unit of the document reading device 102 by the ADF 104. Then, the read document image is converted into an electrical signal and transmitted to a laser scanner 113 of an image forming unit 110 described below. As described above, image data transmitted from a personal computer or the like may be input to the laser scanner 113.

The image forming apparatus 100 includes the image forming unit 110, a plurality of sheet feeding apparatuses 120, a sheet conveyance apparatus 130, and the like. Each unit of the image forming apparatus 100 is controlled by a control unit 140. The control unit 140 includes a central processing unit (CPU), a read only memory (ROM), and a random access memory (RAM). The CPU controls each unit while reading a program corresponding to a control procedure stored in the ROM. In addition, work data and input data are stored in the RAM, and the CPU performs control with reference to the data stored in the RAM based on the above-described program or the like.

Each of the plurality of sheet feeding apparatuses 120 includes a cassette 121 that stores sheets S, a pickup roller 122, and a separation conveyance roller pair 125 including a feed roller 123 and a retard roller 124. The sheets S stored in the cassette 121 are separated and fed one by one by the pickup roller 122 that rotate by moving up and down at a predetermined timing and the separation conveyance roller pair 125.

The sheet conveyance apparatus 130 includes a conveyance roller pair 131 and a registration roller pair 133. The sheet S fed from the sheet feeding apparatus 120 is made to pass through a sheet conveyance path 134 by the conveyance roller pair 131 and then guided to the registration roller pair 133. Thereafter, the sheet S is sent to the image forming unit 110 at a predetermined timing by the registration roller pair 133.

The sheet conveyed from the multistage feeding apparatus 200 or the feeding deck 500 described below via a conveyance roller pair 201 is conveyed into the image forming apparatus 100 via a connection path 202 with the image forming apparatus 100. Then, the sheet conveyed from the multistage feeding apparatus 200 or the feeding deck 500 into the image forming apparatus 100 is sent to the image forming unit 110 via the registration roller pair 133 at a predetermined timing, similarly to the sheet conveyed from the sheet feeding apparatus 120 in the image forming apparatus 100.

The image forming unit 110 includes a photosensitive drum 111, a charger 112, a laser scanner 113, a developing device 114, a transfer device 115, a cleaner 117, and the like. At the time of image formation, the photosensitive drum 111 is rotationally driven, and first, the surface of the photosensitive drum 111 is uniformly charged by the charger 112. Then, the charged photosensitive drum 111 is irradiated with laser light emitted from the laser scanner 113 according to the image signal, whereby an electrostatic latent image is formed on the photosensitive drum 111. Further, the electrostatic latent image formed on the photosensitive drum 111 in this manner is then visualized as the toner image by the developing device 114.

Thereafter, the toner image on the photosensitive drum 111 is transferred to the sheet S by the transfer device 115 in a transfer portion 116. Further, the sheet S to which the toner image has been transferred in this manner is conveyed to a fixing device 150 to fix the toner image, and then discharged to a discharge tray 152 outside the apparatus by a discharge roller 151.

When the toner image is formed on the back surface of the sheet S, the sheet S discharged from the fixing device 150 is conveyed to a reverse conveyance path 160. Then, the sheet S is conveyed to the transfer portion 116 of the image forming unit 110 again in a state of being reversed by the reverse conveyance path 160. The sheet S having the back surface to which the toner image has been transferred is conveyed to the fixing device 150, and after the toner image is fixed, the sheet S is discharged to the discharge tray 152 by the discharge roller 151. A residual toner remaining on the photosensitive drum 111 after the transfer is removed by the cleaner 117.

Multistage Feeding Apparatus

Next, an outline of the multistage feeding apparatus 200 will be described with reference to FIG. 1. The multistage feeding apparatus 200 serving as a sheet conveyance apparatus includes a plurality of storage compartments 210*a* to 210*c*, the relay conveyance apparatus 400, and the like. In the present embodiment, three storage compartments 210*a* to 210*c* are vertically arranged in three stages, and the relay conveyance apparatus 400 is disposed between the lowermost storage compartment 210*c* and the second uppermost storage compartment 210*b*.

The sheet fed from the uppermost storage compartment 210*a* is conveyed to a conveyance path 212, the sheet fed from the second uppermost storage compartment 210*b* is conveyed to a conveyance path 213, and the sheet fed from the lowermost storage compartment 210*c* is conveyed to a conveyance path 214. The sheet conveyed from the relay conveyance apparatus 400 is conveyed to a conveyance path 215. The conveyance path 213 joins the conveyance path 212 on the way. The conveyance paths 212, 214, and 215 join at a junction 216, and the sheet is conveyed to the conveyance roller pair 201 through a conveyance path 217 and is conveyed to the image forming apparatus 100 via the connection path 202.

In addition, a double-feed detection sensor for detecting double feeding of the sheet is disposed in each of the conveyance path 212 after joining the conveyance path 213, the relay conveyance apparatus 400, and the conveyance path 214. Then, the sheet for which double feeding has been detected by the double-feed detection sensor is conveyed to the conveyance path 217. A double-fed sheet storing portion (escape tray) 218 for storing the sheet for which double feeding has been detected is disposed below the conveyance path 217. A switching member 219 provided in the conveyance path 217 performs conveyance path switching to convey the sheet for which double feeding has been detected and which has been conveyed to the conveyance path 217 to the double-fed sheet storing portion 218.

Each unit of the multistage feeding apparatus 200 is controlled by a control unit 203. The control unit 203 includes a central processing unit (CPU), a read only memory (ROM), and a random access memory (RAM). In addition, the control unit 203 can communicate with the control unit 140 of the image forming apparatus 100, and controls a sheet feeding timing and the like by communicating with the control unit 140.

The sheet fed from the feeding deck 500 positioned upstream is conveyed to the relay conveyance apparatus 400 through a conveyance path 512. Further, the sheet can be fed even by manual feeding in the multistage feeding apparatus 200. The manually fed sheet is conveyed to a conveyance path 510 joining the conveyance path 512, and is conveyed to the relay conveyance apparatus 400 via the conveyance path 512 by a conveyance roller pair 511.

As described in detail below, the relay conveyance apparatus 400 includes a misalignment correction unit 410 including a conveyor belt 12 and the like. A conveyance roller pair 401 serving as a conveyance member is disposed upstream of the misalignment correction unit 410 in the sheet conveyance direction, and a conveyance roller pair 402 is disposed downstream of the misalignment correction unit 410 in the sheet conveyance direction. The sheet conveyed through the conveyance path 512 is sent to the misalignment correction unit 410 by the conveyance roller pair 401. The sheet is delivered to the conveyance roller pair 402 positioned downstream after side registration (misalignment of an edge of the sheet in a width direction) and side skew (inclination of the edge of the sheet in the width direction with respect to the sheet conveyance direction) are corrected by the misalignment correction unit 410. Then, the sheet is conveyed to the conveyance path 215 by the conveyance roller pair 402 and a conveyance roller pair 403. In this manner, the relay conveyance apparatus 400 corrects misalignment or the like of the sheet conveyed from the feeding deck 500 positioned upstream or the like, and delivers the sheet to the image forming apparatus 100 positioned downstream.

Relay Conveyance Apparatus

Next, the relay conveyance apparatus 400 will be described. First, a schematic configuration of the relay conveyance apparatus 400 will be described with reference to FIGS. 2 to 4. The relay conveyance apparatus 400 receives the sheet conveyed by the conveyance roller pair 401 serving as the conveyance member that conveys the sheet in a conveyance direction (predetermined conveyance direction) X, and conveys the received sheet toward the image forming apparatus 100. That is, the sheet is delivered from the conveyance roller pair 401 positioned upstream to the misalignment correction unit 410, and after the misalignment of the sheet is corrected, the sheet is delivered from the misalignment correction unit 410 to the conveyance roller pair 402 positioned downstream. As illustrated in FIG. 3, the conveyance roller pairs 401 and 402 each include a driving roller and a driven roller. The driving roller and the driven roller each include two roller portions that are separated from each other in a rotation axis direction. In particular, a width of the conveyance roller pair 402 positioned downstream (a length of the conveyance roller pair 402 in a width direction Y, and an interval between an upper end of the upper roller portion and a lower end of the lower roller portion of the two roller portions of the conveyance roller pair 402 arranged in the rotation axis direction illustrated in FIG. 3) is larger than a width of the conveyor belt 12 (a length of the conveyor belt in the width direction Y). The misalignment correction unit 410 includes the conveyor belt 12, a plurality of spheres 20 and 21 serving as a plurality of rotary members, a pair of regulation guides 14A and 14B, a guide moving unit 420, and the like.

The conveyor belt 12 is disposed downstream of the conveyance roller pair 401 in the conveyance direction X (downstream of the conveyance roller pair 401 in the conveyance direction), the conveyance roller pair 401 serving as the conveyance member that conveys the sheet in the conveyance direction X. The conveyor belt 12 is an endless belt stretched around pulleys 11A and 11B, and has a conveyance surface 12A extending in the conveyance direction X. A motor M1 serving as a drive source is connected to the pulley 11A on one side, and the conveyor belt 12 rotates by the drive of the motor M1. Such a conveyor belt 12 conveys the sheet delivered from the conveyance roller pair 401 positioned upstream in the conveyance direction X to the conveyance surface 12A in the conveyance direction X.

Figure 4A:
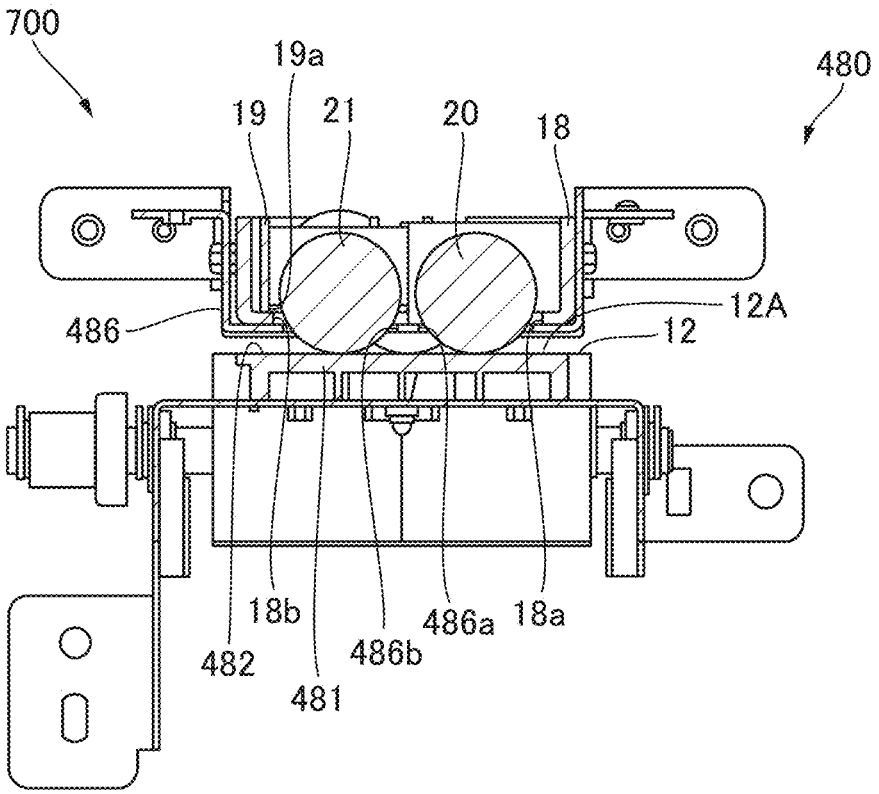
FIG. 4A is a cross-sectional view of a conveyor belt unit of the relay conveyance apparatus according to the first embodiment, which illustrates a contact state where spheres in both rows come into contact with a sheet.
Figure 4B:
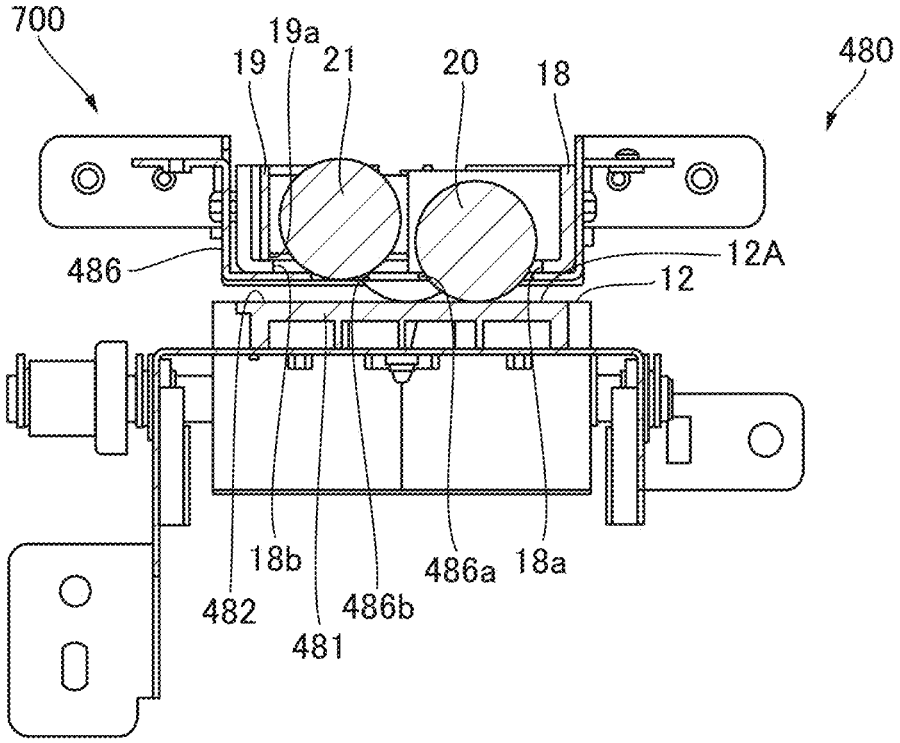
FIG. 4B is a cross-sectional view of the conveyor belt unit of the relay conveyance apparatus according to the first embodiment, which illustrates a separated state where the spheres in one row are separated from the sheet.

The plurality of spheres 20 and 21 are arranged in the conveyance direction X at positions facing the conveyance surface 12A of the conveyor belt 12. As illustrated in FIGS. 4A and 4B, at least some spheres 21 of the spheres 20 and 21 can come into contact with and be separated from the conveyance surface 12A. Then, when some of the spheres 21 come into contact with the conveyance surface 12A, the own weight of the spheres 21 imposes a load on the conveyance surface 12A. That is, in the present embodiment, the load applied from at least some spheres 21 of the plurality of spheres 20 and 21 to the sheet can be changed. The configuration will be described in detail below.

The spheres (rotary members) 20 and 21 are not necessarily perfect spheres. That is, it is sufficient if the spheres 20 and 21 can rotate at least in the conveyance direction by rotation of the conveyor belt 12 in a state nipping the sheet with the conveyor belt 12. In the present embodiment, the spheres 20 and 21 are rotatable in a direction intersecting the conveyance direction in addition to the conveyance direction, and further, are rotatable in an arbitrary direction. Furthermore, in a case where the spheres 20 and 21 can rotate, the centers of gravity of the spheres 20 and 21 do not have to be the centers of the spheres 20 and 21, or the surfaces of the spheres 20 and 21 may be uneven or flat. The sphere having the uneven surface is, for example, a sphere like a golf ball, and the sphere having a flat surface is, for example, a polyhedron or a sphere whose surface is partially flat.

In the present embodiment, the spheres 20 and 21 are arranged in two rows in a sheet guiding direction of guide surfaces 15A of the regulation guides 14A and 14B described below. The spheres 21 in one row can come into contact with and be separated from the conveyance surface 12A of the conveyor belt 12. That is, as described in detail below, the spheres 21 are movable to a contact position (FIG. 4A) where the spheres 21 come into contact with the conveyance surface 12A in a state where there is no sheet between the spheres 21 and the conveyance surface 12A and a separated position (FIG. 4B) where the spheres 21 are separated from the conveyance surface 12A with respect to the contact position. The guide direction of the regulation guides 14A and 14B and the conveyance direction X of the conveyor belt 12 substantially coincide with each other.

Figure 2:
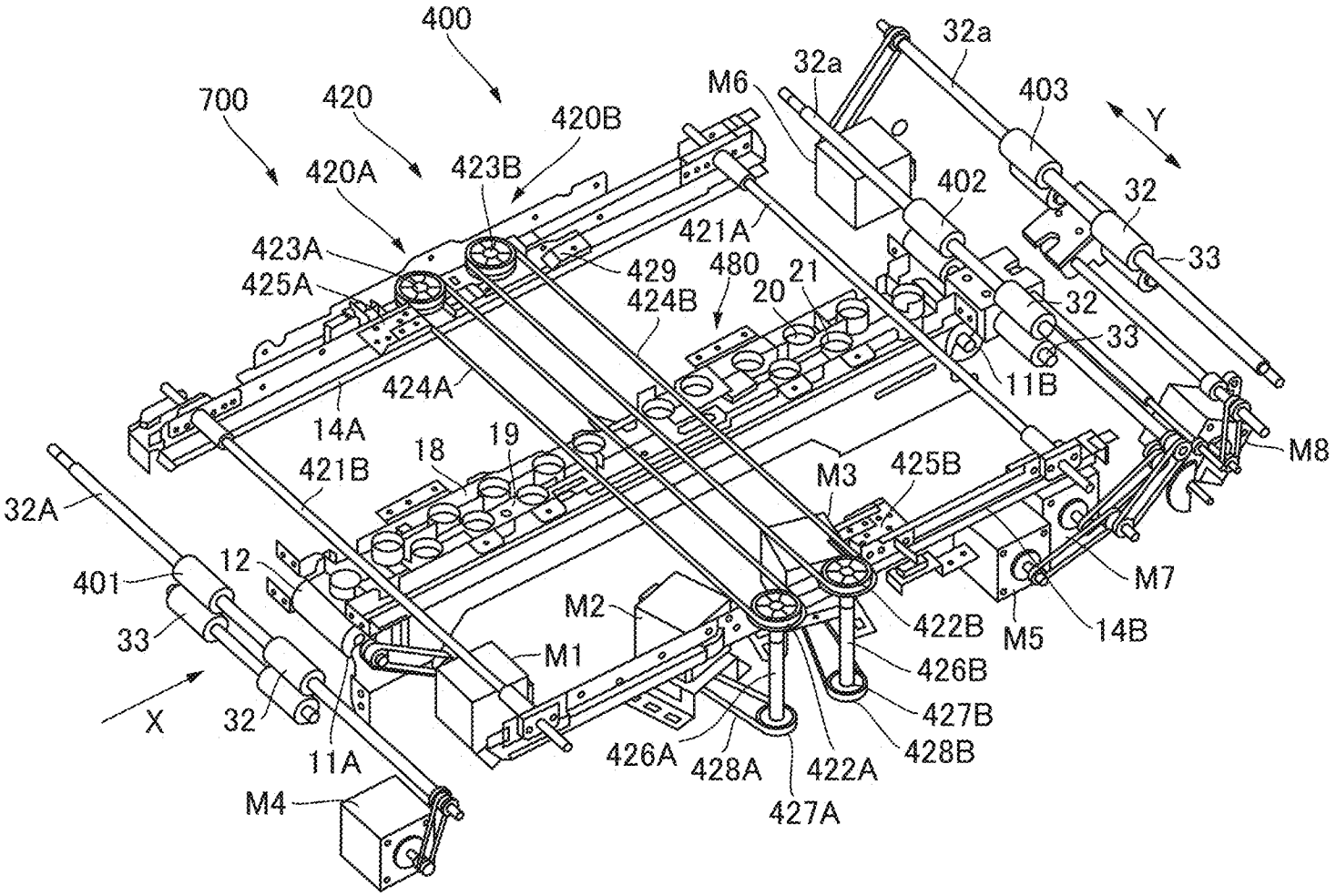
FIG. 2 is a perspective view of a relay conveyance apparatus according to the first embodiment.
Figure 3:
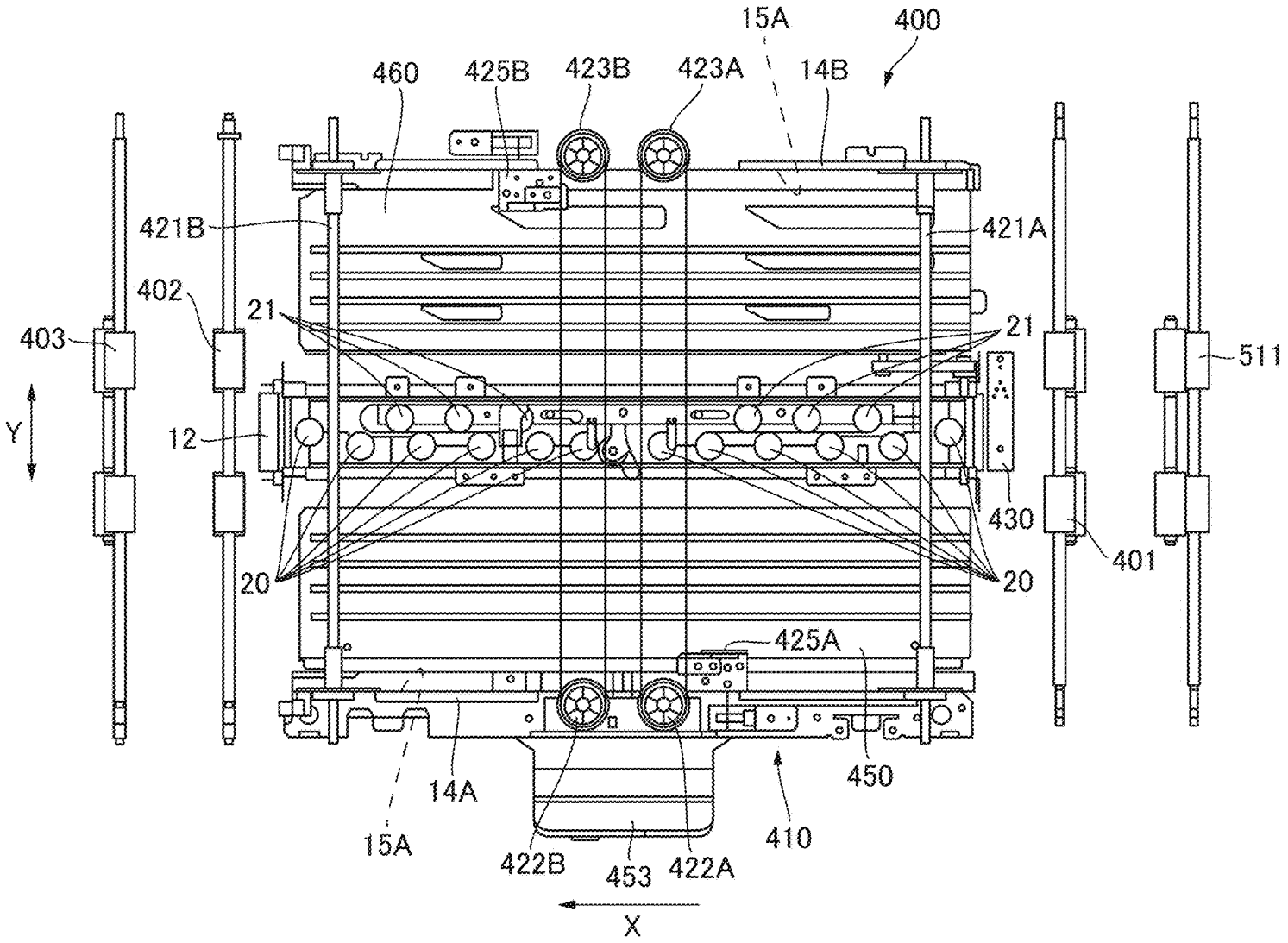
FIG. 3 is a plan view of the relay conveyance apparatus according to the first embodiment.

As illustrated in FIGS. 2 and 3, the pair of regulation guides 14A and 14B serving as regulation portions are disposed on both sides of the conveyor belt 12 in the sheet width direction Y intersecting the conveyance direction X (a direction orthogonal to the conveyance direction in the present embodiment). The pair of regulation guides 14A and 14B can guide both end edges of the sheet in the sheet width direction Y, the sheet being conveyed while being nipped between the conveyor belt 12 and only the spheres 20 or between the conveyor belt 12 and the spheres 20 and 21 (hereinafter, in any case, it is referred to as the "spheres 20 and 21" as necessary for convenience). That is, the pair of regulation guides 14A and 14B each have the guide surface 15A serving as a contact portion that can come into contact with a side edge which is the end edge of the sheet in the sheet width direction Y, the sheet being conveyed using the conveyor belt 12 and the spheres 20 and 21. The pair of regulation guides 14A and 14B regulates movement of the sheet in the sheet width direction Y beyond the guide surfaces 15A when the side edges of the sheet come into contact with the guide surfaces 15A. The regulation guide 14A disposed on one side in the sheet width direction Y can regulate an end portion of the sheet on one side in the sheet width direction, the sheet being conveyed while being nipped between the conveyor belt 12 and the spheres 20 and 21. Further, the regulation guide 14B disposed on the other side in the sheet width direction Y can regulate an end portion of the sheet on the other side in the sheet width direction, the sheet being conveyed while being nipped between the conveyor belt 12 and the spheres 20 and 21.

Figure 9:
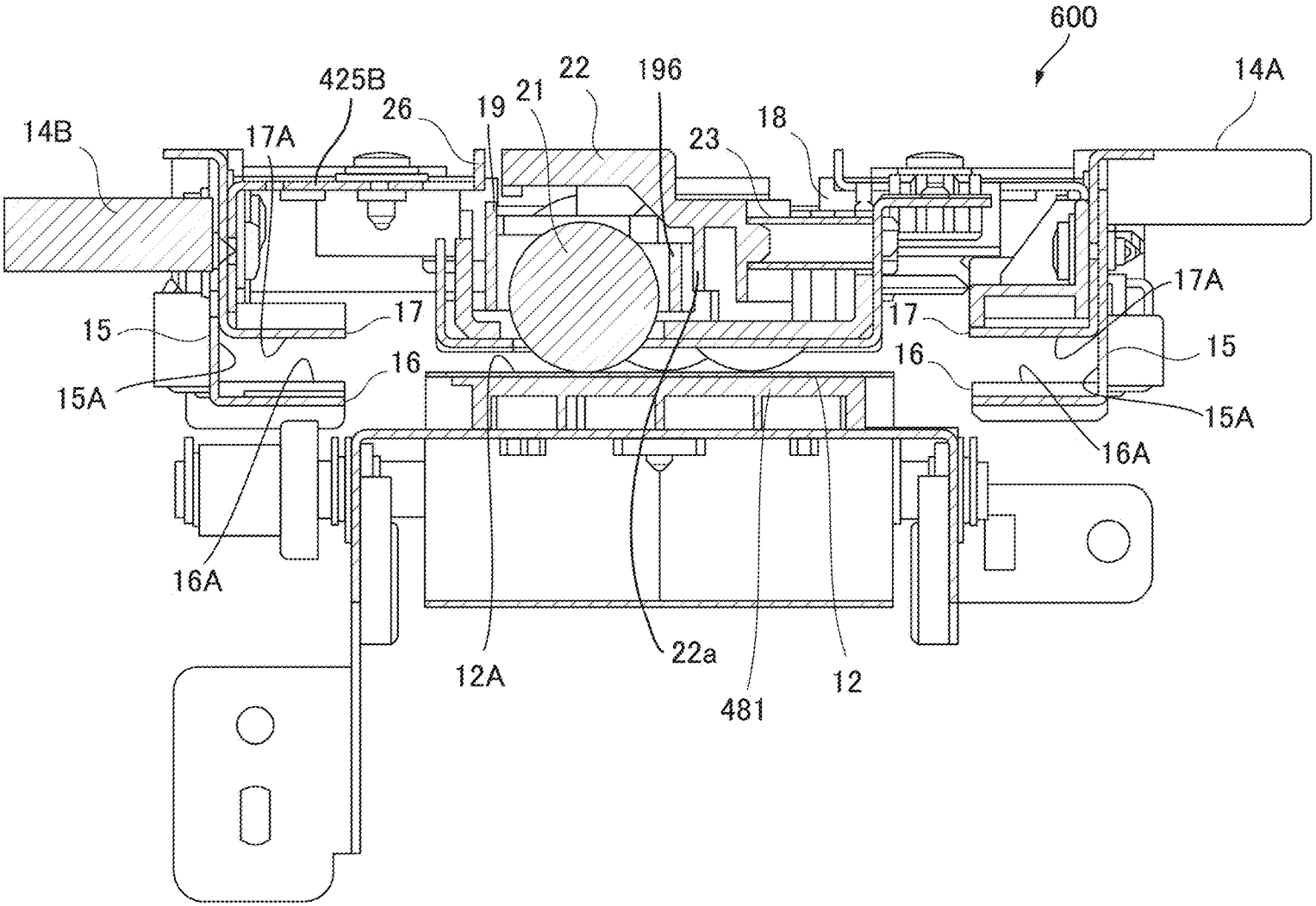
FIG. 9 is a cross-sectional view of the conveyor belt unit and a regulation guide according to the first embodiment taken along a stopper portion.
Figure 10:
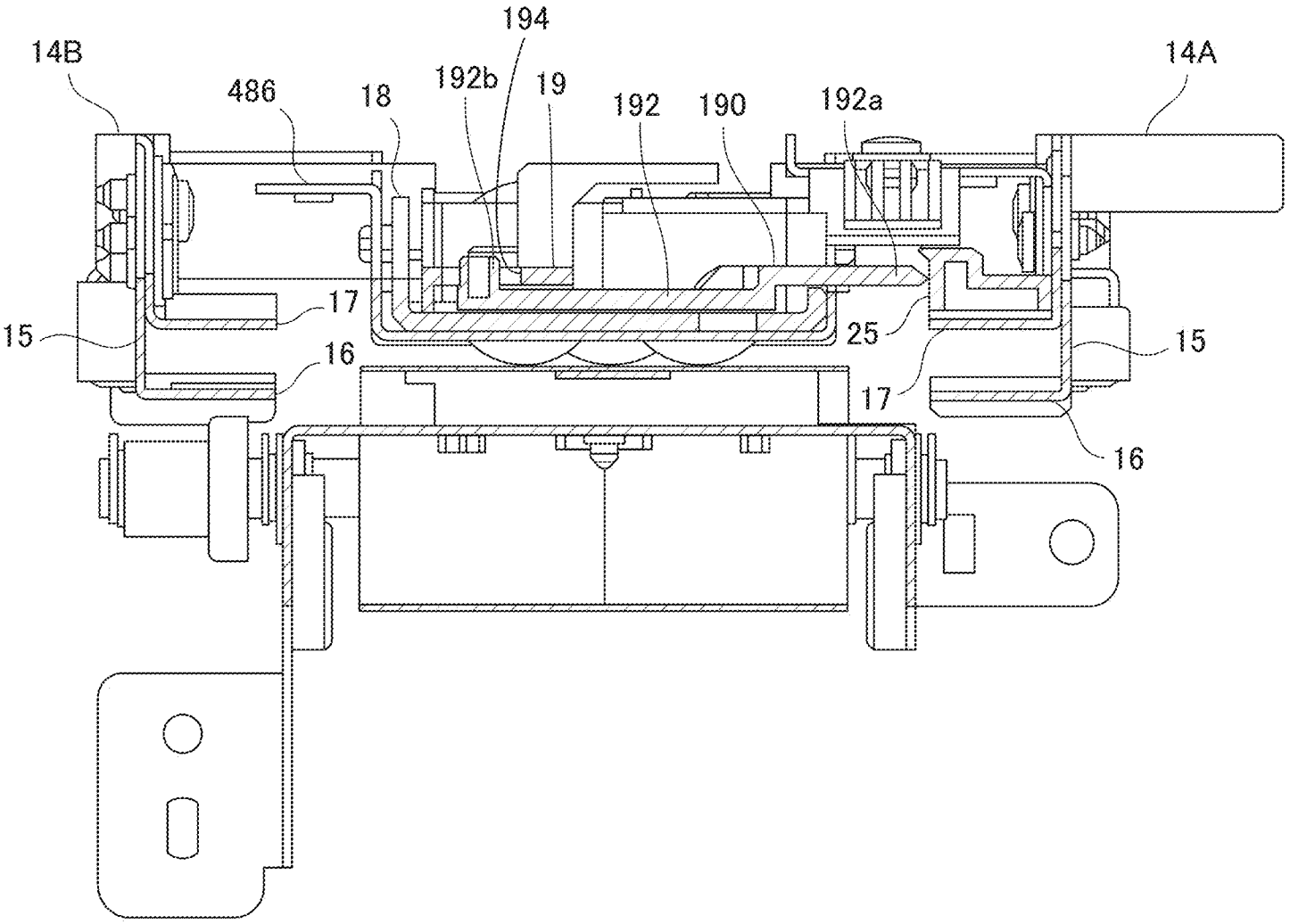
FIG. 10 is a cross-sectional view of the conveyor belt unit and the regulation guide according to the first embodiment taken along a rotation link portion.

As illustrated in FIGS. 9 and 10, the pair of regulation guides 14A and 14B each include a side plate portion 15, a lower plate portion 16, and an upper plate portion 17, and an end portion of the sheet conveyed by the conveyor belt 12 can enter a space surrounded by the plate portions 15, 16, and 17. The pair of regulation guides 14A and 14B are supported by support shafts 421A and 421B (see FIG. 3) so as to be movable between a guide position and a retracted position by a guide moving unit 420 described below. The support shafts 421A and 421B are disposed substantially parallel to the sheet width direction Y, and support end portion sides of the pair of regulation guides 14A and 14B in the conveyance direction X. The pair of regulation guides 14A and 14B are movable in the sheet width direction Y along the support shafts 421A and 421B.

The side plate portion 15 has the guide surface 15A facing the end edge of the sheet in the sheet width direction Y at the guide position, the sheet being conveyed while being nipped between the conveyor belt 12 and the spheres 20 and 21. The guide surface 15A is disposed parallel to the conveyance direction X. The guide surface 15A is a surface orthogonal to the conveyance direction X and the sheet width direction Y, and is a surface along a substantially vertical direction in the present embodiment.

The lower plate portion 16 is disposed so as to be orthogonal to the side plate portion 15, and has a support surface 16A that supports the end edge of the sheet in the sheet width direction Y at the guide position, the sheet being conveyed while being nipped between the conveyor belt 12 and the spheres 20 and 21. The support surface 16A extends in a substantially horizontal direction from a vertically lower end portion of the guide surface 15A. Further, the support surface 16A is positioned vertically lower than the conveyance surface 12A of the conveyor belt 12.

The upper plate portion 17 has a facing surface 17A disposed to face the support surface 16A. The facing surface 17A is positioned above the end edge of the sheet in the sheet width direction Y at the guide position, the sheet being conveyed while being nipped between the conveyor belt 12 and the spheres 20 and 21. Further, the facing surface 17A is formed substantially parallel to the support surface 16A.

As illustrated in FIGS. 2 and 3, the guide moving unit 420 includes a first moving unit 420A that moves the regulation guide 14A of the pair of regulation guides 14A and 14B and a second moving unit 420B that moves the other regulation guide 14B. The guide moving unit 420 includes a motor M2 that generates a driving force for moving the regulation guide 14A and a motor M3 that generates a driving force for moving the other regulation guide 14B.

The first moving unit 420A includes a pair of pulleys 422A and 423A, an endless belt 424A stretched around both of the pulleys 422A and 423A, and a connection portion 425A that connects the belt 424A and the regulation guide 14A. Similarly, the second moving unit 420B includes a pair of pulleys 422B and 423B, an endless belt 424B stretched around both of the pulleys 422B and 423B, and a connection portion 425B that connects the belt 424B and the other regulation guide 14B.

As illustrated in FIG. 2, the first moving unit 420A is driven by the motor M2 serving as a drive source, and the second moving unit 420B is driven by the motor M3 serving as a drive source. That is, in the present embodiment, the motors serving as the drive sources for moving the pair of regulation guides 14A and 14B are separated, and the pair of regulation guides 14A and 14B can move independently of each other. Therefore, the pulley 422A of the first moving unit 420A is connected to the pulley 427A via a connection shaft 426A, and the belt 428A is stretched between the pulley 427A and a pulley rotationally driven by the motor M2. A rotational drive of the motor M2 is transmitted to the belt 424A via the belt 428A, the pulley 427A, the connection shaft 426A, and the pulley 422A. As described above, since the regulation guide 14A is connected to the belt 424A via the connection portion 425A, the regulation guide 14A moves in the sheet width direction Y along the support shafts 421A and 421B by the drive of the motor M2.

Similarly, the pulley 422B of the second moving unit 420B is connected to the pulley 427B via a connection shaft 426B, and the belt 428B is stretched between the pulley 427B and a pulley rotationally driven by the motor M3. Then, a rotational drive of the motor M3 is transmitted to the belt 424B via the belt 428B, the pulley 427B, the connection shaft 426B, and the pulley 422B. As described above, since the other regulation guide 14B is connected to the belt 424B via the connection portion 425B, the other regulation guide 14B moves in the sheet width direction Y along the support shafts 421A and 421B by the drive of the motor M3.

By driving the motors M2 and M3 in this manner, each of the regulation guides 14A and 14B is moved to the guide position or the retracted position. In the present embodiment, the motors M2 and M3 are pulse motors (stepping motors), and the positions of the regulation guides 14A and 14B are controlled by the number of pulses sent to the motors. The regulation guides 14A and 14B have home positions, and sensors for detecting the regulation guides 14A and 14B are provided at the home positions, respectively. Therefore, the positions of the regulation guides 14A and 14B are detected at the home positions, and thereafter, the regulation guides 14A and 14B are moved to the guide positions or the retracted positions according to the number of pulses sent to the motor.

In the present embodiment, as illustrated in FIG. 3, facing members 450 and 460 facing a lower surface of the sheet conveyed by the conveyor belt 12 are disposed between the conveyor belt 12 and the pair of regulation guides 14A and 14B in the sheet width direction Y. The facing members 450 and 460 support an end portion of the sheet in a case where the sheet is conveyed without being supported by any of the regulation guides 14A and 14B.

In the relay conveyance apparatus 400, the sheet delivered from the conveyance roller pair 401 positioned upstream in the conveyance direction X to the conveyor belt 12 is nipped between the conveyor belt 12 and the spheres 20 and 21. Then, the sheet is conveyed by rotation of the conveyor belt 12. At this time, the side edges of the sheet in the width direction Y abut against the guide surfaces 15A of the pair of regulation guides 14A and 14B, the sheet being conveyed by the conveyor belt 12. When the sheet abuts against the guide surfaces 15A, the sheet is conveyed in a direction parallel to the guide surfaces 15A while slipping between the conveyor belt 12 and the guide surface 15A with the side edges along the guide surfaces 15A. In other words, when the side edges of the sheet abut against the guide surfaces 15A, the sheet is conveyed while being regulated from moving in the sheet width direction Y beyond the guide surfaces 15A by the pair of regulation guides 14A and 14B. At this time, since the sheet is nipped between the conveyor belt 12 and the spheres 20 and 21, and the spheres 20 and 21 are rotatable in an arbitrary direction, the sheet is movable while slipping on the conveyor belt 12 in an arbitrary direction. As a result, the side registration and the side skew of the sheet are corrected. In a case where the sheet is conveyed to the relay conveyance apparatus 400 without substantial misalignment in the sheet width direction and inclination in the conveyance direction, the sheet is not brought into contact with the guide surfaces 15A, and is nipped and conveyed by the conveyor belt 12 and the spheres 20 and 21.

Conveyor Belt Unit

Next, a conveyor belt unit 480 including the conveyor belt 12, the plurality of spheres 20 and 21, and the like will be described with reference to FIGS. 4A to 8B while referring to FIGS. 2 and 3. The conveyor belt unit 480 is a portion of the misalignment correction unit 410 that conveys the sheet by the conveyor belt 12 and the spheres 20 and 21. In the present embodiment, the plurality of spheres 20 and 21 are arranged in two rows as described above.

The plurality of spheres 20 and 21 are rotatably held in an arbitrary direction by holding plates 18 and 19 serving as holding portions disposed along the guide direction for the sheet. The plurality of spheres (first spheres) 20 held by the holding plate 18 are arranged above the conveyor belt 12, and are rotatable in an arbitrary direction while nipping the sheet with the conveyance surface 12A. As illustrated in FIGS. 2 to 4B, the holding plate 18 is a long plate disposed along the conveyance direction X and above the conveyor belt 12 at a position separated from the conveyance surface 12A by a predetermined distance, and has a plurality of holding holes 18*a* spaced apart from each other in the conveyance direction X. The sphere 20 is rotatably held in each of the holding holes 18*a*.

As illustrated in FIGS. 4A and 4B, the holding plate 19 has a plurality of exposure holes 18*b* through which the plurality of spheres 21 can be exposed to a conveyance surface 12A side. That is, in the present embodiment, the two rows of spheres 20 and 21 are disposed on the holding plate 18 and 19, and the holding hole 18*a* and the exposure hole 18*b* are formed at intervals so as to correspond to the spheres 20 and 21, respectively. The plurality of spheres 21 are exposed from the exposure holes 18*b* while being held by the holding plate 19 as described below.

Figure 5:
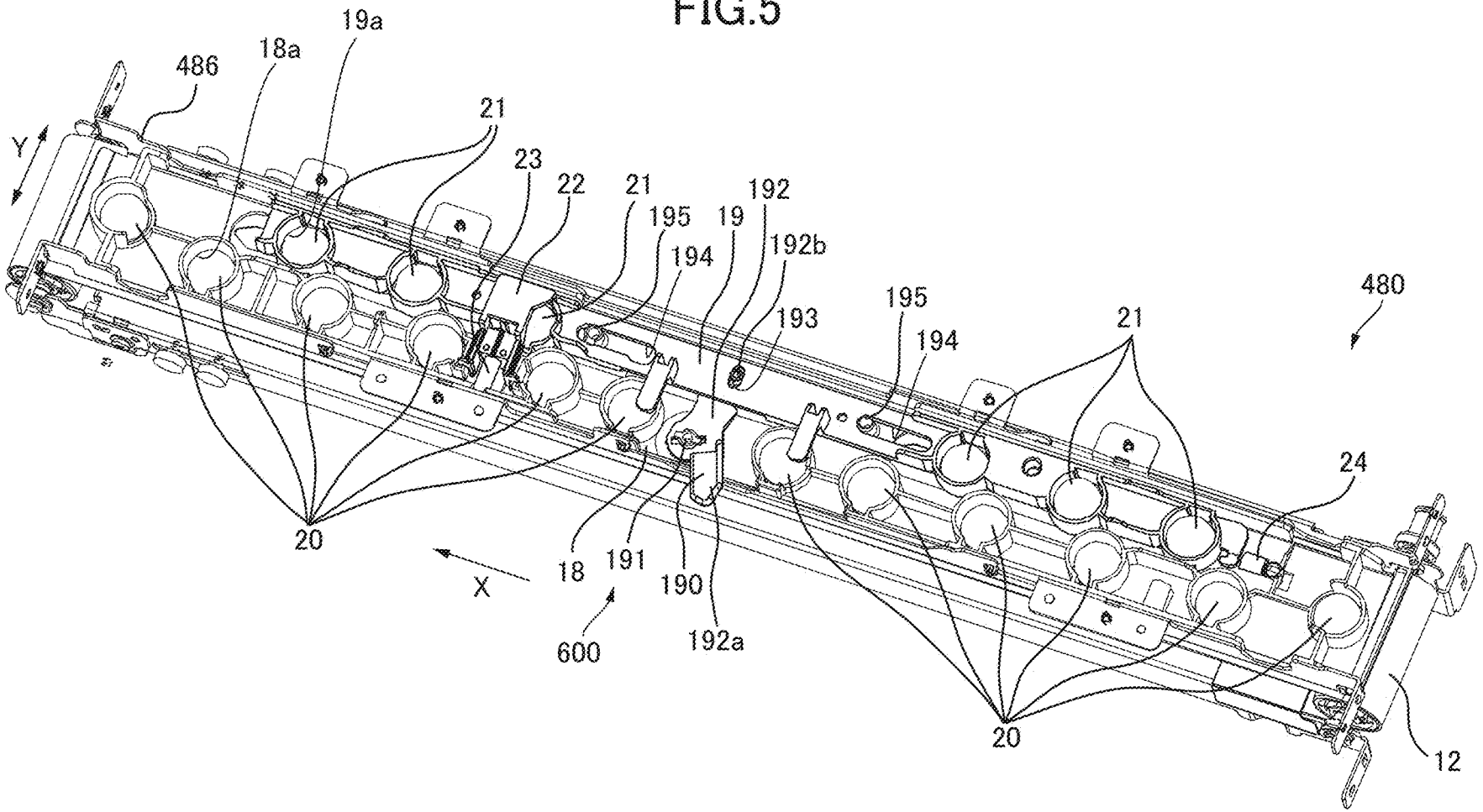
FIG. 5 is a perspective view of the conveyor belt unit of the relay conveyance apparatus according to the first embodiment.

As illustrated in FIG. 5, unlike the other spheres 20 and 21, the spheres 20 held at both ends of the holding plate 18 in the conveyance direction X are arranged such that a central position thereof is a reference central position of the sheet. That is, the position where the centers of the spheres 20 at both ends are aligned is the reference central position of the sheet. The plurality of other spheres 20 are shifted from the reference central position to one side (the right side in FIGS. 3, 4A, and 4B) in the sheet width direction Y. The spheres 21 are disposed at positions shifted from the reference central position to the other side (the left side in FIGS. 3, 4A, and 4B) in the sheet width direction Y.

Here, the reference central position is a position where both a first sheet and a second sheet having different sheet widths (that is, regardless of the size of the sheet) are at the center in the sheet width direction Y. In the present embodiment, the row of spheres 20 and the row of spheres 21 are arranged such that the central positions thereof are equidistant from the reference central position. In addition, in the present embodiment, the sphere 20 and the sphere 21 have the same diameter, but have different weights. Specifically, the sphere 21 is heavier than the sphere 20. In addition, the number of spheres 20 arranged is larger than the number of spheres 21 arranged.

Furthermore, in the present embodiment, the central position of the sphere 21 is disposed between the central positions of two adjacent spheres 20 in the conveyance direction X. This is because it is difficult to secure a range in the sheet width direction Y in which the spheres 20 and 21 can be arranged. That is, there is a small sheet such as a postcard as a type of sheet conveyed by the conveyor belt 12 and the spheres 20 and 21, and in order to guide such a small-sized sheet, it is necessary to bring the regulation guides 14A and 14B close to the conveyor belt 12. Further, the length of the conveyor belt 12 in the sheet width direction needs to be smaller than the width of the small-sized sheet. For this reason, for example, when outer circumferential surfaces of the spheres 20 and 21 are partially disposed outside the conveyor belt 12, the regulation guides 14A and 14B may interfere with the spheres 20 and 21. Therefore, in the present embodiment, the spheres 20 and 21 are arranged so as to alternate with each other in the conveyance direction X, and the central positions thereof are brought close to each other in the sheet width direction, so that a part of the sphere 20 and a part of the sphere 21 overlap each other when viewed in the conveyance direction X.

As a result, even if the spheres 20 and 21 are arranged in two rows, the range in the sheet width direction in which the spheres 20 and 21 are arranged can be narrowed, and interference with the regulation guides 14A and 14B can be prevented. In the present embodiment, the spheres 20 and 21 are arranged so as to entirely fall within the range of the conveyor belt 12 in the sheet width direction Y. As described below, the sphere 21 moves in the conveyance direction X, and the central position of the sphere 21 is disposed between the central positions of two adjacent spheres 20 regardless of a position to which the sphere 21 moves.

In addition, in the present embodiment, the spheres 20 on both end sides in the conveyance direction X are arranged at the reference central position as described above. That is, the spheres 20 on both end sides in the conveyance direction X form one row, and the heavier sphere 21 is not arranged. The conveyance roller pairs 401 and 402 are disposed on both sides of the conveyor belt 12 in the conveyance direction X, respectively. Therefore, on both sides of the conveyor belt 12, the conveyance roller pair 401 or the conveyance roller pair 402 also conveys the sheet, and a conveyance force for the sheet can be secured even without the heavier sphere 21. On the other hand, in a case where the sphere 20 is offset from the reference central position, a force of pressing the sheet against the conveyor belt 12 by the sphere 20 is biased in the sheet width direction, and it is difficult to convey the sheet in a well-balanced manner. Therefore, in the present embodiment, the lighter spheres 20 are arranged at the reference central position at both ends of the conveyor belt 12, so that the sheet is conveyed in a well-balanced manner.

A mechanism for holding the spheres 21 has a function of moving in the conveyance direction X as described below, and thus it is difficult to arrange a large number of spheres 21. Therefore, in the present embodiment, the number of spheres 21 is smaller than that of spheres 20, and the weight of the sphere 21 is larger than that of the sphere 20. Even with a small number of spheres 21, an appropriate conveyance force can be obtained in a case where the sheet is nipped and conveyed between the conveyor belt 12 and the spheres 20 and 21 at the contact position described below. The weight of the sphere 21 and the weight of the sphere 20 may be the same when a large number of spheres 21 are arranged or the like. Furthermore, the sphere 20 and the sphere 21 may have different sizes.

The plurality of spheres 21 (second spheres) held by the holding plate 19 are arranged above the conveyor belt 12 and are movable to the contact position illustrated in FIG. 4A and the separated position illustrated in FIG. 4B. The separated position is preferably a position where the sphere 21 is not exposed from a lower surface of an upper frame body 486 facing the conveyance surface 12A. However, as long as a distance to the conveyance surface 12A can be sufficiently secured, a part of the sphere 21 may be exposed from the lower surface of the upper frame body 486.

The holding plate 19 is a long plate disposed on the holding plate 18 so as to be reciprocal in the conveyance direction X. That is, the holding plate 19 is disposed on the holding plate 18 along the conveyance direction X at a position shifted from the row of spheres 20 in the sheet width direction Y. Such a holding plate 19 has a plurality of holding holes 19*a* spaced apart from each other in the conveyance direction X. The sphere 21 is rotatably held in each of the holding holes 19*a*. The position of the sphere 21 can be arbitrarily selected between the separated position and the contact position with respect to the conveyance surface 12A according to the position of the holding plate 19 in the conveyance direction X. In the present embodiment, as described in detail below, the reciprocating movement of the holding plate 19 in the conveyance direction X is made by the regulation guides 14A and 14B. In the present embodiment, the movement of the sphere 21 and the holding plate 19 is implemented by operating the regulation guides 14A and 14B without adding a new actuator or the like.

This will be described in more detail with reference to FIGS. 4A, 4B, and 5. As described above, in the conveyor belt unit 480, the plurality of spheres 20 are rotatably held on the holding plate 18, and the plurality of spheres 21 are rotatably held on the holding plate 19 that is slidably movable in the conveyance direction X on the holding plate 18. The holding plate 18 is fixed on the upper frame body 486 of the conveyor belt unit 480. The upper frame body 486 is fixed to a casing of the relay conveyance apparatus 400. Therefore, in the present embodiment, the holding plate 18 is fixed on the upper frame body 486, and the holding plate 19 is slidably disposed on the holding plate 18. The upper frame body 486 has exposure holes 486*a* and guide holes 486*b* through which the plurality of spheres 20 and 21 held by the holding plates 18 and 19 can be exposed to the conveyor belt 12. The exposure hole 486*a* is formed at a position corresponding to the sphere 20. The guide hole 486*b* is formed at a position corresponding to the sphere 21. Then, as described in detail below, when the sphere 21 moves together with the holding plate 19, the sphere 21 moves with respect to the guide hole 486*b*, and the sphere 21 moves between the contact position where the sphere 21 comes into contact with the conveyor belt 12 and the separated position where the sphere 21 is separated from the conveyor belt 12.

On the other hand, the conveyor belt 12 is supported by a conveyor belt support member 481. Similarly to the holding plate 18, the conveyor belt support member 481 is made of a long plate member extending in the conveyance direction X. As illustrated in FIGS. 4A and 4B, the conveyor belt support member 481 has a conveyor belt support surface 482 that supports the conveyor belt 12 from the back surface. The conveyor belt support surface 482 is formed over substantially the entire length of the conveyor belt support member 481 in the conveyance direction X. The conveyor belt support member 481 is disposed such that the conveyor belt support surface 482 faces the plurality of spheres 20 and 21 with the conveyor belt 12 interposed therebetween.

With such a configuration, the sphere 20 held by the holding plate 18 protrudes from the upper frame body 486 and, the own weight of the sphere 20 imposes a load on the conveyance surface 12A of the conveyor belt 12 supported by the conveyor belt support surface 482. The sphere 21 also protrudes from the upper frame body 486, faces the conveyance surface 12A of the conveyor belt 12 supported by the conveyor belt support surface 482, and is configured to be selectively movable to the contact position and the separated position with respect to the conveyance surface 12A by sliding of the holding plate 19. As described above, FIG. 4A illustrates a state where the sphere 21 comes into contact with the conveyance surface 12A, and FIG. 4B illustrates a state where the sphere 21 is separated from the conveyance surface 12A.

Sphere Separation/Contact Operation

Next, a configuration in which the spheres 21 held by the holding plate 19 are separated from and come into contact with the conveyor belt 12 will be described in detail with reference to FIGS. 5 to 10. First, the configurations of the sphere 20 and the sphere 21 will be described with reference to FIG. 5. As described above, the spheres 20 and the spheres 21 are arranged in two rows in the conveyance direction X, and in the present embodiment, the number of spheres 20 is 12 and the number of spheres 21 is 6. The number of spheres 20 and the number of spheres 21 can be set as appropriate. However, in the present embodiment, the number and arrangement of lighter spheres are set such that at least three of the lighter spheres 20 can come into contact with and convey the smallest sheet that can be conveyed by the apparatus. The sphere 20 is rotatably held by the holding plate 18, and the sphere 21 is rotatably held by the holding plate 19 slidably disposed on the holding plate 18.

A rotary link 190 is further connected to the holding plate 19, and the holding plate 19 and the sphere 21 can slide in the conveyance direction X in conjunction with rotation of the rotary link 190. The rotary link 190 has a body portion 192 pivotable around a pivot shaft 191, and an arm portion 192*a* protruding toward a front side (a regulation guide 14A side) of the relay conveyance apparatus 400 is integrally formed with the body portion 192. A protruding portion (boss) 192*b* is provided on a back side (a rear side and a regulation guide 14B side) of the body portion 192, and the protruding portion 192*b* can enter an engagement hole 193 formed in the holding plate 19 and be engaged with the engagement hole 193. The engagement hole 193 is a long hole having a large length in the sheet width direction. The engagement hole 193 is formed at a substantially central position of the holding plate 19 in the conveyance direction X.

Long holes 194 that are long in the conveyance direction X are formed on both sides of the engagement hole 193 of the holding plate 19 in the conveyance direction X. A projecting portion 195 projecting from the holding plate 18 enters each of the long holes 194, and the projecting portion 195 can be engaged with the long hole 194. With such a configuration, when the rotary link 190 pivots around the pivot shaft 191, the holding plate 19 tends to move in a pivot direction of the rotary link 190 by the engagement between the protruding portion 192*b* and the engagement hole 193. At this time, a movement direction of the holding plate 19 is regulated to a direction along the conveyance direction X by the engagement between the projecting portion 195 and the long hole 194. Therefore, the holding plate 19 moves in the direction along the conveyance direction X by the pivoting of the rotary link 190.

A claw portion 196 (see FIG. 6B and the like) is provided on a part of the holding plate 19 so as to protrude toward the front side. Meanwhile, a stopper 22 is supported at a position corresponding to the claw portion 196 so as to be movable in the sheet width direction Y with respect to the holding plate 18. As described in detail below, the stopper 22 is engageable with the claw portion 196, and when the holding plate 19 slides by a predetermined amount in the conveyance direction X direction, a claw portion of the stopper 22 and the claw portion 196 of the holding plate 19 are engaged with each other, and the holding plate 19 and the sphere 21 can be held at positions moved by the predetermined amount. In addition, the holding plate 19 is urged in a direction opposite to the conveyance direction X by a tension spring 24, and when the stopper 22 is released, the holding plate 19 and the sphere 21 are returned to the positions before the sliding movement by the tension spring 24. The releasing operation of the stopper 22 is performed by pushing the stopper 22 in a direction of releasing the engagement between the claw portion of the stopper 22 and the claw portion 196 of the holding plate 19.

In the present embodiment, the holding plate 19, the upper frame body 486, the rotary link 190, the stopper 22, the tension spring 24, and the like form a movement mechanism 600 capable of moving the sphere 21 between the contact position and the separated position. The movement mechanism 600 is operated by movement of the pair of regulation guides 14A and 14B. That is, the guide moving unit 420 that moves the pair of regulation guides 14A and 14B and the movement mechanism 600 form a load changing unit 700 that changes a load applied from the sphere 21 to the sheet. The movement mechanism 600 includes the holding plate 19 and the upper frame body 486 serving as a positioning member. The holding plate 19 holds the spheres 21 as a part of the plurality of spheres and is movable between a first position and a second position. The upper frame body 486 positions the sphere 21 at the contact position when the holding plate 19 is at the first position, and positions the sphere 21 at the separated position when the holding plate 19 is at the second position. The movement of the holding plate 19 to the first position and the second position is performed by movement of the pair of regulation guides 14A and 14B as described below. As a result, the load changing unit 700 can change the load applied from the sphere 21 to the sheet between when the sphere 21 is at the contact position and when the sphere 21 is at the separated position. For example, when the sphere 21 is at the contact position, the weight of the sphere 21 acts on the sheet as a load applied from the sphere 21 to the sheet. On the other hand, when the sphere 21 is at the separated position, the load applied from the sphere 21 to the sheet becomes zero.

Figure 8A:
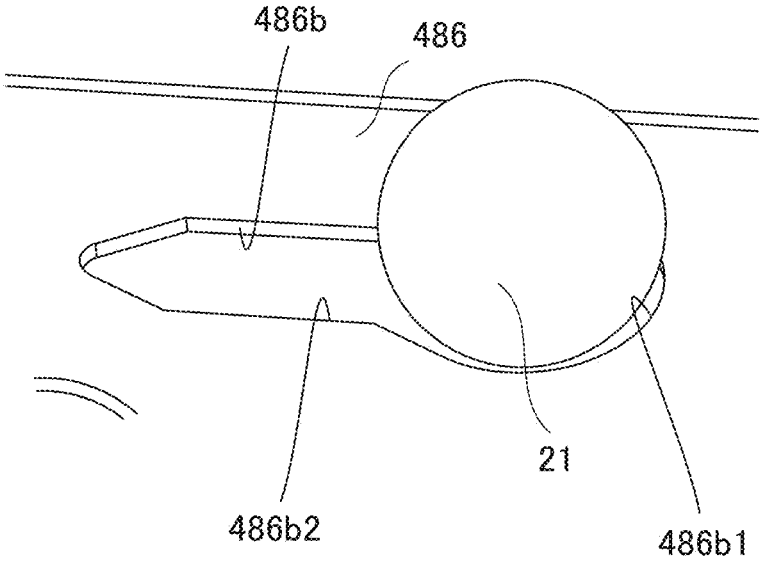
FIG. 8A is a perspective view illustrating a part of a holding plate that holds the spheres in one row according to the first embodiment, in which the spheres are in the contact state.
Figure 8B:
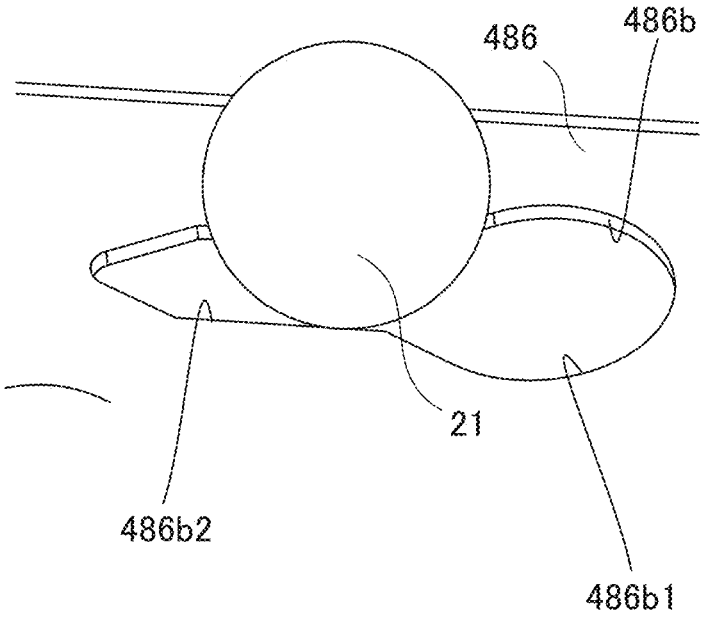
FIG. 8B is a perspective view illustrating a part of the holding plate that holds the spheres in one row according to the first embodiment, in which the spheres are in the separated state.

Specifically, as illustrated in FIGS. 8A and 8B, the guide hole 486*b* is formed in the upper frame body 486. The guide hole 486*b* is formed such that a first hole 486*b*1 opened to such a size that the sphere 21 can fall to a position where the sphere 21 can come into contact with the conveyance surface 12A and a second hole 486*b*2 which is an opening smaller than the first hole 486*b*1 communicate with each other. The first hole 486*b*1 is formed in a circular shape having a diameter equal to or less than that of the sphere 21. On the other hand, the second hole 486*b*2 is a long hole whose length in the sheet width direction Y is sufficiently smaller than the diameter of the first hole 486*b*1 and whose length in the conveyance direction X is sufficiently long enough to allow the sphere 21 to move from the first hole 486*b*1 to the second hole 486*b*2.

When the holding plate 19 is positioned at the first position, the sphere 21 is positioned in the first hole 486*b*1 and comes into contact with the conveyance surface 12A. On the other hand, when the holding plate 19 is positioned at the second position, the sphere 21 is positioned in the second hole 486*b*2 and separated from the conveyance surface 12A. The holding plate 19 holding the sphere 21 moves to the first position when one regulation guide 14B of the pair of regulation guides 14A and 14B moves to a first predetermined position, and the holding plate 19 holding the sphere 21 moves to the second position when the other regulation guide 14A moves to a second predetermined position.

Figure 6A:
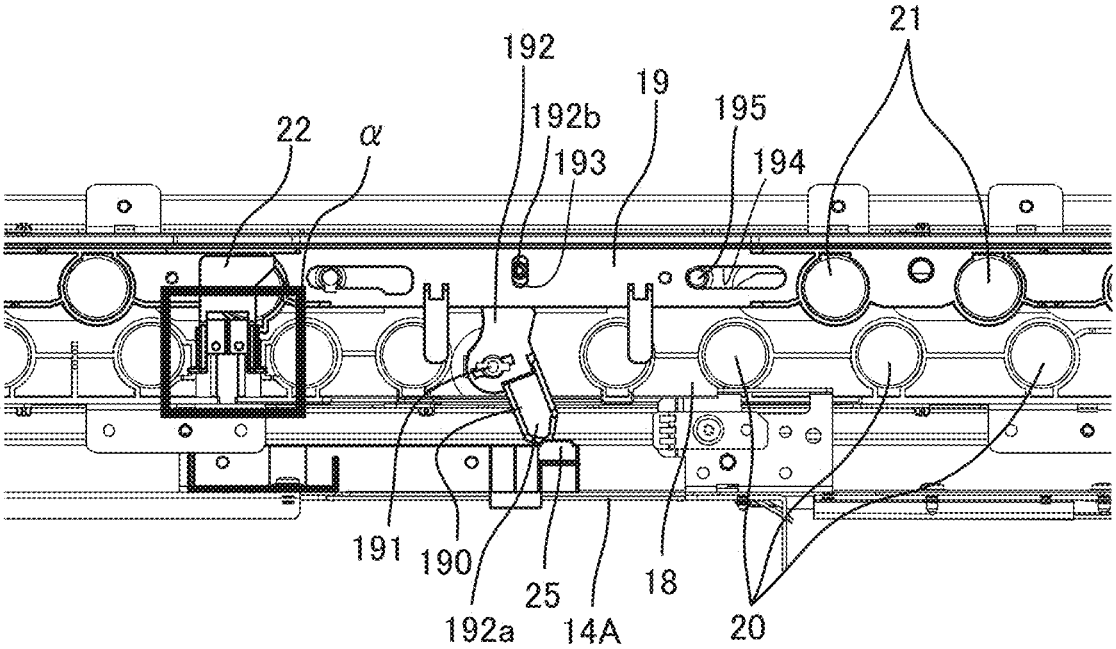
FIG. 6A is a plan view of the conveyor belt unit according to the first embodiment, which illustrates a contact state where the spheres in both rows come into contact with the sheet.
Figure 6B:
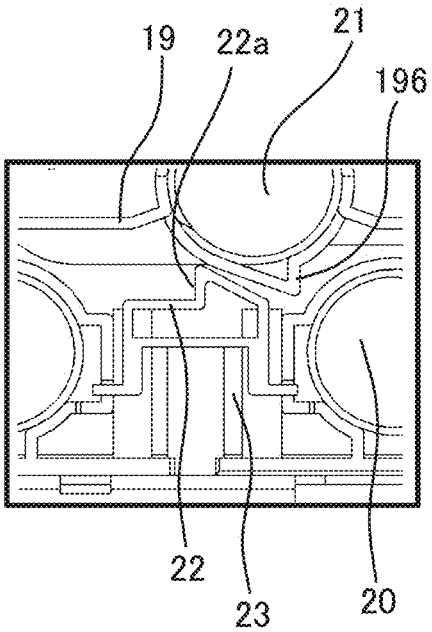
FIG. 6B is an enlarged cross-sectional view of a portion $\alpha$ in FIG. 6A.

The operation of moving the sphere 21 to the contact position and the separated position will be described in more detail. First, a separation operation of moving the sphere 21 to the separated position from the conveyance surface 12A of the conveyor belt 12 will be described. FIGS. 6A and 6B illustrate a state where the sphere 21 is at the contact position where the sphere 21 comes into contact with the conveyance surface 12A. That is, a contact state where the spheres 20 and 21 in both rows come into contact with the sheet is illustrated. In a state where the sphere 21 is at the contact position, the claw portion 196 of the holding plate 19 is not caught by a claw portion 22*a* of the stopper 22 as illustrated in FIG. 6B. As a result, the holding plate 19 is held at the first position by an urging force of the tension spring 24.

Figure 6C:
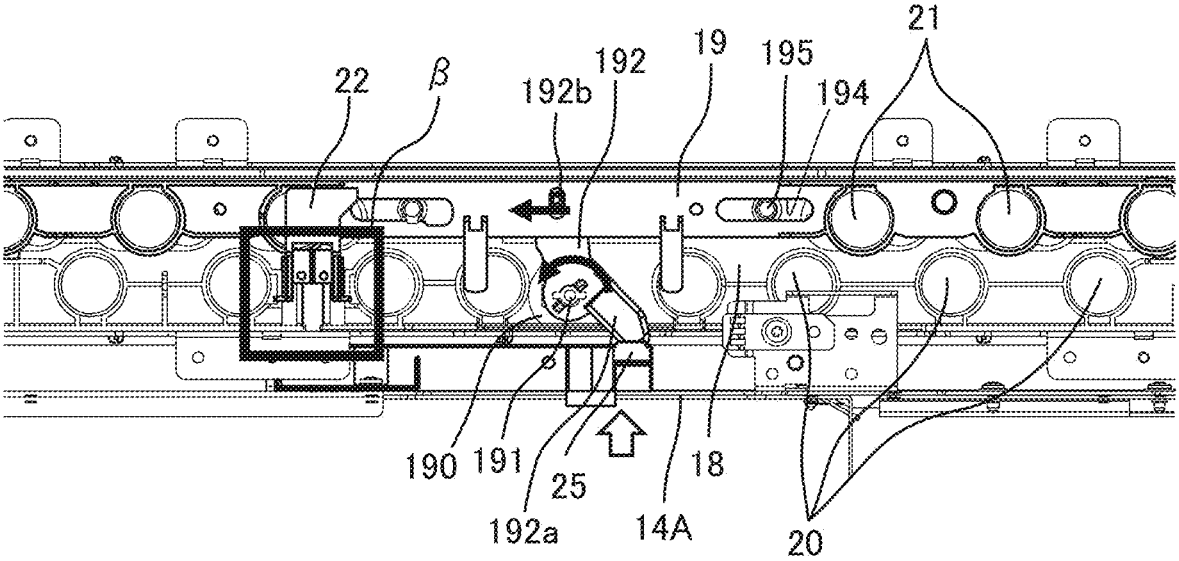
FIG. 6C is a plan view of the conveyor belt unit according to the first embodiment, which illustrates the separated state where the spheres in one row are separated from the sheet.

In this state, the motor M2 is driven to move the regulation guide 14A on the front side toward the conveyor belt 12. As illustrated in FIGS. 6C and 10, when the regulation guide 14A reaches the first predetermined position, the arm portion 192*a* of the rotary link 190 is pushed by a link pressing portion 25 provided in the regulation guide 14A so as to protrude toward the conveyor belt 12. Then, the rotary link 190 rotates counterclockwise in FIG. 6C around the pivot shaft 191.

The protruding portion 192*b* provided on the body portion 192 of the rotary link 190 is engaged with the engagement hole 193 of the holding plate 19, and the projecting portion 195 provided on the holding plate 18 positioned below is further engaged with the long hole 194 of the holding plate 19. The long hole 194 is formed in the conveyance direction X, and regulates the movement direction of the holding plate 19 to the conveyance direction X. Therefore, the holding plate 19 slides to the right in FIG. 6C in the conveyance direction X against the urging force of the tension spring 24 in conjunction with the rotation of the rotary link 190. Here, since the sphere 21 is rotatably held by the holding plate 19, the sphere 21 moves in the same direction as that of the holding plate 19 in conjunction with the sliding movement of the holding plate 19.

Figure 6D:
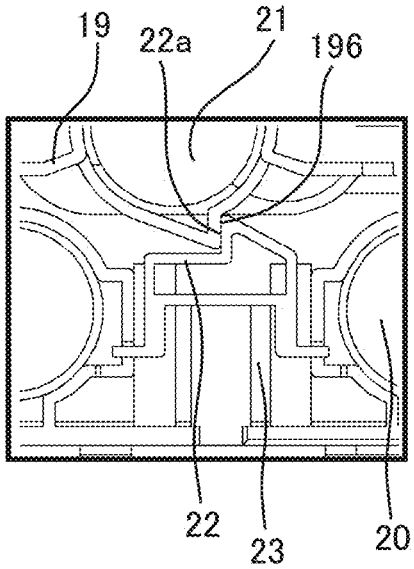
FIG. 6D is an enlarged cross-sectional view of a portion $\beta$ in FIG. 6C.

When the holding plate 19 and the sphere 21 slide by a predetermined amount to reach the second position from the first position, the claw portion 22*a* of the stopper 22 and the claw portion 196 of the holding plate 19 are engaged to move the stopper 22 to the front side (the lower side in FIGS. 6A to 6D). As illustrated in FIGS. 6B, 6D, and 9, the stopper 22 is urged toward the back side (the upper side in FIGS. 6A to 6D, and the left side in FIG. 9) by a pressing spring 23. Therefore, when the claw portion 22*a* of the stopper 22 and the claw portion 196 of the holding plate 19 are engaged by the sliding movement of the holding plate 19 described above, the stopper 22 moves toward the front side against an urging force of the pressing spring 23. As a result, when the claw portion 196 of the holding plate 19 moves beyond the claw portion 22*a* of the stopper 22, the stopper 22 returns to the back side by the urging force of the pressing spring 23, and the claw portion 196 of the holding plate 19 and the claw portion 22*a* of the stopper 22 are engaged to hold the holding plate 19 and the sphere 21 at the second position as illustrated in FIG. 6D.

At this time, the sphere 21 moves from the position in FIG. 8A to the position in FIG. 8B by sliding to the second position together with the holding plate 19. That is, the sphere 21 slides along the guide hole 486*b* from the first hole 486*b*1 to the second hole 486*b*2. As described above, the second hole 486*b*2 is formed to be narrower than the first hole 486*b*1. Therefore, when the sphere 21 moves on the guide hole 486*b* to the second hole 486*b*2, the sphere 21 moves upward and is separated from the conveyance surface 12A. Such a state is a state where the sphere 21 has moved to the separated position.

Figure 7A:
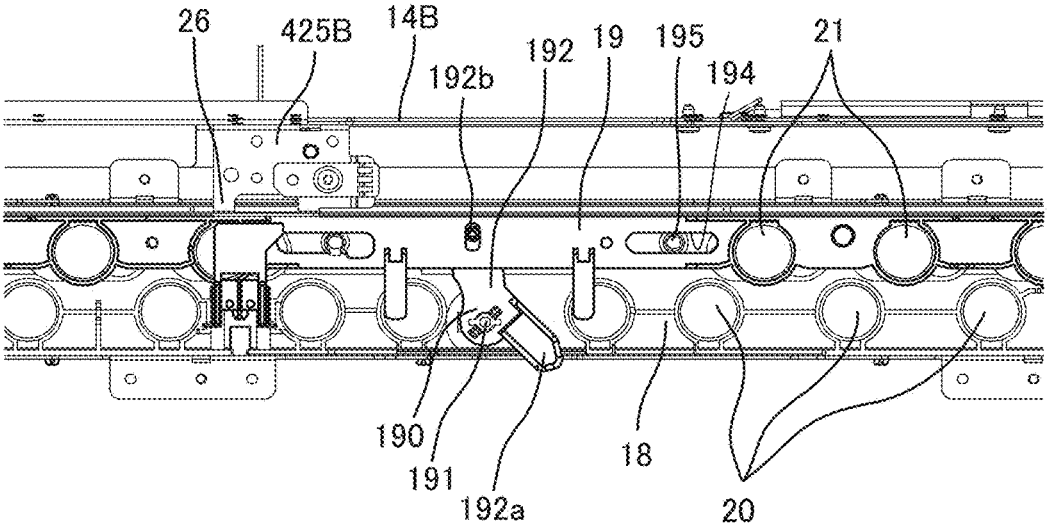
FIG. 7A is a plan view of the conveyor belt unit according to the first embodiment, which illustrates the separated state where the spheres in one row are separated from the sheet.

Next, a contact operation of moving the sphere 21 from the separated position to the contact position where the sphere 21 comes into contact with the conveyance surface 12A of the conveyor belt 12 will be described. FIG. 7A illustrates a state where the sphere 21 is at the separated position where the sphere 21 is separated from the conveyance surface 12A. That is, FIG. 7A illustrates a separated state where the spheres 21 in one row are separated from the sheet, and the state in FIGS. 6C and 6D described above corresponds to the separated state. In a state where the sphere 21 is at the separated position, the claw portion 196 of the holding plate 19 is caught by the claw portion 22*a* of the stopper 22 as illustrated in FIG. 6D.

Figure 7B:
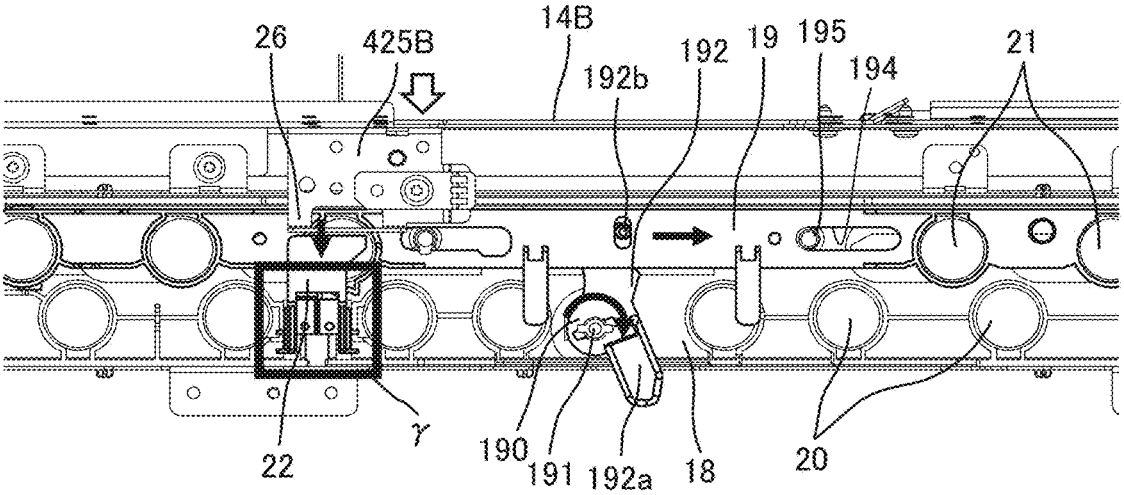
FIG. 7B is a plan view of the conveyor belt unit according to the first embodiment, which illustrates a state when transitioning from the separated state to the contact state where the spheres in both rows come into contact with the sheet.

In this state, the motor M3 is driven to move the regulation guide 14B on the back side toward the conveyor belt 12. As illustrated in FIG. 7B, when the regulation guide 14B reaches the second predetermined position, the stopper 22 is pushed by a pressing portion 26 provided on the regulation guide 14B so as to protrude toward the conveyor belt 12. As illustrated in FIG. 9, the pressing portion 26 is provided at a distal end of a metal plate portion that is adjacent to the conveyor belt 12, the metal plate portion being provided for providing the connection portion 425B that connects the regulation guide 14B and a belt 428B (FIGS. 2 and 3) for moving the regulation guide 14B.

Figure 7C:
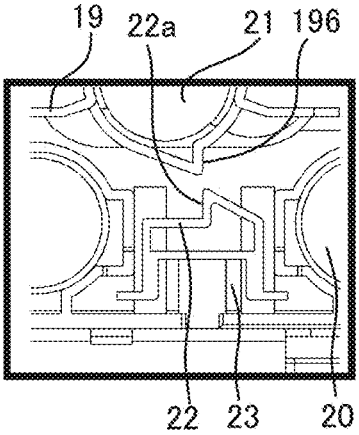
FIG. 7C is an enlarged cross-sectional view of a portion $\gamma$ in FIG. 7B.

In this manner, the stopper 22 is pushed by an operation of moving the regulation guide 14B toward the conveyor belt 12, and moves to the front side (the lower side in FIGS. 7A to 7C and the right side in FIG. 9). Then, as illustrated in FIG. 7C, the claw portion 22*a* of the stopper 22 and the claw portion 196 of the holding plate 19 are disengaged. When the holding plate 19 and the stopper 22 are disengaged, the holding plate 19 returns in the direction opposite to the conveyance direction X (the right side in FIGS. 7A to 7C) by the tension spring 24.

At this time, the sphere 21 moves from the position in FIG. 8B to the position in FIG. 8A by sliding to the first position together with the holding plate 19. That is, the sphere 21 slides along the guide hole 486*b* from the second hole 486*b*2 to the first hole 486*b*1. As described above, the first hole 486*b*1 is a hole opened such that the sphere 21 can come into contact with the conveyance surface 12A. Therefore, when the sphere 21 moves on the guide hole 486*b* to the first hole 486*b*1, the sphere 21 moves downward and comes into contact with the conveyance surface 12A. Such a state is a state where the sphere 21 has moved to the contact position.

Sphere Separation/Contact Control

Control related to the separation and contact operations of the sphere 21 with respect to the conveyance surface 12A of the conveyor belt 12 will be described. As described above, each unit of the multistage feeding apparatus 200 is controlled by the control unit 203 (FIG. 1). The control unit 203 controls the separation and contact operations of the spheres 21 according to a grammage of the sheet. That is, the control unit 203 operates the load changing unit 700 such that the load applied from the spheres 21 to the sheet is larger in a case where the grammage of the sheet is a first grammage than in a case where the grammage of the sheet is a second grammage smaller than the first grammage. Specifically, in a case where the grammage of the sheet is equal to or larger than a predetermined grammage, the sphere 21 is positioned at the contact position. On the other hand, in a case where the grammage of the sheet is smaller than the predetermined grammage, the sphere 21 is positioned at the separated position. The predetermined grammage is, for example, 351 $g/m^2$.

For example, a user inputs sheet information such as the grammage and size of the sheet via an input unit (for example, an operation panel) 1001 (FIG. 1) provided in the image forming system 1000. The input unit 1001 corresponds to a sheet information recognition unit that recognizes the sheet information. The control unit 203 controls the load changing unit 700 according to the sheet information input to the input unit 1001. That is, the control unit 203 drives any one of the regulation guides 14A and 14B by controlling the motors M2 and M3 of the guide moving unit 420 before the sheet is conveyed to the relay conveyance apparatus 400 based on the sheet information, and causes the movement mechanism 600 to position the sphere 21 at the separated position or the contact position as described above.

The control of the separation and contact operations of the spheres 21 is not limited to being based on the grammage of the sheet, and may be performed according to a stiffness of the sheet, for example. That is, the sphere 21 is positioned at the contact position in a case where the stiffness of the sheet is equal to or higher than a predetermined stiffness, and the sphere 21 is positioned at the separated position in a case where the stiffness of the sheet is lower than the predetermined stiffness. The predetermined stiffness is, for example, 54 mN. Furthermore, the separation and contact operations of the sphere 21 may be switched based on user's selection. That is, the control unit 203 may have a mode in which the sphere 21 is positioned at the contact position according to the user's selection. For example, when the user operates the input unit 1001 to select this mode, the control unit 203 positions the sphere 21 at the contact position. On the other hand, in a case where this mode is not selected, the sphere 21 is positioned at the separated position.

As described above, in the present embodiment, since some spheres 21 among the plurality of spheres 20 and 21 are movable to the contact position and the separated position where the spheres 21 come into contact with the conveyance surface 12A of the conveyor belt 12, it is possible to provide the relay conveyance apparatus 400 that can obtain an appropriate conveyance force associated to the type of the sheet. That is, the sphere 21 can be positioned at the contact position or the separated position according to the grammage or stiffness of the sheet.

For example, when the grammage is large and the conveyance force for the sheet is required, the conveyance force of the conveyor belt unit 480 for the sheet can be secured by moving the sphere 21 to the contact position, so that the sheet can be stably conveyed. On the other hand, in a case where the sheet has a small grammage, when the nip pressure applied to the sheet is excessively high, the sheet may be buckled. Such a sheet does not require a large conveyance force. Therefore, conveyance can be performed in a state where the nip pressure applied to the sheet is reduced by positioning the sphere 21 at the separated position, and buckling of the sheet due to the load applied from the sphere can be reduced and stable skew correction can be performed at the time of aligning the sheet by the regulation guides 14A and 14B.

JP 2007-217096 A described above describes a configuration in which some spheres are separated from the conveyor belt and a gap therebetween can be adjusted, but in a case of such a configuration, adjustment in micron units according to the thickness of the sheet is required. On the other hand, in the present embodiment, the sphere 21 moves to the contact position with respect to only the sheet requiring the conveyance force, and otherwise, the sphere 21 moves to the separated position, and such adjustment is not necessary. In addition, although the configuration described in JP 2007-217096 A is a configuration in which the gap is manually adjusted, it takes time and effort for the user to manually adjust the gap every time the type of the sheet is changed. On the other hand, in the present embodiment, since the gap between the sphere 21 and the conveyor belt 12 can be adjusted by moving the regulation guides 14A and 14B, an appropriate conveyance force associated to the type of the sheet can be easily obtained.

In the present embodiment, the sphere 21 is moved to the separated position and the contact position by moving the regulation guides 14A and 14B. Therefore, a new actuator is not required to move the sphere 21, and the above-described configuration can be implemented at low cost.

In the present embodiment, the sphere 21 is moved by pressing the regulation guides 14A and 14B. However, the sphere 21 may also be moved by a dedicated actuator. For example, the holding plate 19 may be directly slid by a solenoid or the like.

In the present embodiment, the load changing unit 700 can change the load applied from the sphere 21, but the loads applied from both spheres 20 and 21 may be changed. In this case, all the spheres 20 and 21 may be separated from the conveyor belt 12. That is, the loads applied the spheres 20 and 21 to the sheet may be set to zero. In addition, the load applied to both or any one of the spheres 20 and 21 to the sheet may be decreased or increased.

In a case where all the spheres 20 and 21 can be separated from the conveyor belt 12, when the grammage of the sheet is a third grammage, the control unit 203 may regulate the movement of the sheet in the sheet width direction by the regulation guides 14A and 14B while conveying the sheet in the conveyance direction X in a state where the plurality of spheres 20 and 21 are separated from the conveyor belt 12, and then nip the sheet between the plurality of spheres 20 and 21 and the conveyor belt 12. The sheet having the third grammage is, for example, a sheet such as thin paper having a grammage of 80 g/m$^2$ or less. In this case, it is preferable to perform such an operation in a state where the spheres 20 and 21 are separated from the conveyor belt 12. When the grammage of the sheet is the first grammage or the second grammage larger than the third grammage, the control unit 203 regulates the movement of the sheet in the sheet width direction by the regulation guides 14A and 14B while conveying the sheet in the conveyance direction X in a state where the sheet is nipped by the plurality of spheres 20 and 21 and the conveyor belt 12. Further, for example, in a case where the sheet has a grammage of 200 g/m$^2$ or less, the control unit 203 may separate the plurality of spheres 20 and 21 from the conveyor belt 12, and in a case where the sheet has a grammage of larger than 200 g/m$^2$, the control unit 203 may regulate the movement of the sheet in the sheet width direction by the regulation guides 14A and 14B while conveying the sheet in a state where the sheet is nipped between the plurality of spheres 20 and 21 and the conveyor belt 12. As described above, the load (including a load of 0) may be set in two stages, or may be set in a plurality of stages such as three or more stages.

Second Embodiment

Figure 11A:
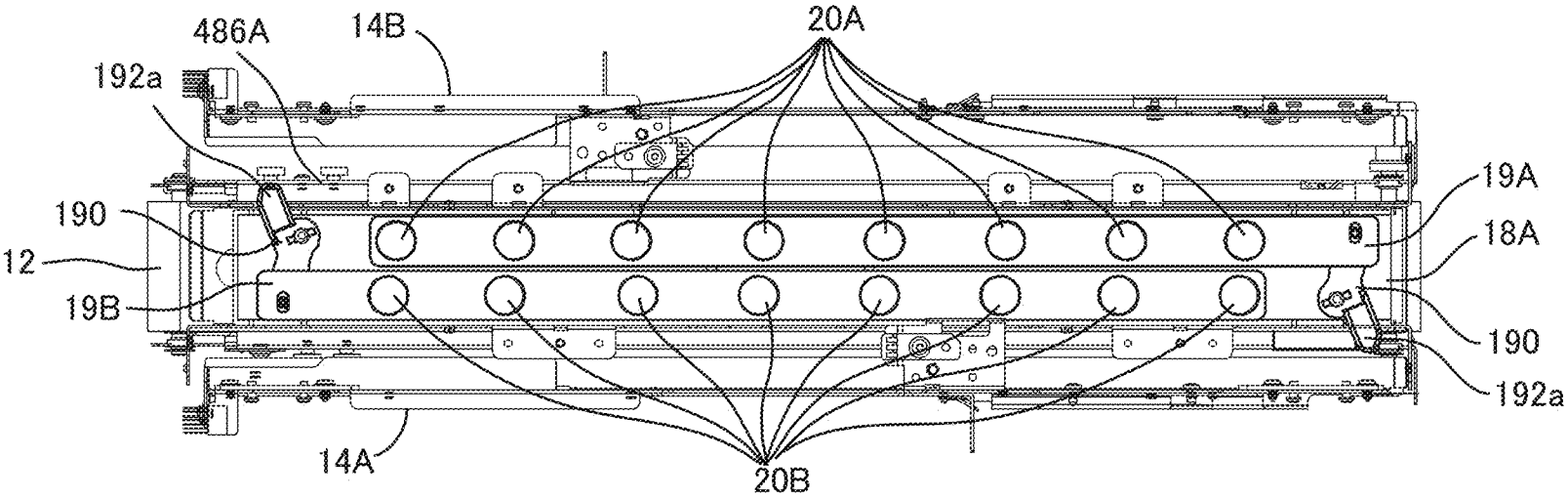
FIG. 11A is a plan view of a conveyor belt unit according to a second embodiment, which illustrates a state where spheres in both rows come into contact with a sheet.
Figure 11B:
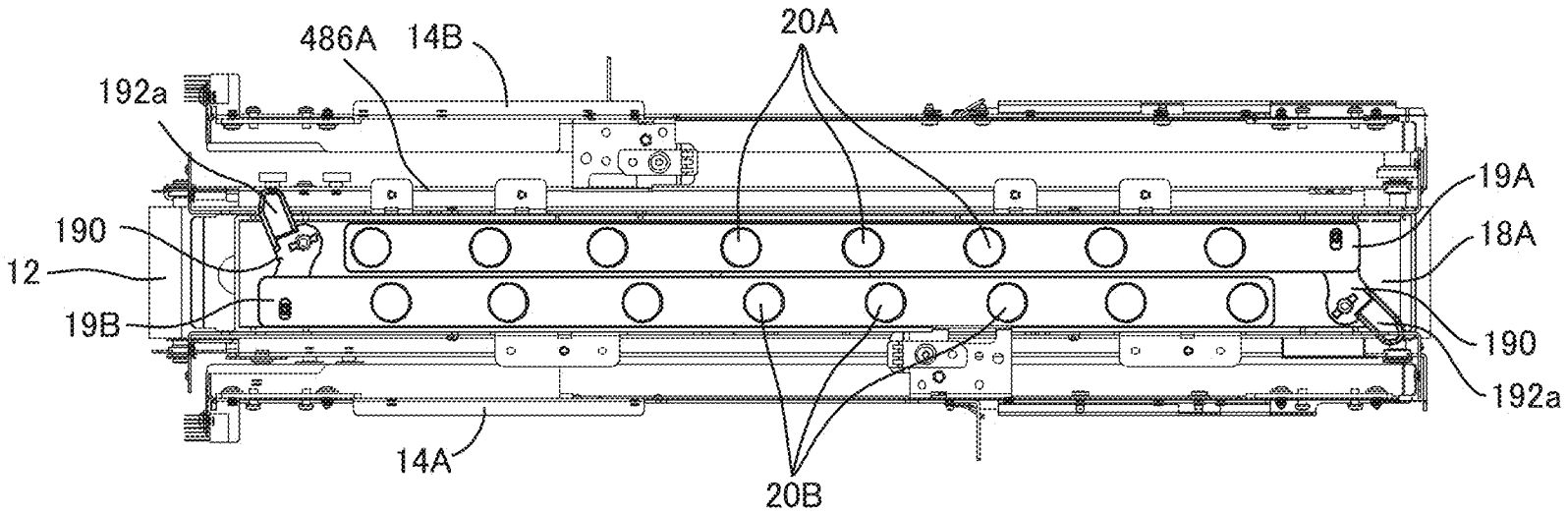
FIG. 11B is a plan view of the conveyor belt unit according to the second embodiment, which illustrates a state where the spheres in the upper row are separated from the sheet.
Figure 12A:
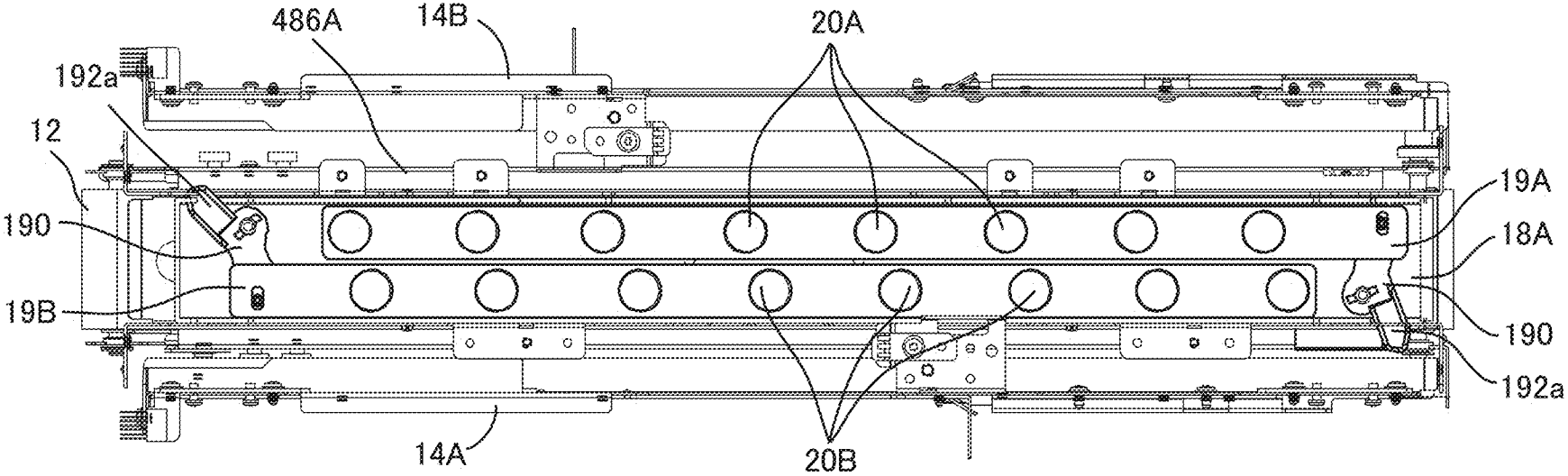
FIG. 12A is a plan view of the conveyor belt unit according to the second embodiment, which illustrates a separated state where the spheres in the lower row are separated from the sheet.
Figure 12B:
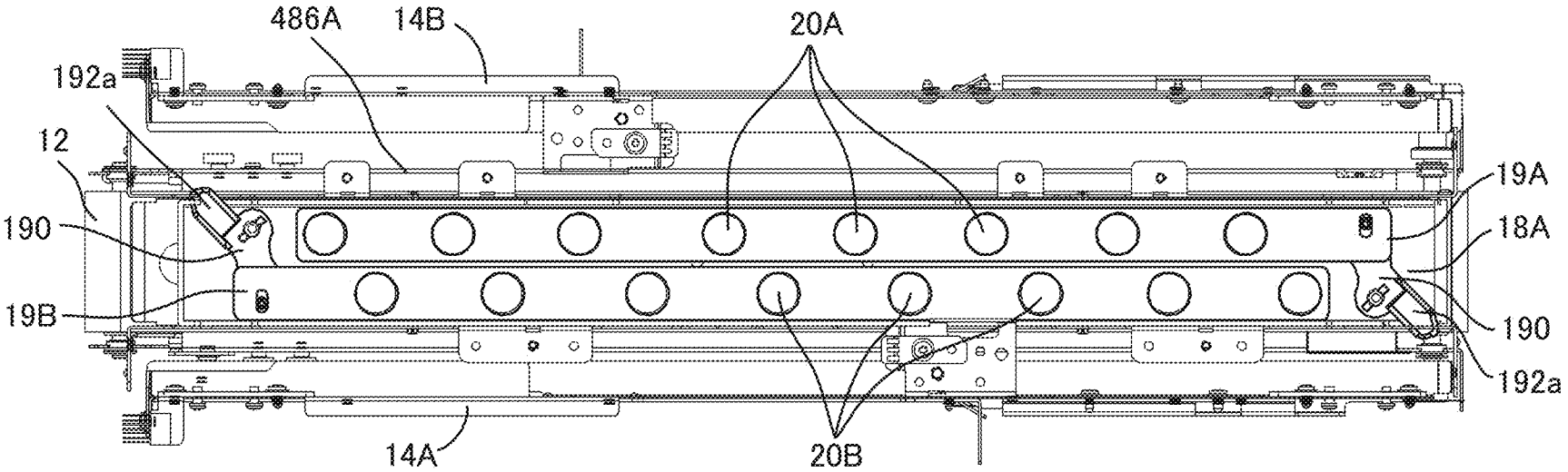
FIG. 12B is a plan view of the conveyor belt unit according to the second embodiment, which illustrates a state where the spheres in both rows are separated from the sheet.
Figure 13:
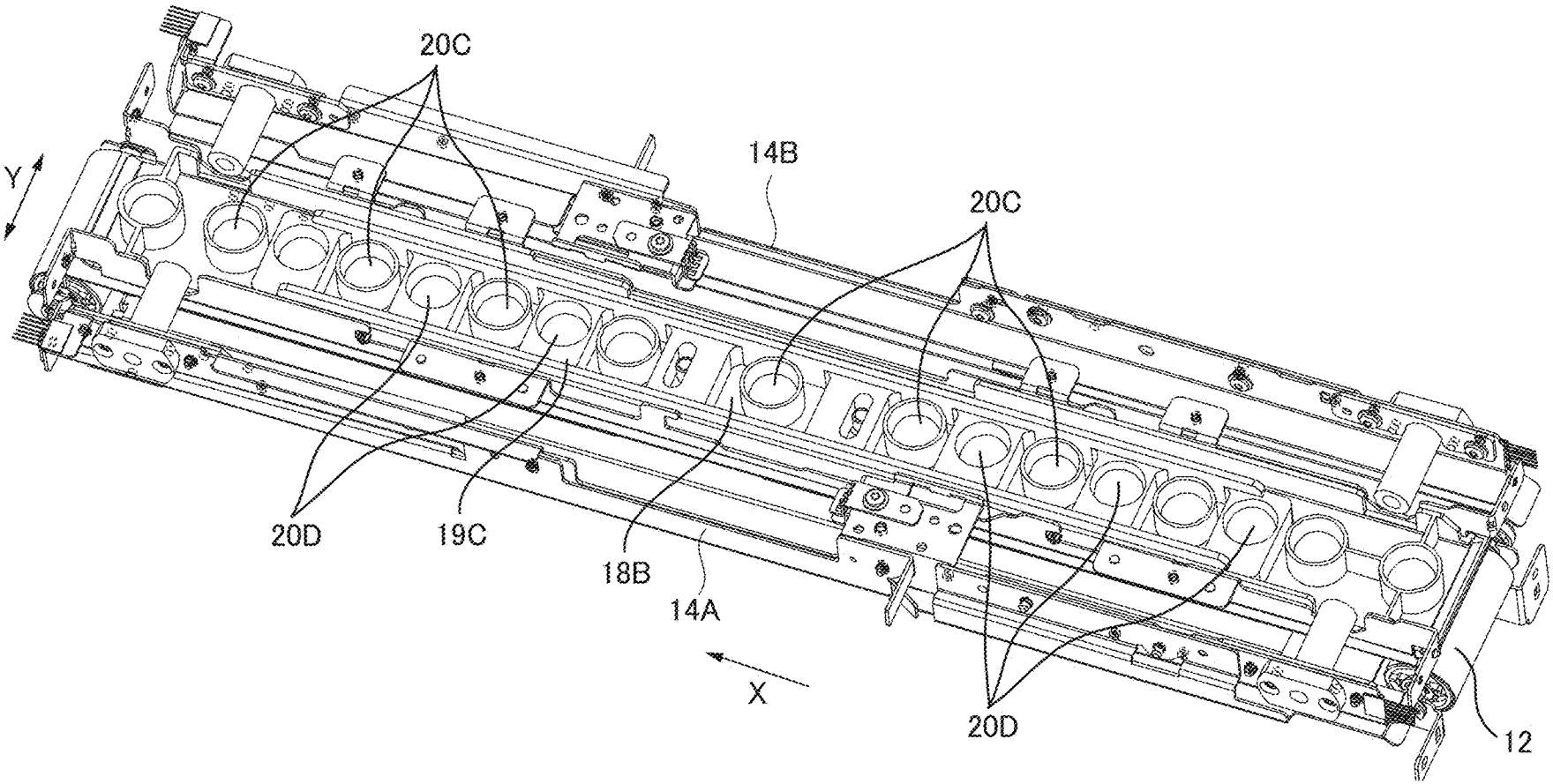
FIG. 13 is a perspective view of a conveyor belt unit according to a third embodiment.

A second embodiment will be described with reference to FIGS. 11A to 12B. In the first embodiment described above, the configuration in which the spheres 21 in one of the two rows of the spheres 20 and 21 are moved to the contact position and the separated position has been described. On the other hand, in the present embodiment, spheres in each row are independently movable to a contact position and a separated position. Specifically, a plurality of spheres 20A are held by a holding plate 19A, and a plurality of spheres 20B are held by a holding plate 19B. When an arm portion 192*a* of a rotary link 190 is pushed by regulation guides 14A and 14B, the holding plates 19A and 19B slide in a conveyance direction X. As a result, a contact/separation state of the spheres 20A and 20B with respect to a conveyance surface 21A can be changed in four patterns of FIGS. 11A to 12B (three patterns for a nip pressure applied to a sheet). FIG. 11A illustrates a state where both of the spheres 20A and 20B are at the contact position where the spheres 20A and 20B come into contact with the conveyance surface 12A. FIG. 11B illustrates a state where the spheres 20A of the spheres 20A and 20B are positioned at the separated position where the spheres 20A are separated from the conveyance surface 12A, and the spheres 20B are at the contact position. FIG. 12A illustrates a state where the spheres 20B of the spheres 20A and 20B are positioned at the separated position and the spheres 20A are positioned at the contact position. FIG. 12B illustrates a state where both the spheres 20A and 20B are at the separated position.

As described above, in the present embodiment, a pressing force of the spheres 20A and 20B against the conveyance surface 12A can be finely set. Therefore, it is possible to more finely set an appropriate conveyance force for a type of the sheet, and it is possible to further improve sheet conveyance performance. The holding plates 19A and 19B may be moved by a dedicated actuator such as a solenoid in addition to the operation of the regulation guides 14A and 14B. In addition, a load applied from both or any one of the spheres 20A and 20B to the sheet may be decreased or increased.

Third Embodiment

A third embodiment will be described with reference to FIGS. 13 to 15B. In the first embodiment described above, the configuration in which the spheres 21 in one of the two rows of spheres 20 and 21 are moved to the contact position and the separated position has been described, but some of the spheres in one row may be movable to the contact position and the separated position.

Specifically, some of a plurality of spheres 20D among spheres 20C and 20D are held by a holding plate 19C serving as a holding portion. The plurality of remaining spheres 20C are held by a holding plate 18B serving as a holding portion. The holding plate 19C is slidable on the holding plate 18B in a sheet width direction Y. When the spheres 20D move in the sheet width direction Y together with the holding plate 19C, the spheres 20D move to a contact position where the spheres 20D come into contact with a conveyance surface 12A and a separated position where the spheres 20D are separated from the conveyance surface 12A.

Figure 14A:
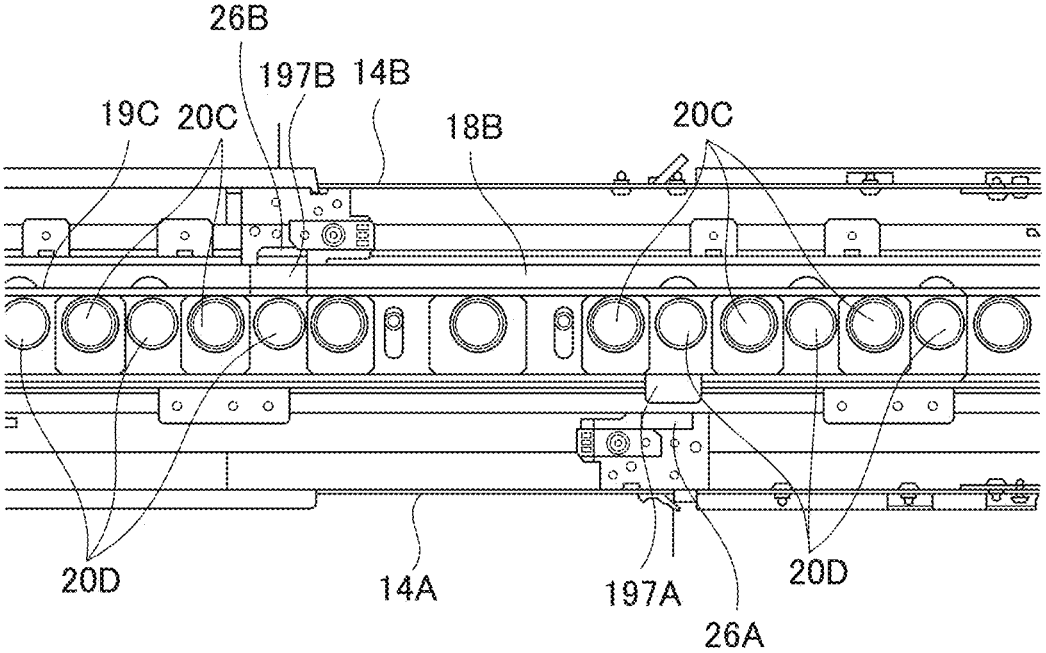
FIG. 14A is a plan view illustrating a state where all spheres come into contact with a sheet in the conveyor belt unit according to the third embodiment.
Figure 14B:
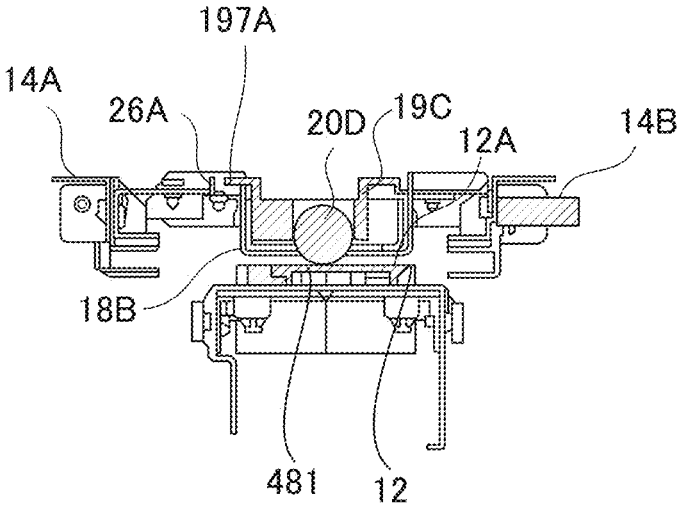
FIG. 14B is a cross-sectional view illustrating a state where all the spheres come into contact with the sheet in the conveyor belt unit according to the third embodiment.
Figure 15A:
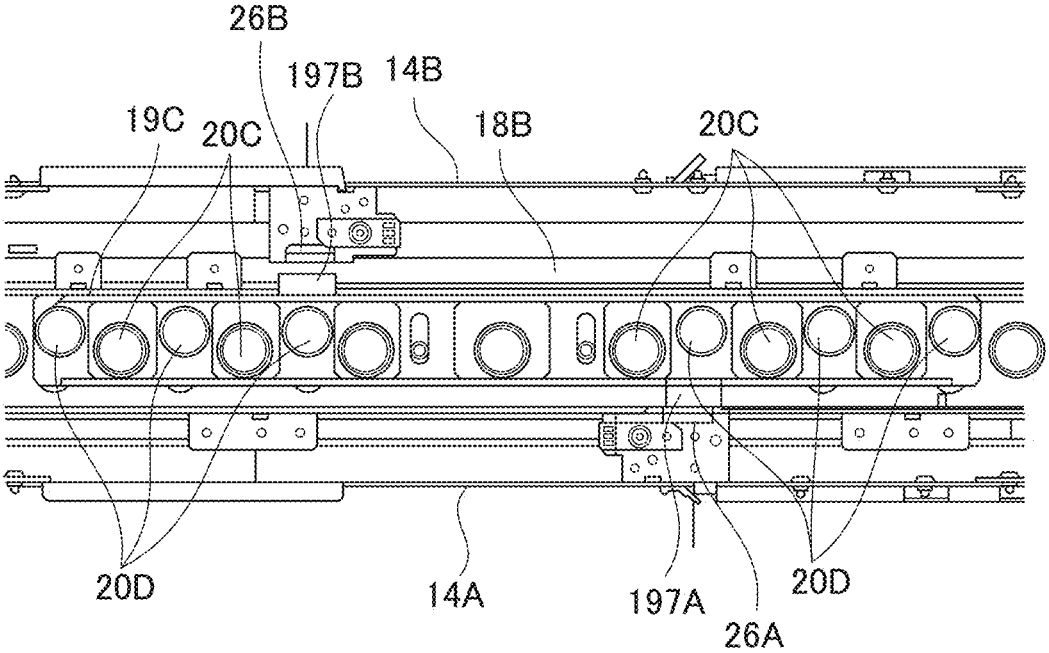
FIG. 15A is a plan view illustrating a state where some spheres are separated from the sheet in the conveyor belt unit according to the third embodiment.
Figure 15B:
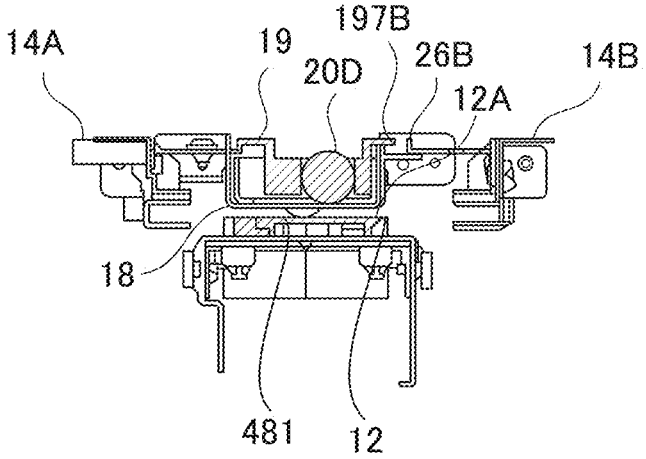
FIG. 15B is a cross-sectional view illustrating a state where some spheres are separated from the sheet in the conveyor belt unit according to the third embodiment.

The holding plate 19C is provided with a receiving member 197A protruding from a side surface facing a regulation guide 14A toward the regulation guide 14A, and a receiving member 197B protruding from a side surface facing a regulation guide 14B toward the regulation guide 14B. In a state where the holding plate 19C is positioned on a front side (the lower side in FIG. 14A and the left side in FIG. 14B), the spheres 20C and 20D are arranged in one row such that the centers thereof are positioned at a reference central position as illustrated in FIG. 14A. In this state, the spheres 20D are positioned at the contact position as illustrated in FIG. 14B. On the other hand, in a state where the holding plate 19C is positioned on a back side (the upper side in FIG. 15A and the right side in FIG. 15B), the spheres 20D are shifted in the sheet width direction with respect to the spheres 20C as illustrated in FIG. 15A. In this state, the spheres 20D are positioned at the separated position as illustrated in FIG. 15B. The holding plate 19C may be moved by a dedicated actuator such as a solenoid in addition to the operations of the regulation guides 14A and 14B as described in the first embodiment.

In the present embodiment, since the spheres 20C and 20D are arranged in one row, space saving can be achieved as compared with the configuration in which the spheres are arranged in two rows. Further, since the regulation guides 14A and 14B can further move toward a conveyor belt 12, even a sheet having a smaller size can be handled.

Also in the present embodiment, loads of both the spheres 20C and 20D may be changeable. In this case, all the spheres 20C and 20D may be separated from the conveyor belt 12. That is, the loads applied from the spheres 20C and 20D to the sheet may be set to zero. In addition, the load applied from both or any one of the spheres 20C and 20D to the sheet may be decreased or increased.

Fourth Embodiment

A fourth embodiment will be described with reference to FIGS. 16A and 16B. In the first to third embodiments described above, the configuration in which the load applied from at least some of the plurality of spheres on the sheet is changed by moving the regulation guides has been described. However, the load applied from the sphere to the sheet may be changed by separately using an actuator without moving the regulation guides. Specifically, a nip pressure of a plurality of spheres and a conveyor belt for a sheet may be changed by changing a pressing force for pressing the spheres.

In the present embodiment, a load changing unit 701 is provided as an actuator that changes a load applied from spheres 20E. The load changing unit 701 includes a pressing portion 710 capable of pressing at least some of the plurality of spheres 20E toward a conveyance surface 12A of a conveyor belt 12, and a pressing force changing portion 720 capable of changing a pressing force of the pressing portion 710 for the spheres 20E. The spheres 20E pressed by the pressing portion 710 may be some or all of the plurality of spheres.

The pressing portion 710 is held by a holding portion 712 on a side opposite to the conveyance surface 12A with respect to the spheres 20E, and is urged toward the spheres 20E by an urging portion 711 such as a spring. In the present embodiment, the pressing portion 710 is disposed above the spheres 20E and urged downward by the urging portion 711. Further, the pressing portion 710 is a sphere or a rotary member whose outer circumferential surface is a cylindrical surface, and is rotatable following the spheres 20E when coming into contact with the spheres 20E.

The pressing force changing portion 720 includes a motor M10 serving as a driving unit, a gear 721 rotationally driven by the motor M10, and a rack portion 722 provided on the holding portion 712 and meshing with the gear 721. The rack portion 722 moves in a vertical direction (a gravity direction in the present embodiment) in FIGS. 16A and 16B together with the holding portion 712 by the rotation of the gear 721. In the present embodiment, the pressing force of the pressing portion 710 for the spheres 20E is changed by driving the motor M10 to move the holding portion 712 via the gear 721 and the rack portion 722. Then, the load applied from the spheres 20E to the sheet is changed by changing the pressing force for the spheres 20E.

Figure 16A:
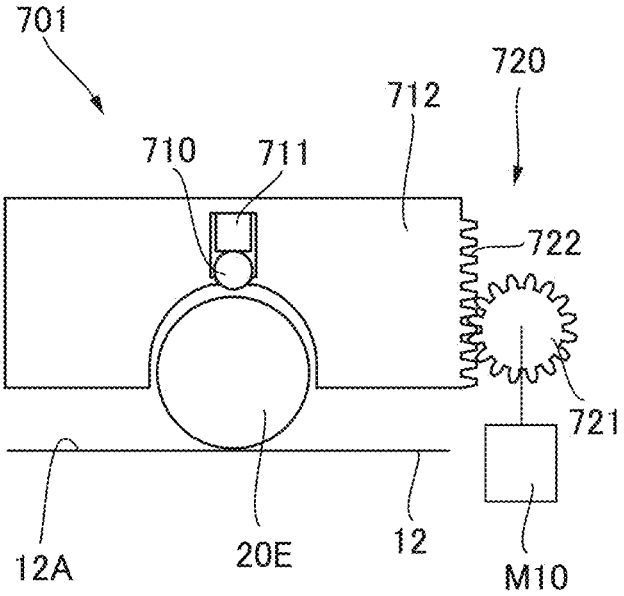
FIG. 16A is a cross-sectional view illustrating a state where a load applied from a sphere to a sheet is decreased in a conveyor belt unit according to a fourth embodiment.
Figure 16B:
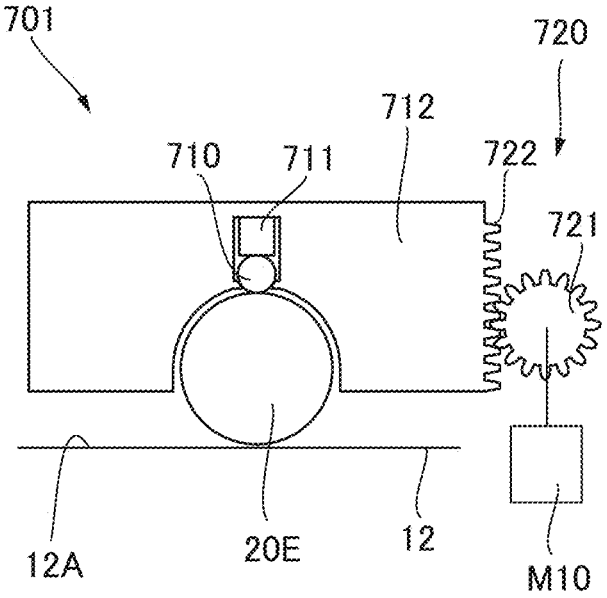
FIG. 16B is a cross-sectional view illustrating a state where the load applied from the sphere to the sheet is increased in the conveyor belt unit according to the fourth embodiment.

That is, in a case where the holding portion 712 is at a position illustrated in FIG. 16A, the pressing portion 710 and the spheres 20E are separated from each other, and the load applied from the spheres 20E to the sheet is small. Even in this state, the spheres 20E come into contact with the sheet conveyed by the conveyor belt 12. Meanwhile, in this state, the holding portion 712 is moved in a direction of approaching the conveyance surface 12A to be positioned at a position illustrated in FIG. 16B. Then, the pressing portion 710 comes into contact with the spheres 20E, and an urging force of the urging portion 711 is further applied to the spheres 20E via the pressing portion 710. A direction of the urging force is a direction in which the spheres 20E are pushed toward the conveyance surface. In this case, the load applied from the spheres 20E to the sheet becomes larger than that in the state illustrated in FIG. 16A.

Furthermore, in the present embodiment, the nip pressure can be more finely adjusted by changing the amount of movement of the holding portion 712 by the pressing force changing portion 720, and for example, a range of a grammage of the sheet that can be conveyed can be widened from thin paper to ultrathick paper, and the most efficient nip pressures for various types of sheets can be set.

Also in the present embodiment, the spheres 20E may be separated from the conveyor belt 12. That is, the load applied from the spheres 20E to the sheet may be set to zero.

Also in the present embodiment, an appropriate conveyance force associated to a type of the sheet can be easily obtained, similarly to each of the above-described embodiments. In the present embodiment, unlike each of the above-described embodiments, the load applied from the spheres 20E to the sheet can be changed without moving the regulation guides. Therefore, the load applied from the spheres 20E to the sheet can be changed even at a timing when the regulation guides cannot be moved.

Fifth Embodiment

A fifth embodiment will be described with reference to FIGS. 17 and 18. In each of the above-described embodiments, as illustrated in FIG. 17, a user inputs sheet information such as a grammage via a recognition unit 1002 provided in an image forming system 1000, and a control unit 203 of a multistage feeding apparatus 200 changes a load applied from spheres 21 to a sheet based on the information.

Examples of the sheet information include a thickness of the sheet and a model number of the sheet in addition to the grammage and stiffness of the sheet. Furthermore, the recognition unit 1002 serving as a sheet information recognition unit is, for example, an input unit 1001 (FIG. 1) such as the operation panel described above, an information reading unit provided in the image forming system 1000, or the like. Examples of the information reading unit include a device that reads a barcode attached to wrapping paper for the sheet or the like, a device that wirelessly reads an IC tag provided on wrapping paper or the like, and a sensor that detects a characteristic of the sheet as described in, for example, JP 2022-90861 A. Examples of the sensor that detects the characteristic of the sheet include a sensor that detects the thickness of the sheet, a sensor that detects the grammage of the sheet, and a sensor that detects a surface property of the sheet.

In any case, it is sufficient if the recognition unit 1002 can recognize the sheet information by inputting or reading the sheet information or can recognize the sheet information by detecting the characteristic of the sheet by the sensor. Furthermore, the recognition unit 1002 may be provided in the multistage feeding apparatus 200 or may be provided in an image forming apparatus 100. In short, the recognition unit 1002 may be provided in any of the apparatuses included in the image forming system 1000. FIGS. 17 and 18 illustrate two examples of a control configuration of the present embodiment.

Figure 17:
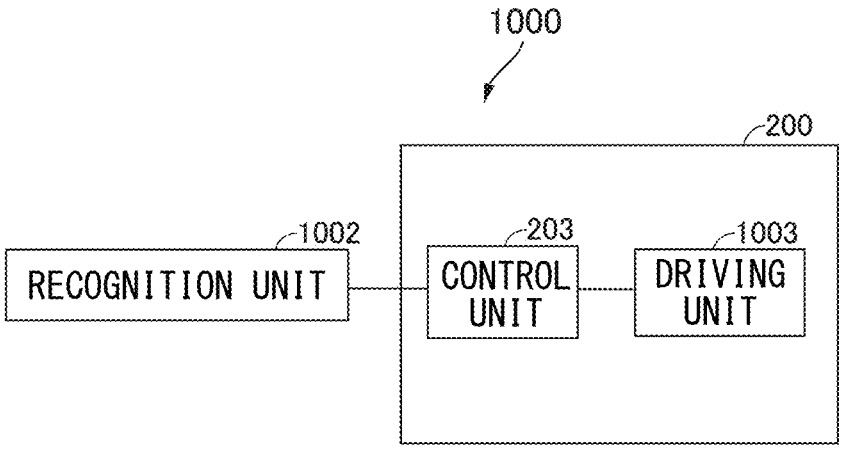
FIG. 17 is a block diagram illustrating a first example of a control configuration according to a fifth embodiment.

In a first example of FIG. 17, the recognition unit 1002 provided in the image forming system 1000 recognizes the sheet information, and the control unit 203 of the multistage feeding apparatus 200 determines a change of a load applied to the sheet according to the information and controls load changing units 700 or 701. Specifically, the control unit 203 controls a driving unit 1003 such as the motors M2 and M3 for moving regulation guides or the motor M10 for moving a holding portion 712 according to the sheet information.

Figure 18:
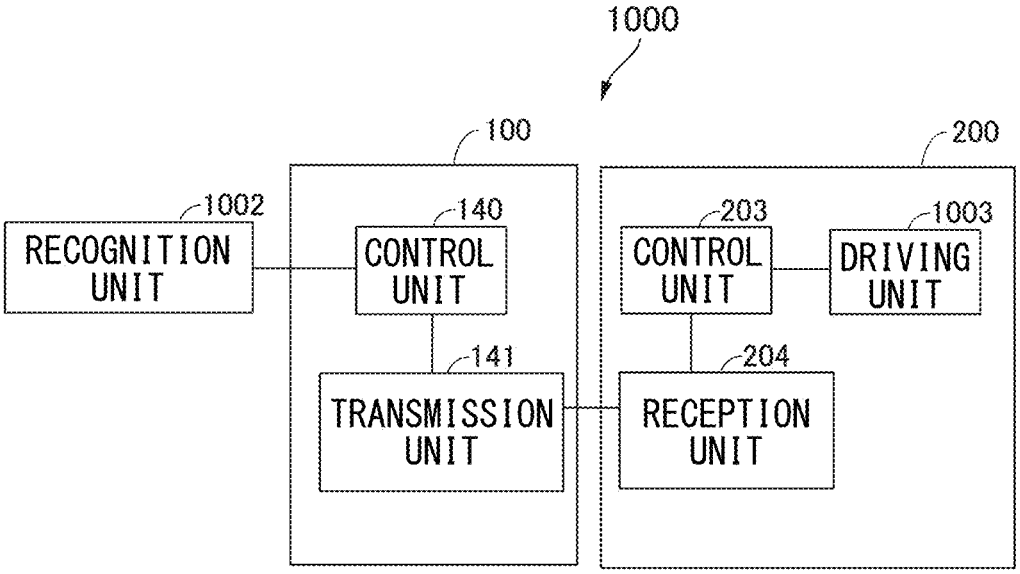
FIG. 18 is a block diagram illustrating a second example of the control configuration according to the fifth embodiment.

On the other hand, in a second example of FIG. 18, the recognition unit 1002 provided in the image forming system 1000 recognizes the sheet information, and a control unit 140 of the image forming apparatus 100 determines the change of the load applied to the sheet according to the information. Then, a command related to the change of the load is transmitted from the control unit 140 to the control unit 203 of the multistage feeding apparatus 200, and the control unit 203 controls the load changing units 700 or 701. For this purpose, the image forming apparatus 100 includes a transmission unit 141 that transmits information including the command, and the multistage feeding apparatus 200 includes a reception unit 204 that receives the information including the command. When the control unit 140 of the image forming apparatus 100 determines the change of the load applied to the sheet according to the sheet information, the command related to the change of the load is transmitted from the transmission unit 141, and the reception unit 204 of the multistage feeding apparatus 200 receives the command. Then, the control unit 203 controls the driving unit 1003 according to the command.

When the sheet information is the model number of the sheet, in any case of FIGS. 17 and 18, information such as the grammage associated to the model number of the sheet is stored in advance in the control unit 203 or the control unit 140, and the load changing units 700 or 701 are controlled according to the model number of the sheet. For example, in a case where a plurality of types of sheets frequently used are set in advance in a feeding deck 500 (FIG. 1), the control unit 203 or the control unit 140 can grasp which sheet among the plurality of types of sheets is conveyed from the feeding deck 500 to a relay conveyance apparatus 400 based on the model number of the sheet, and can determine the load associated to the sheet. The model number of the sheet may be directly input from the input unit 1001 such as the operation panel, or may be included in information read from a barcode or an IC tag.

Sixth Embodiment

A sixth embodiment will be described with reference to FIGS. 19A to 20B. In each of the above-described embodiments, a case where a plurality of rotary members are spheres rotatable in an arbitrary direction has been described, but the rotary member is not limited to such a sphere. In the present embodiment, two examples in which the rotary member is other than a sphere rotatable in an arbitrary direction will be described. Since other configurations and operations are the same as those of the first embodiment described above, the same components are denoted by the same reference numerals, a description and illustration thereof are omitted or simplified, and hereinafter, differences from the first embodiment will be mainly described.

Figure 19A:
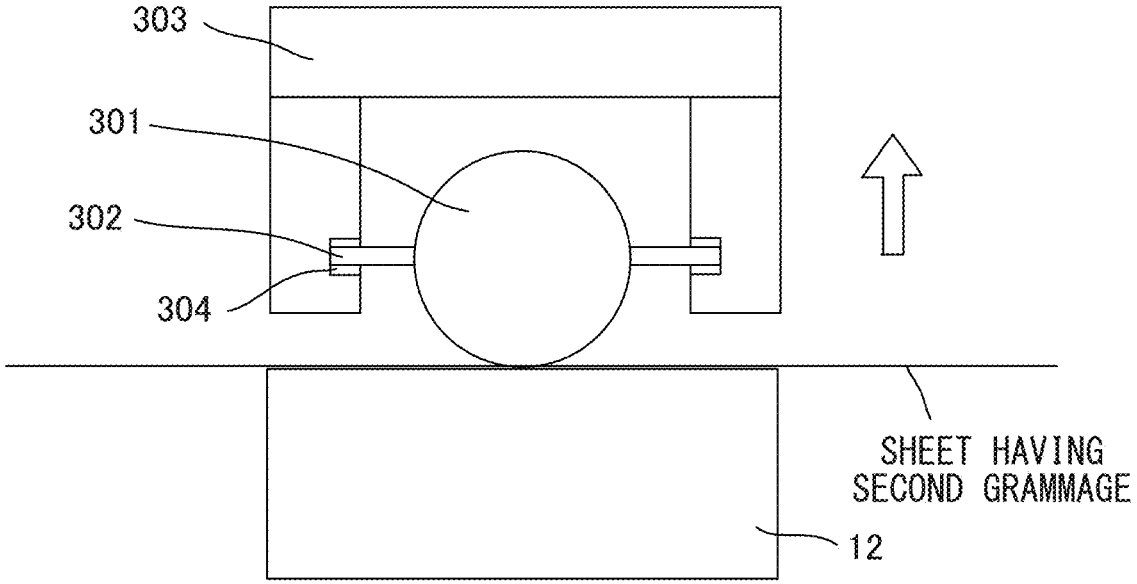
FIG. 19A is a cross-sectional view illustrating a state where a load applied from a rotary member to a sheet is decreased in a conveyor belt unit according to a sixth embodiment.
Figure 19B:
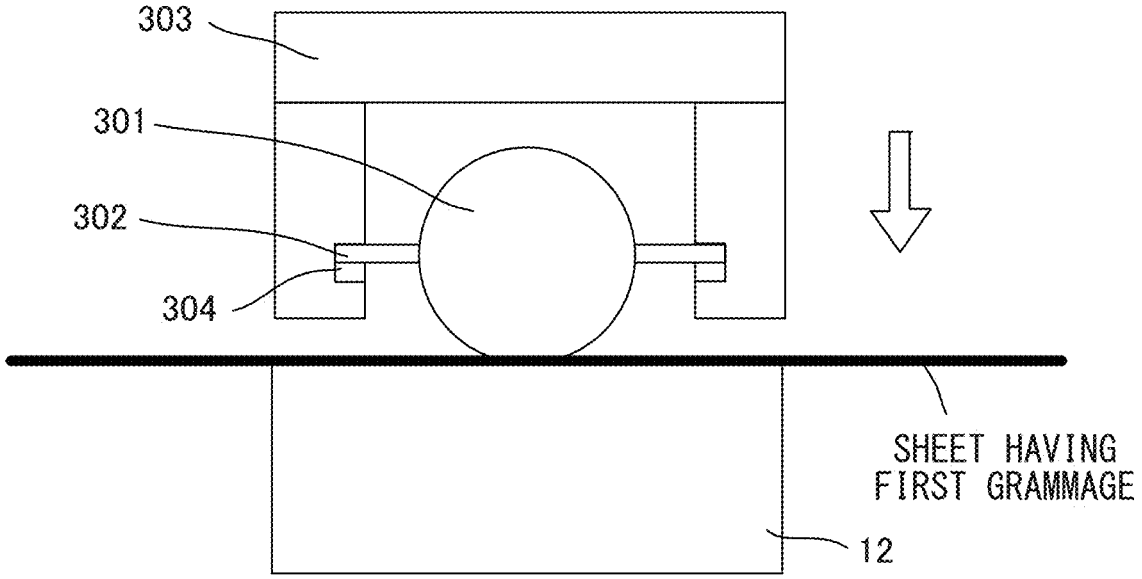
FIG. 19B is a cross-sectional view illustrating a state where the load applied from the rotary member to the sheet is increased in the conveyor belt unit according to the sixth embodiment.

First, a first example of the present embodiment will be described with reference to FIGS. 19A and 19B. In this example, a rotary member 301 is a sphere, but the rotary member 301 is supported by a shaft 302 and rotates around the shaft 302. As described above, the rotary member 301 does not need to be a perfect sphere, and the center of gravity does not have to be the center of the rotary member 301 or the surface of the rotary member 301 may be uneven or flat as long as the rotary member 301 can rotate.

The rotary member 301 is rotatably supported with respect to the shaft 302, and both end portions of the shaft 302 are supported by a holding portion 303. The holding portion 303 is, for example, the holding portion 712 of the fourth embodiment, and a load applied from the rotary member 301 to a sheet can be changed by a load changing unit 701 as in the fourth embodiment. That is, the load applied from the rotary member 301 to the sheet is changed by the holding portion 303 moving up and down. FIG. 19A illustrates a position where the rotary member 301 comes into contact with a sheet (the sheet having a second grammage) by its own weight. In a case where a sheet such as ultrathin paper having a grammage of 80 g/m$^2$ or less (a sheet having a third grammage) is conveyed, the load changing unit 701 may raise the holding portion 303 upward in the drawing to make the load applied from the rotary member 301 lighter than the own weight of the rotary member 301, or separate the rotary member 301 from the sheet to make the load applied from the rotary member 301 be zero. FIG. 19B illustrates a position where the load applied to the sheet becomes larger than that in FIG. 19A, and for example, the holding portion 303 is lower than the position in FIG. 19A, and the rotary member 301 is pushed downward by a spring (not illustrated). The position in FIG. 19B is preferable in a case where the sheet to be conveyed is a sheet having a large grammage (a sheet having a first grammage) such as thick paper.

In this example, the shaft 302 is engaged with a groove 304 formed in the holding portion 303. The groove 304 is formed to be long in a vertical direction, and the shaft 302 is movable in the vertical direction in the groove 304. Therefore, even in a case where the position of the holding portion 303 in the vertical direction is not changed, the rotary member 301 can move in the vertical direction within a range in which the shaft 302 can move in the groove 304. In FIG. 19B, an upper end of the groove 304 is engaged with the shaft 302, so that the rotary member 301 is pushed downward by the holding portion 303.

The shaft 302 may be non-rotatably supported or rotatably supported with respect to the groove 304. In a case where the shaft 302 is non-rotatably supported by the groove 304, the rotary member 301 is supported so as to be relatively rotatable with respect to the shaft 302. In a case where the shaft 302 is rotatably supported by the groove 304, the rotary member 301 may be supported so as to be relatively non-rotatable with respect to the shaft 302, or may be supported so as to be relatively rotatable. In any case, the rotary member 301 is rotatable around an axis direction of the shaft 302. A rotation direction thereof is a direction in which the sheet is conveyed by a conveyor belt 12 (conveyance direction X).

Therefore, in the present embodiment, the rotary member 301 does not rotate in a direction of moving the sheet in a sheet width direction. However, the rotary member 301 is a sphere and has a small contact area with the sheet, and a frictional force between the sheet and the rotary member 301 is also small when the sheet comes into contact with regulation guides 14A and 14B and moves in the sheet width direction. Therefore, the sheet is allowed to move in the width direction. That is, in the present example, the conveyor belt 12 and a plurality of rotary members 301 are configured such that the sheet is movable in a direction intersecting the conveyance direction X when the regulation guides 14A and 14B come into contact with side edges of the sheet in a state where the sheet is conveyed in the conveyance direction X by the conveyor belt 12 and the plurality of rotary members 301.

In order to allow the sheet to move in the sheet width direction in a state where the sheet and the rotary member 301 are in contact with each other, the rotary member 301 may be made of a resin member that is slippery or may be processed to have a surface that is slippery. The rotary member 301 may be loosely fitted to the shaft 302 to be movable in the axis direction. Alternatively, the shaft 302 may be movable in the axis direction (sheet width direction) with respect to the holding portion 303. In this way, when the sheet moves in the width direction, even in a case where the sheet and the rotary member 301 come into contact with each other, the rotary member 301 moves in the axis direction, so that the sheet can be smoothly moved in the width direction.

Figure 20A:
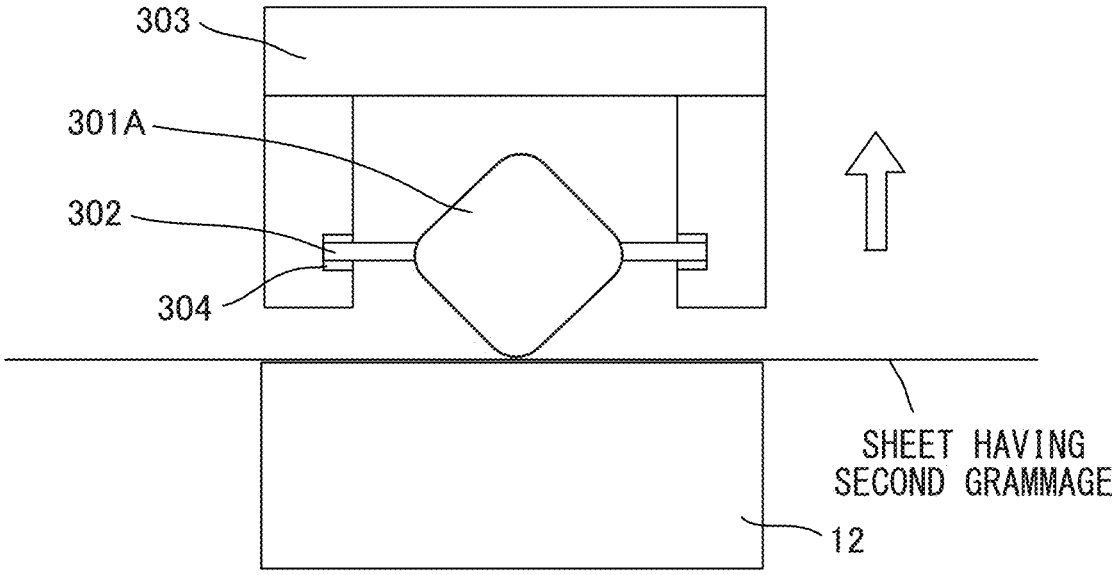
FIG. 20A is a cross-sectional view illustrating a state where a load applied from a rotary member to a sheet is decreased in a conveyor belt unit according to another example of the sixth embodiment.
Figure 20B:
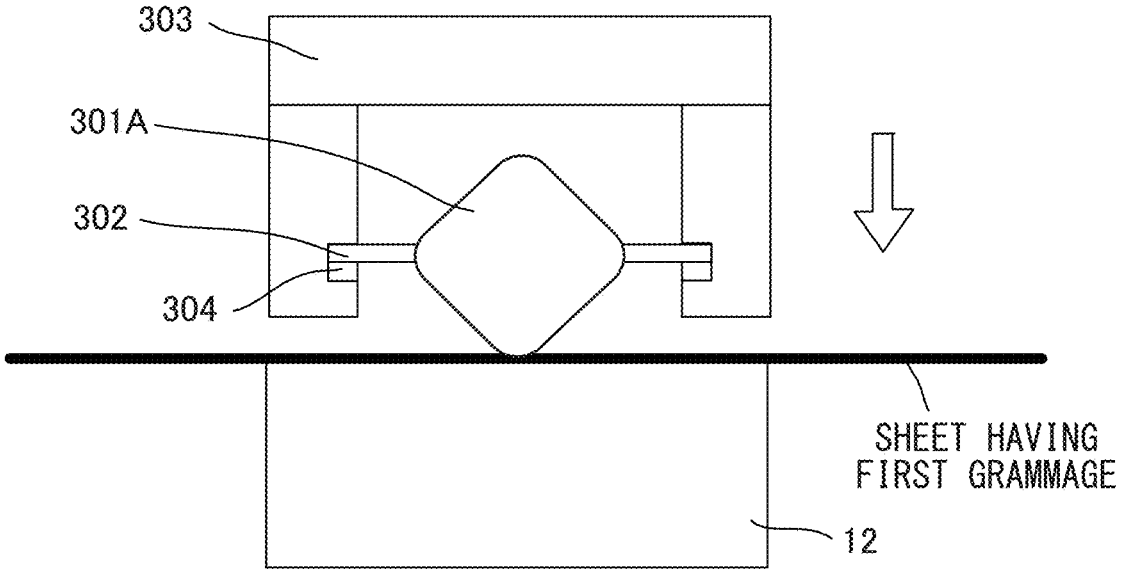
FIG. 20B is a cross-sectional view illustrating a state where the load applied from the rotary member to the sheet is increased in the conveyor belt unit according to another example of the sixth embodiment.
Figure 21:
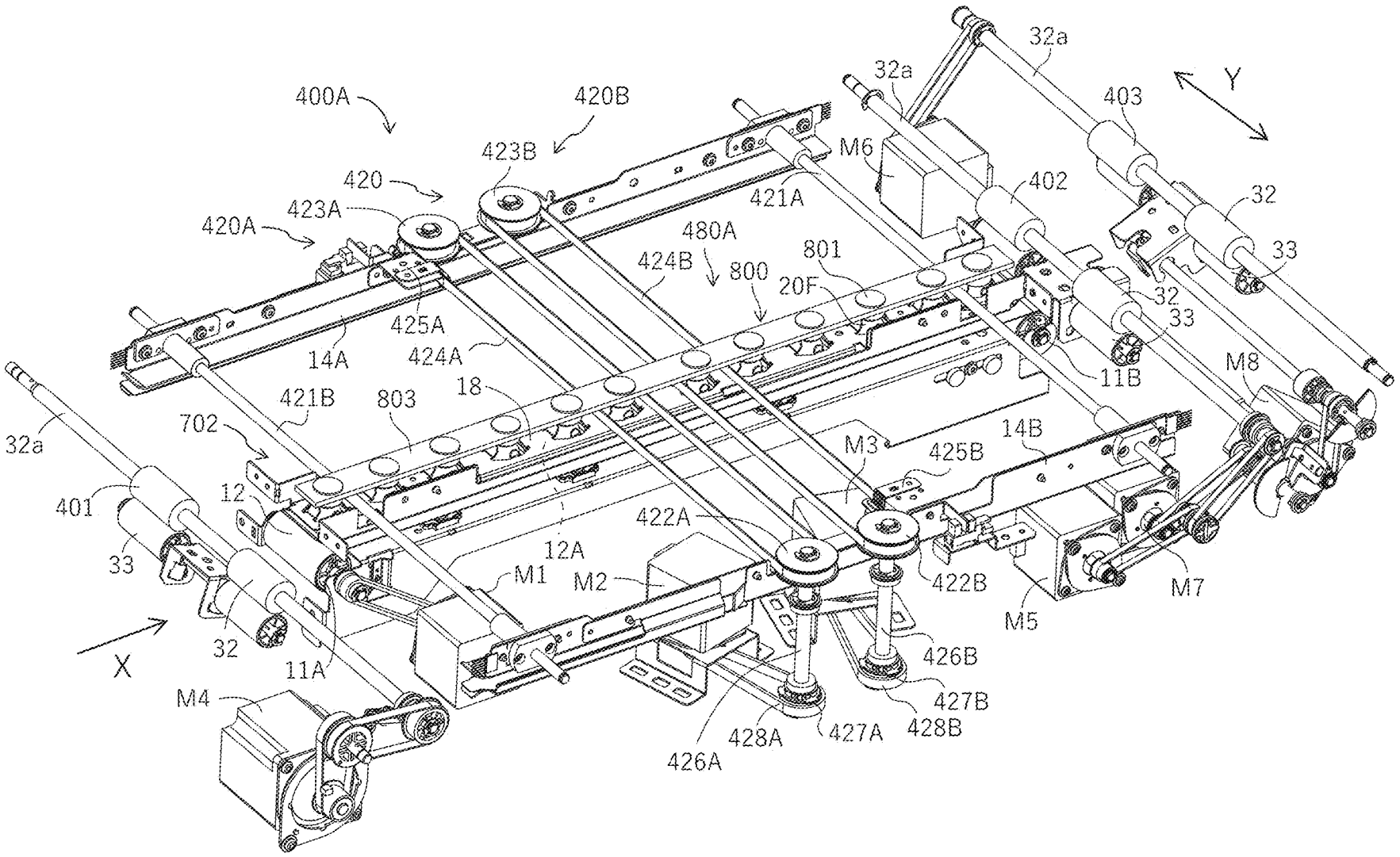
FIG. 21 is a perspective view of a relay conveyance apparatus according to a seventh embodiment.
Figure 22:
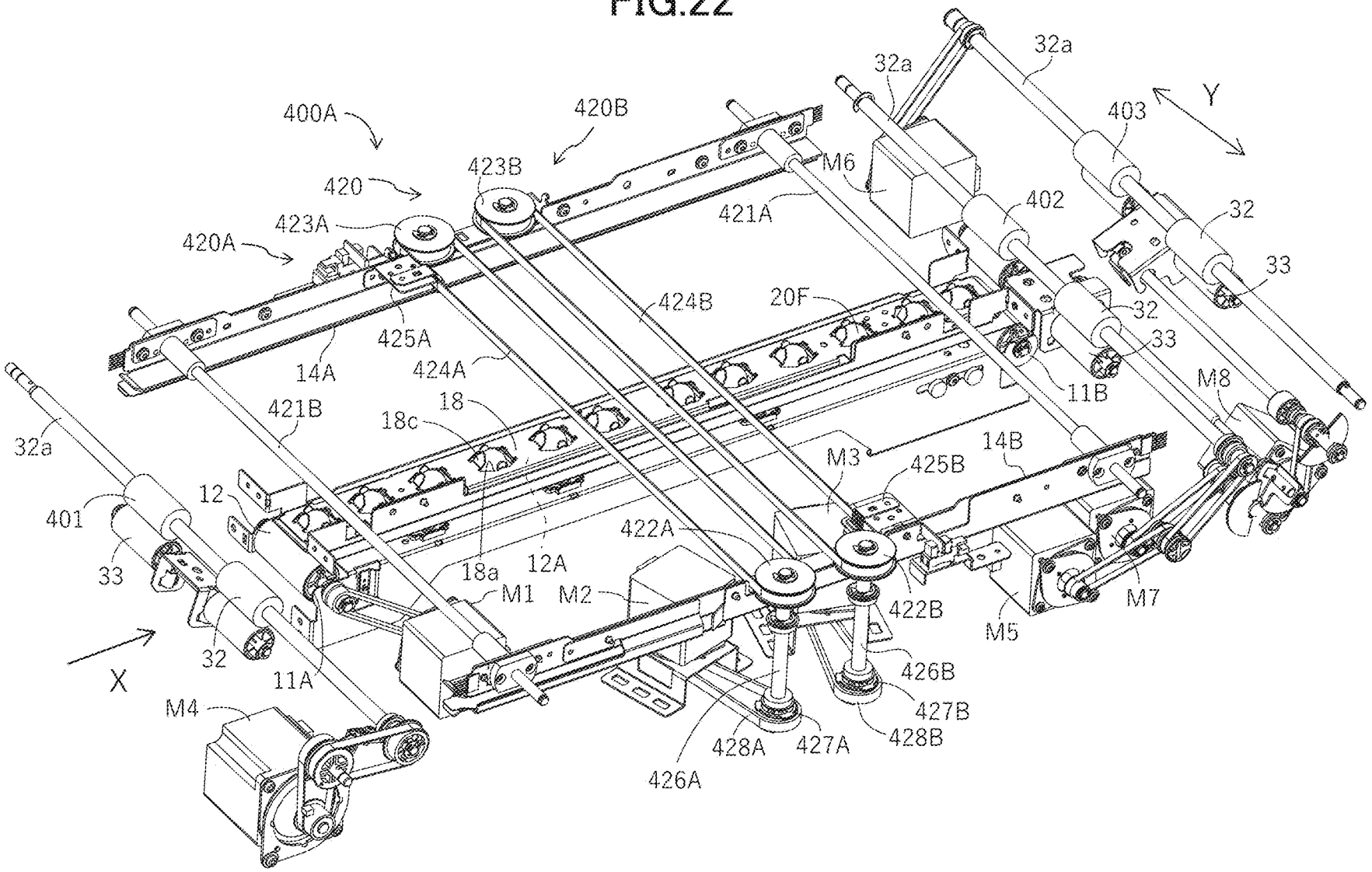
FIG. 22 is a perspective view illustrating the relay conveyance apparatus according to the seventh embodiment with an electromagnet device omitted.
Figure 23:
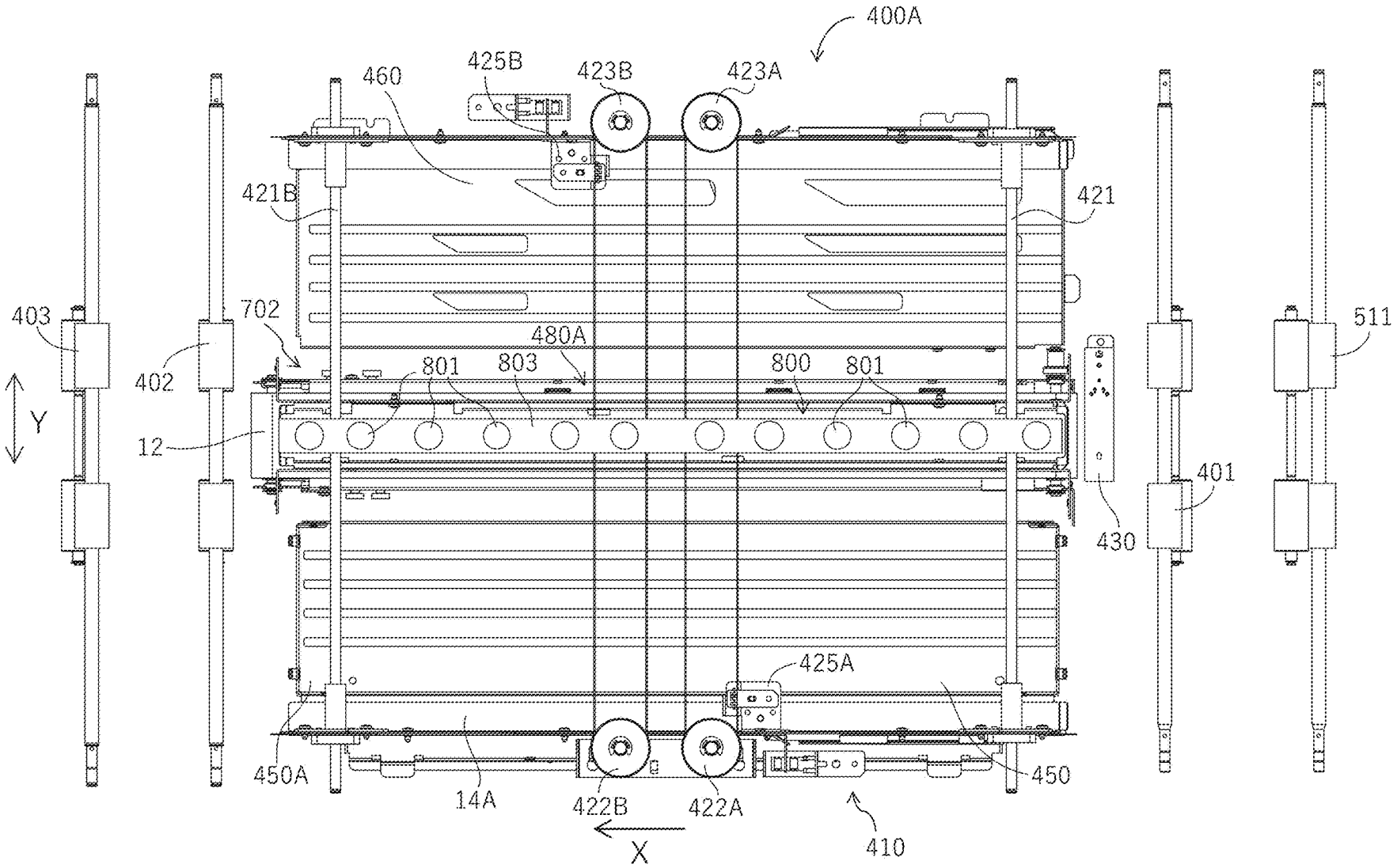
FIG. 23 is a plan view of the relay conveyance apparatus according to the seventh embodiment.
Figure 24:
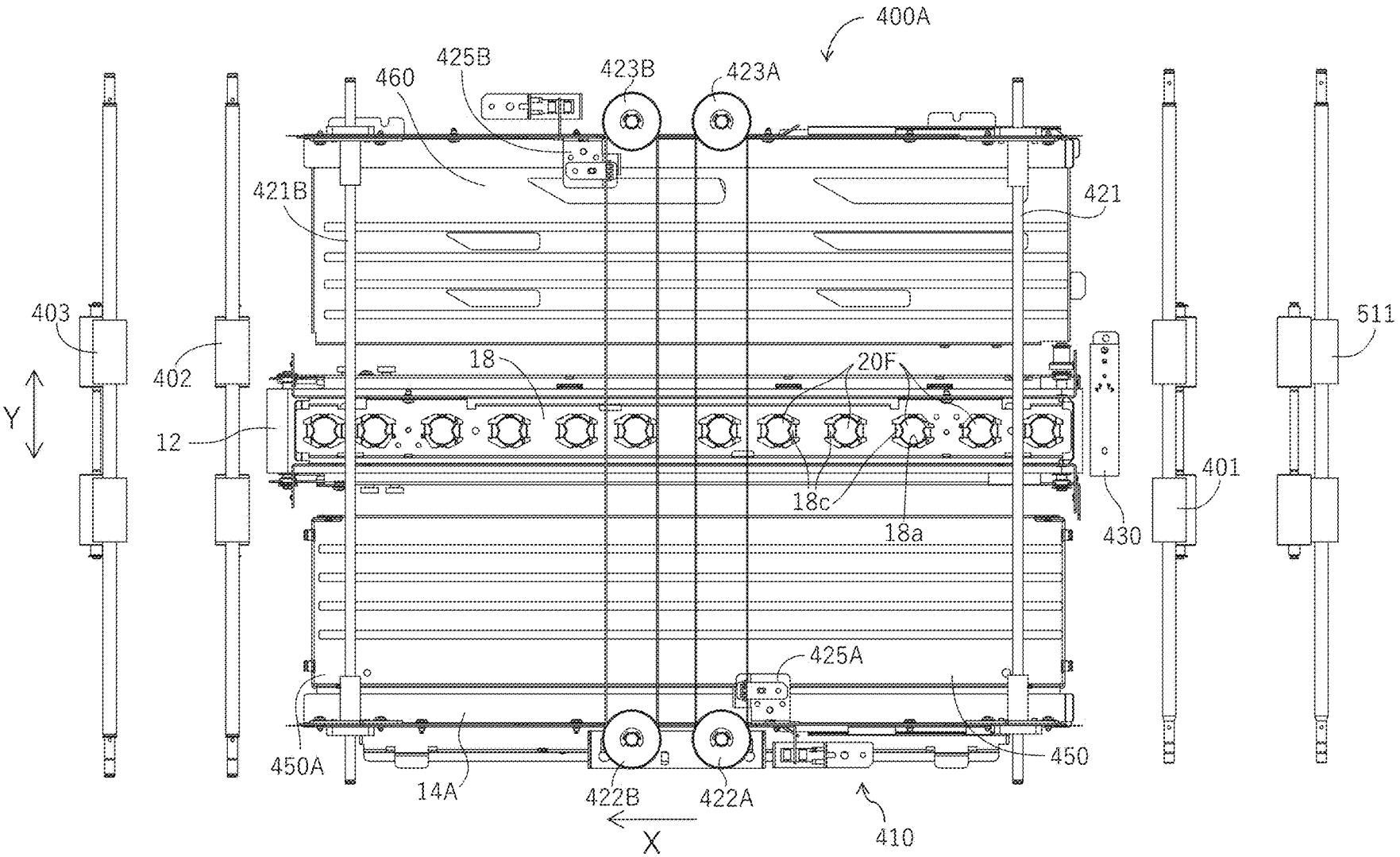
FIG. 24 is a plan view illustrating the relay conveyance apparatus according to the seventh embodiment with the electromagnet device omitted.
Figure 25:
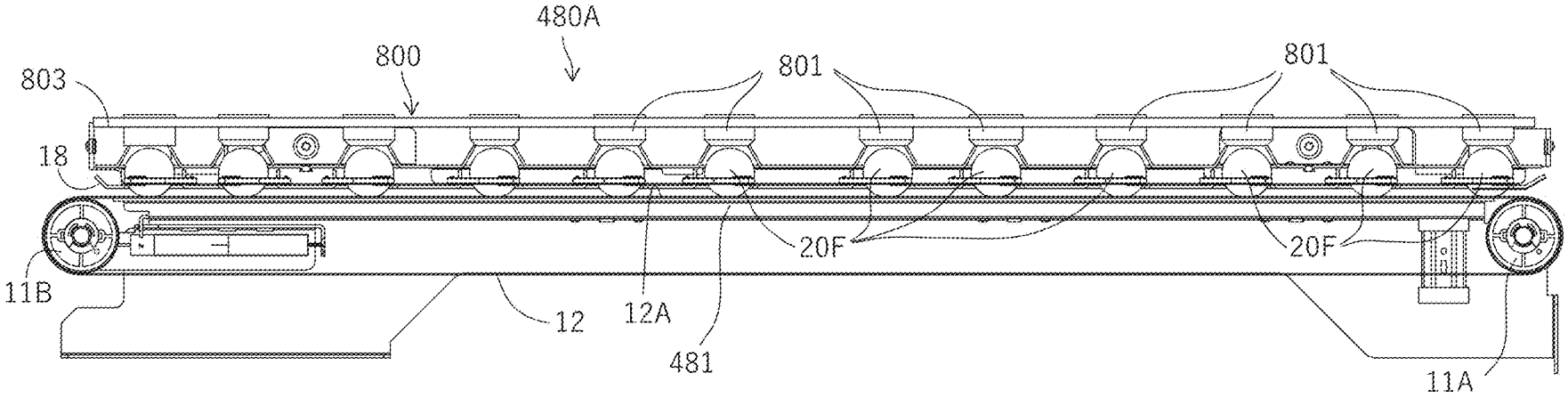
FIG. 25 is a cross-sectional view of a conveyor belt unit of the relay conveyance apparatus according to the seventh embodiment.

Furthermore, as illustrated in FIGS. 20A and 20B, the rotary member may be a rotary member 301A other than a sphere. In FIGS. 20A and 20B illustrating a second example of the present embodiment, the rotary member 301A has a substantially rectangular cross section, and a corner portion of the rectangular rotary member 301A comes into contact with the sheet. The shape of the rotary member 301A may be other shapes such as a disk shape as long as a contact area with the sheet can be reduced.

Also in the present example, FIG. 20A illustrates a position where the rotary member 301A comes into contact with the sheet by its own weight similarly to the first example. FIG. 20B illustrates a position where the load applied to the sheet becomes larger than that in FIG. 20A. Similarly to the first example, in a case where the sheet having the third grammage (ultrathin paper having a grammage of 80 g/m$^2$ or less) is conveyed, the load changing unit 701 may raise the holding portion 303 upward in the drawing to make the load applied from the rotary member 301A lighter than the own weight of the rotary member 301A, or separate the rotary member 301A from the sheet to make the load applied from the rotary member 301A be zero. The configurations of the shaft 302 and the holding portion 303 and the configuration of moving the holding portion 303 up and down are the same as those in the first example.

The configuration for changing the load applied from the rotary members 301 and 301A to the sheet is not limited to the above-described fourth embodiment, and may be any of the configurations of the first to third embodiments. The control configuration described in the fifth embodiment is also applicable to the present embodiment.

Further, any of the above-described embodiments is common in that the load (including a load of 0) applied from the plurality of rotary members (spheres) to the sheet is changed according to the sheet information described above, and the load may be set in two stages or in a plurality of stages such as three or more stages.

Seventh Embodiment

A seventh embodiment will be described with reference to FIGS. 21 to 26. In the above-described fourth embodiment, the configuration in which the load applied from the sphere to the sheet is changed using the actuator has been described, but a configuration in which the load applied from the sphere to the sheet is changed using an electromagnet may also be adopted. A basic configuration of a relay conveyance apparatus 400A of the present embodiment is similar to that of the relay conveyance apparatus 400 described in the first embodiment. Also in the present embodiment, a conveyor belt unit 480A is a portion of a misalignment correction unit 410 that conveys a sheet by a conveyor belt 12 and spheres 20F.

Figure 26:
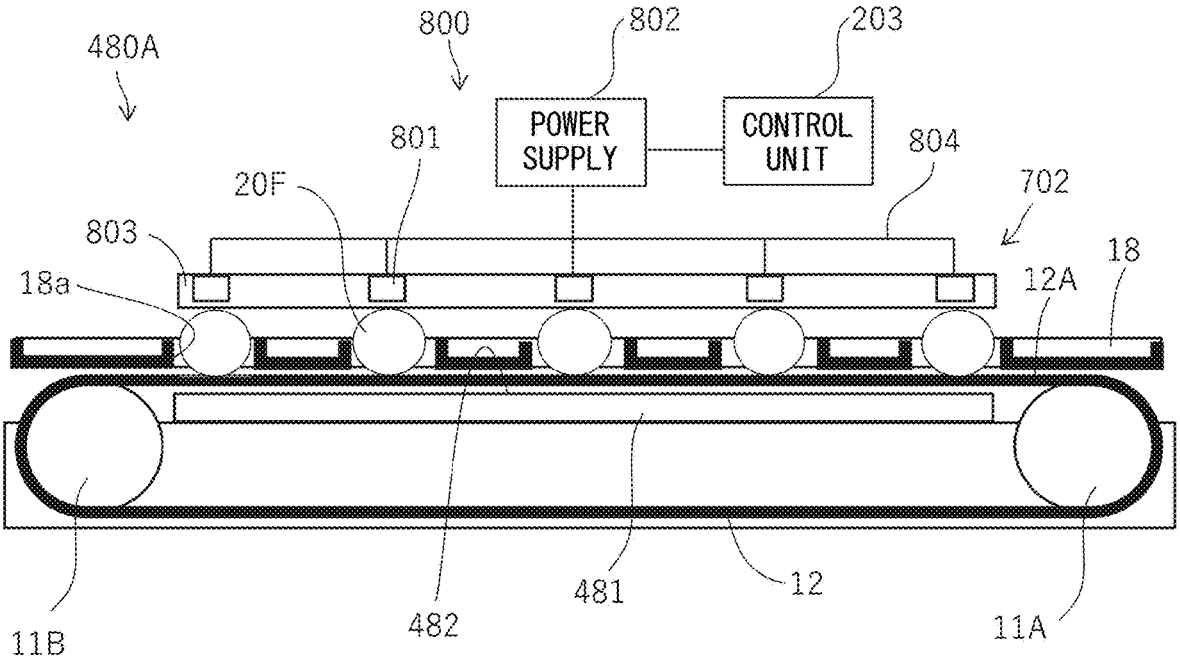
FIG. 26 is a view schematically illustrating a cross section of the conveyor belt unit according to the seventh embodiment.

Next, a load changing unit 702 of the present embodiment will be described with reference to FIG. 26 while referring to FIGS. 21 to 25. FIG. 26 schematically illustrates a cross section of the conveyor belt unit 480A of the present embodiment, and the conveyor belt unit 480A includes the load changing unit 702. The load changing unit 702 changes the load applied from at least some of the plurality of spheres 20F to the sheet. In the present embodiment, the load applied from all the spheres 20F on the sheet can be changed, but the load may be changed for some of the spheres 20F, for example, the spheres 20F excluding one sphere 20F at each end in a conveyance direction X among the plurality of spheres 20F.

In the present embodiment, an electromagnetic device 800 is used to change the load applied from the spheres 20F to the sheet. That is, the load applied from the spheres 20F to the sheet is changed using a magnetic force generated by the electromagnetic device 800. For this purpose, the sphere 20F contains a magnetic material. For example, the sphere 20F is a sphere made of magnetic metal such as iron. The metal sphere may be a solid sphere or a hollow sphere. In the present embodiment, the sphere 20F is a solid iron sphere.

The sphere 20F may be, for example, a sphere made of a resin such as polyoxymethylene (POM) in which metal such as iron is provided. Furthermore, the sphere 20F may be made of a resin containing a magnetic material. Furthermore, in a case where the load can be changed for some of the spheres 20F, some spheres 20F may contain a magnetic material, and the spheres whose load is not changed do not have to be magnetic. However, regardless of whether the load is changed, all the spheres 20F may contain a magnetic material.

The electromagnetic device 800 includes a plurality of electromagnets 801, a power supply 802 capable of energizing the plurality of electromagnets 801, and a holding plate 803 holding the plurality of electromagnets 801. The plurality of electromagnets 801 generates a magnetic force in an energized state. That is, the magnetic force is generated by turning on the power supply 802, and the generation of the magnetic force is stopped by turning off the power supply 802. The power supply 802 is connected to the plurality of electromagnets 801, and can energize the plurality of electromagnets 801. In addition, the power supply 802 can change a current value to be supplied to the plurality of electromagnets 801. Therefore, the magnetic force of the plurality of electromagnets 801 can be changed by changing the current value supplied from the power supply 802.

The electromagnet 801 is disposed such that the magnetic force acts on the sphere 20F, and changes the load applied from the sphere 20F to the sheet according to the energized state of the electromagnet 801. Such an electromagnet 801 is held by the holding plate 803 serving as an electromagnet holding portion. The holding plate 803 is made of a non-magnetic material that does not receive the magnetic force of the electromagnet 801, and is made of a resin in the present embodiment. The holding plate 803 is disposed on a side of a holding plate 18 that is opposite to the conveyor belt 12, that is, above the holding plate 18 holding the plurality of spheres 20F. The holding plate 18 is also made of a non-magnetic material that does not receive the magnetic force of the electromagnet 801, and is made of a resin in the present embodiment. The holding plate 803 is disposed substantially parallel to the holding plate 18 and along the conveyance direction X. The plurality of electromagnets 801 held by the holding plate 803 are positioned above the plurality of spheres 20F. The holding plate 803 is provided with a wiring 804 that electrically connects the power supply 802 and the plurality of electromagnets 801.

In the present embodiment configured as described above, when the energization of the plurality of electromagnets 801 is turned off, the weights of the plurality of spheres 20F act on the sheet as the load applied to the sheet. On the other hand, when the energization of the plurality of electromagnets 801 is turned on, the magnetic force of the plurality of electromagnets 801 acts on the plurality of spheres 20F in a direction away from a conveyance surface 12A. That is, the sphere 20F is raised upward by a magnetic attraction force of the electromagnet 801. Then, the load applied from the plurality of spheres 20F to the sheet becomes smaller than that in a case where the energization of the electromagnet 801 is turned off.

That is, when a current is applied to the electromagnet 801 to generate the magnetic force, the force is applied to the sphere 20F in a direction of being attracted to the electromagnet 801. Since the electromagnet 801 is disposed above the sphere 20F, the sphere 20F is pulled upward by the magnetic force of the electromagnet 801. At this time, a pressure at which the sphere 20F come into contact with the conveyor belt 12 is reduced by the attraction force of the electromagnet 801. Therefore, the load applied from the sphere 20F to the sheet nipped and conveyed by the sphere 20F and the conveyor belt 12 becomes small.

Change of Load Applied to Sheet

Control related to the change of the load applied from the spheres 20F to the sheet will be described. As described above, a multistage feeding apparatus 200 controls each unit by a control unit 203 (FIG. 1). The control unit 203 controls separation and contact operations of the spheres 20F according to a grammage of the sheet. That is, the control unit 203 operates the load changing unit 702 such that the load applied from the sphere 20F to the sheet is larger in a case where the grammage of the sheet is a first grammage larger than a second grammage than in a case where the grammage of the sheet is the second grammage.

The control of the change of the load applied from the sphere 20F is not limited to being based on the grammage of the sheet, and may be performed, for example, according to a stiffness of the sheet. Further, examples of sheet information include a thickness of the sheet, a model number of the sheet, and the like, in addition to the grammage and stiffness of the sheet. For example, the load changing unit 702 may be controlled according to the thickness or model number of the sheet input by an input unit 1001. Furthermore, the load applied from the spheres 20F may be changed based on user's selection.

Eighth Embodiment

Figure 27A:
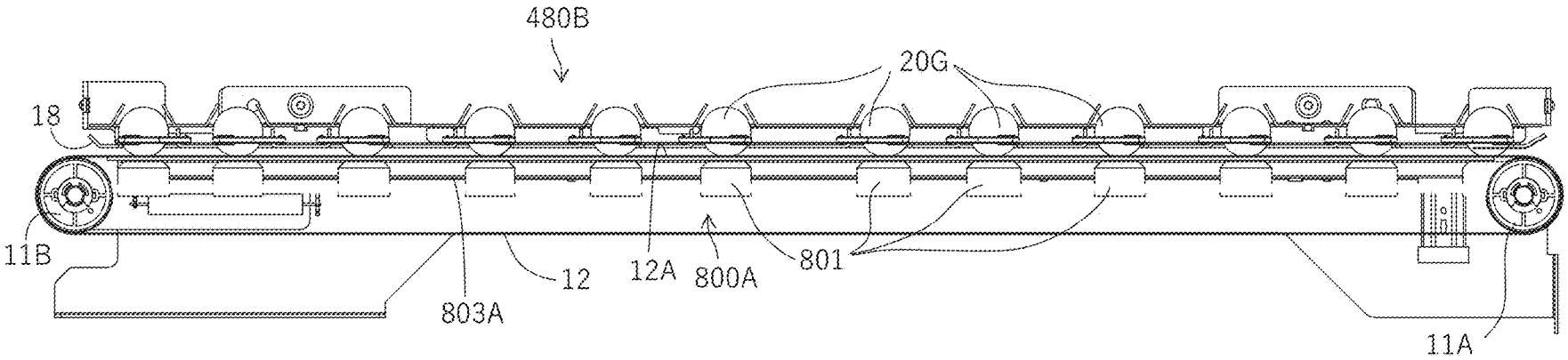
FIG. 27A is a cross-sectional view of a conveyor belt unit according to an eighth embodiment.
Figure 27B:
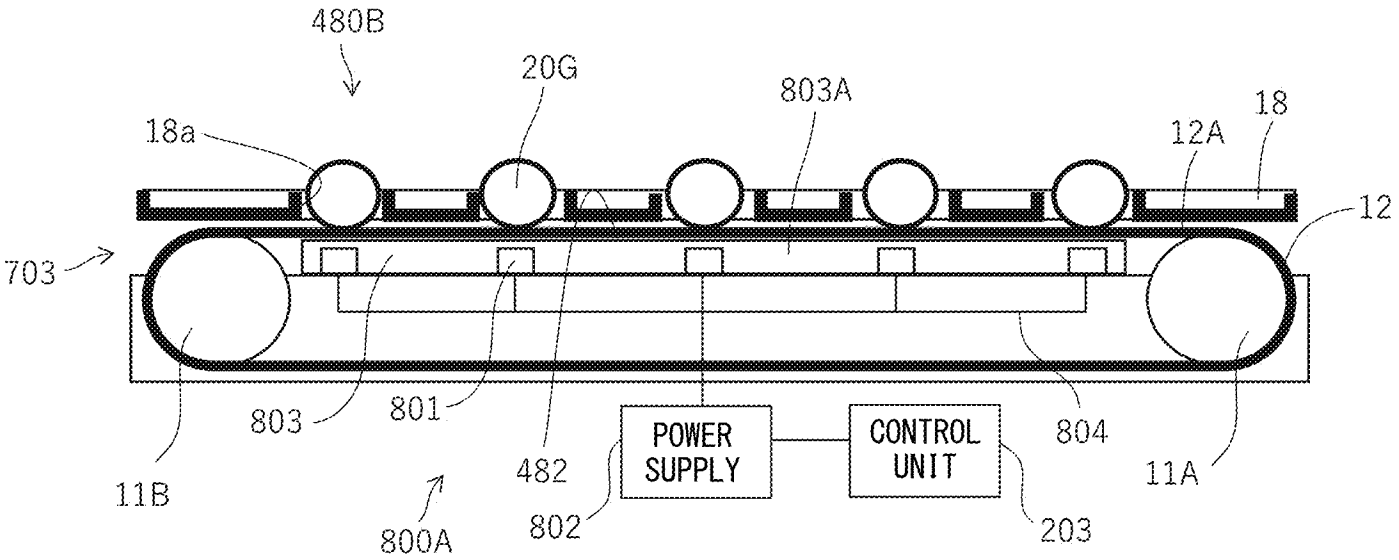
FIG. 27B is a view schematically illustrating a cross section of the conveyor belt unit according to the eighth embodiment.

In the above-described seventh embodiment, an electromagnet 801 is disposed above a sphere 20F, but the electromagnet 801 may be disposed below the sphere 20G as illustrated in FIGS. 27A and 27B. A conveyor belt unit 480B includes a load changing unit 703. The load changing unit 703 changes a load applied from at least some of a plurality of spheres 20G to a sheet. Also in the present embodiment, an electromagnetic device 800A includes a plurality of electromagnets 801, a power supply 802 capable of energizing the plurality of electromagnets 801, and a holding plate 803A holding the plurality of electromagnets 801.

In the present embodiment, for example, when a grammage of the sheet is large and a conveyance force for the sheet is required, the energization of the electromagnet 801 is turned on to increase the load applied from the spheres 20F to the sheet. As a result, the conveyance force of the conveyor belt unit 480B for the sheet can be secured, so that the sheet can be stably conveyed. On the other hand, in a case of a sheet having a small grammage, the energization of the electromagnet 801 is turned off, and the sphere 20G is brought into contact with the sheet by its own weight. Since the sphere 20G is lighter than the sphere 20F of the seventh embodiment, the load applied from the sphere 20G to the sheet can be decreased. Therefore, conveyance can be performed in a state where a nip pressure applied to the sheet is reduced, and buckling of the sheet due to the load applied from the sphere can be reduced and stable skew correction can be performed at the time of aligning the sheet by regulation guides 14A and 14B.

Ninth Embodiment

Figure 28:
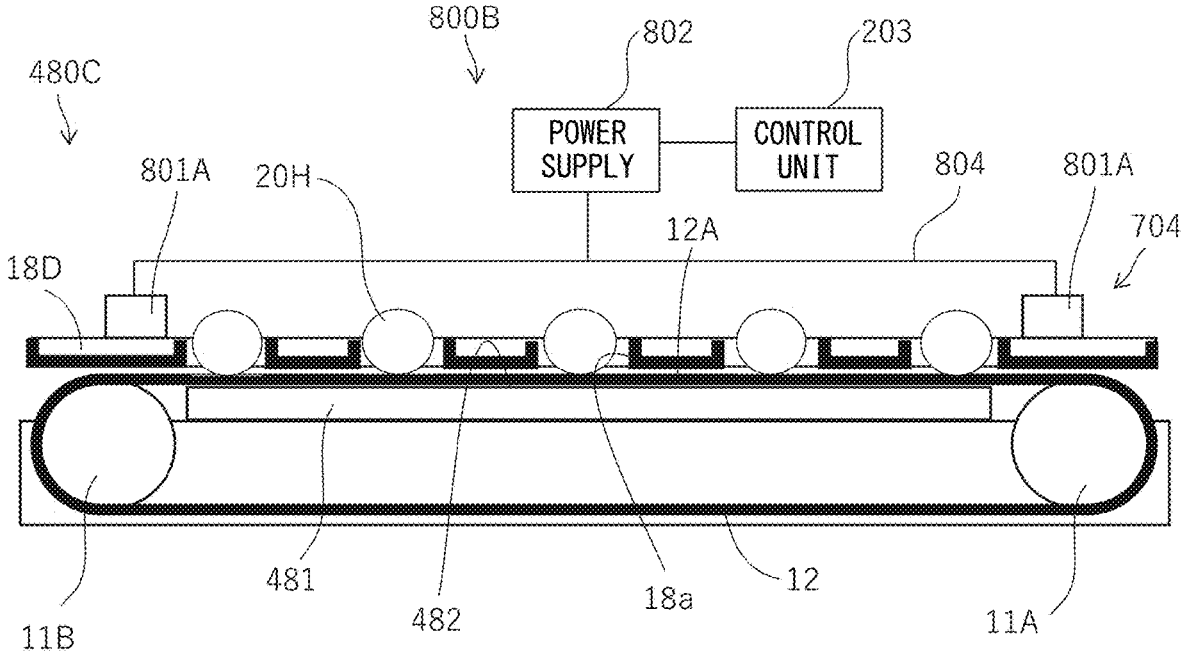
FIG. 28 is a view schematically illustrating a cross section of a conveyor belt unit according to a ninth embodiment.
Figure 29:
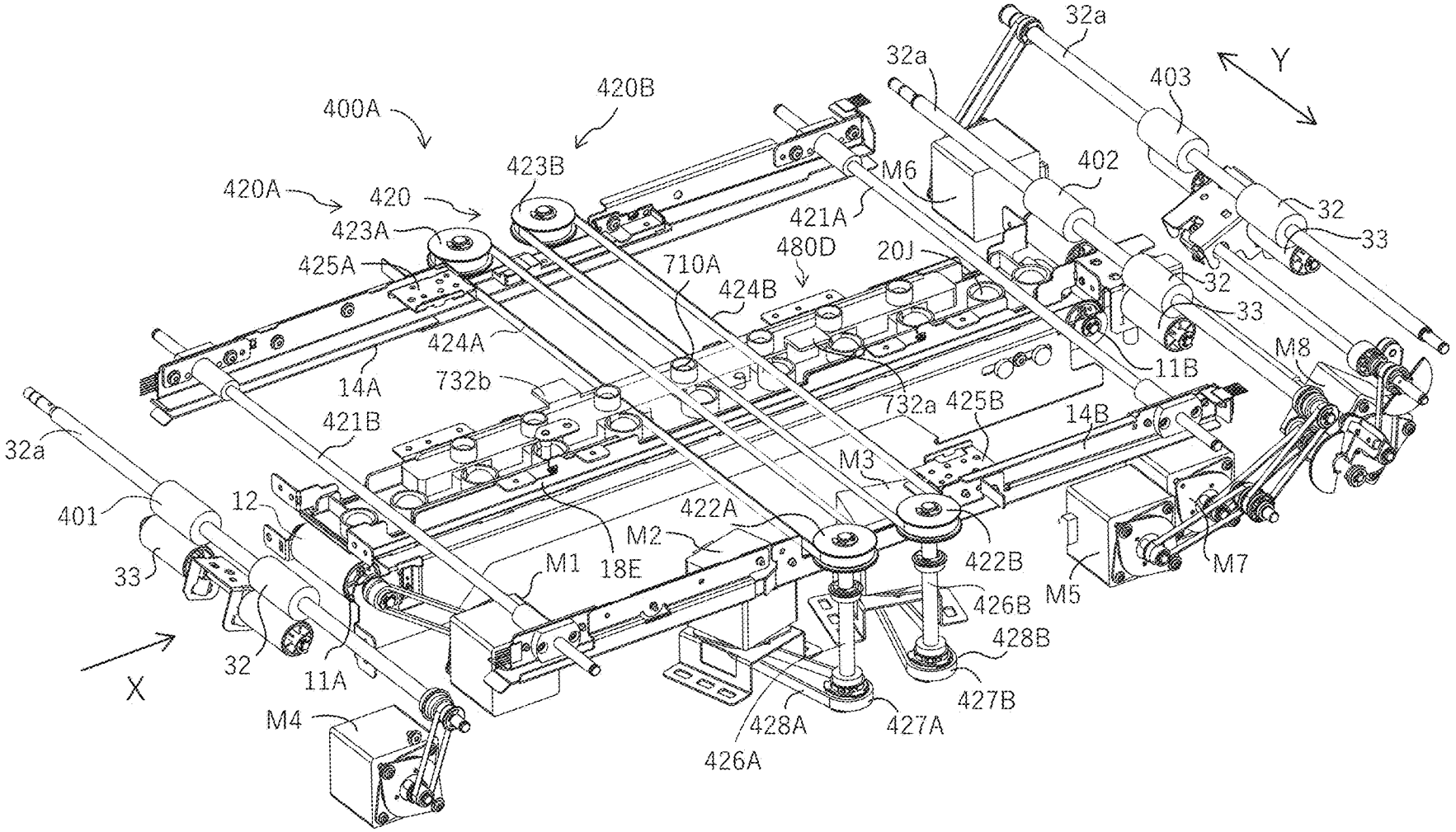
FIG. 29 is a perspective view of a relay conveyance apparatus according to a tenth embodiment.
Figure 30:
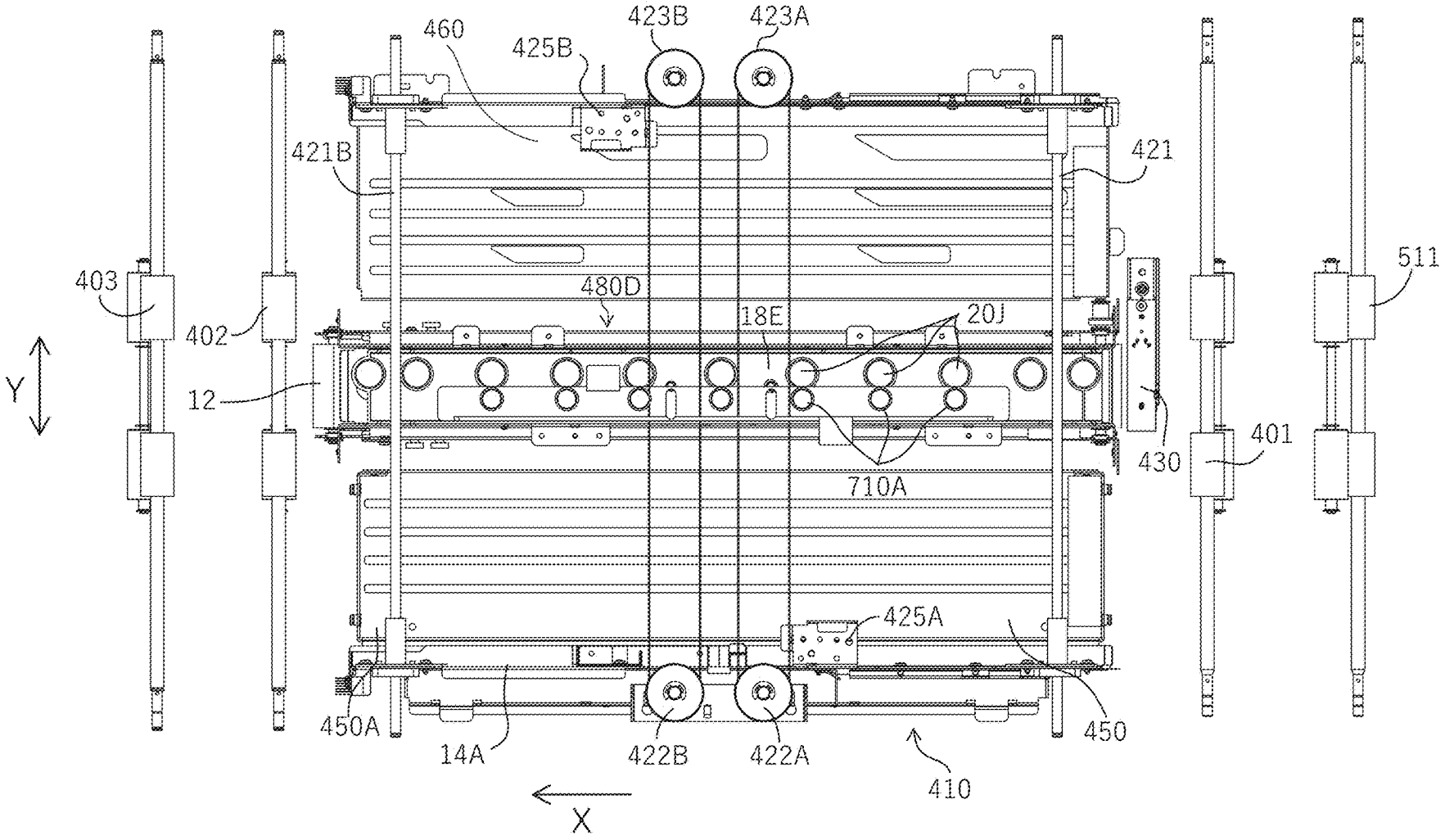
FIG. 30 is a plan view of the relay conveyance apparatus according to the tenth embodiment.
Figure 31A:
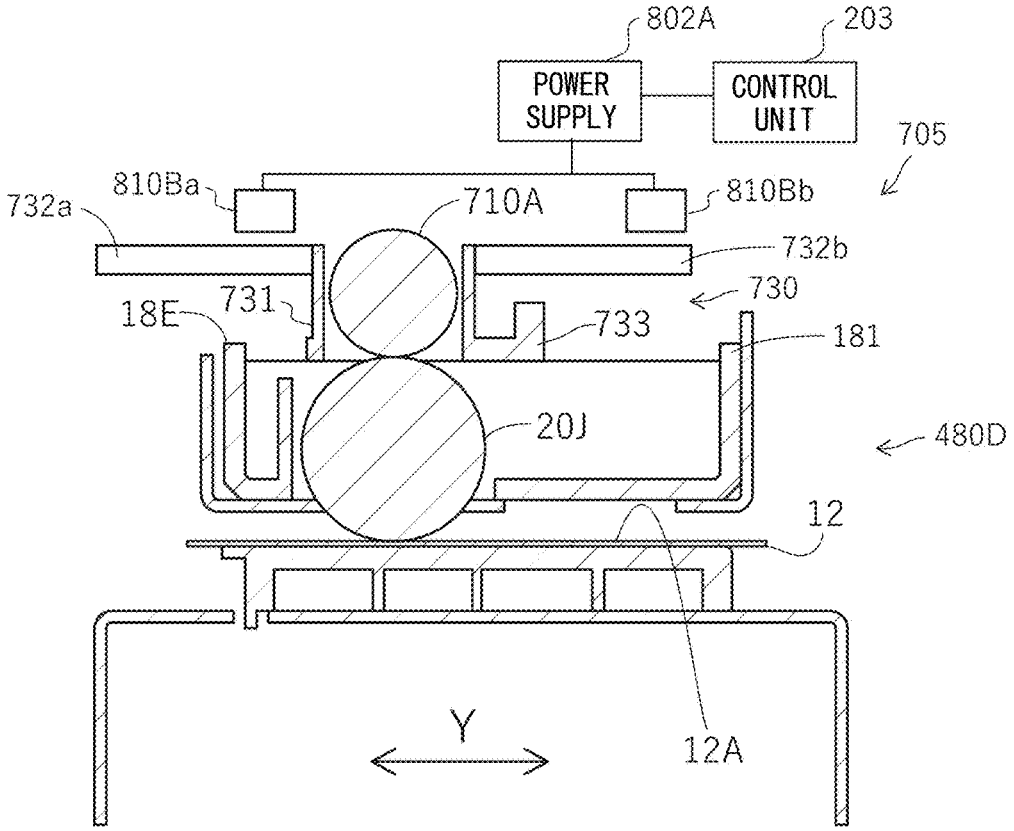
FIG. 31A is a cross-sectional view illustrating a state of a pressing position in a conveyor belt unit according to the tenth embodiment.
Figure 31B:
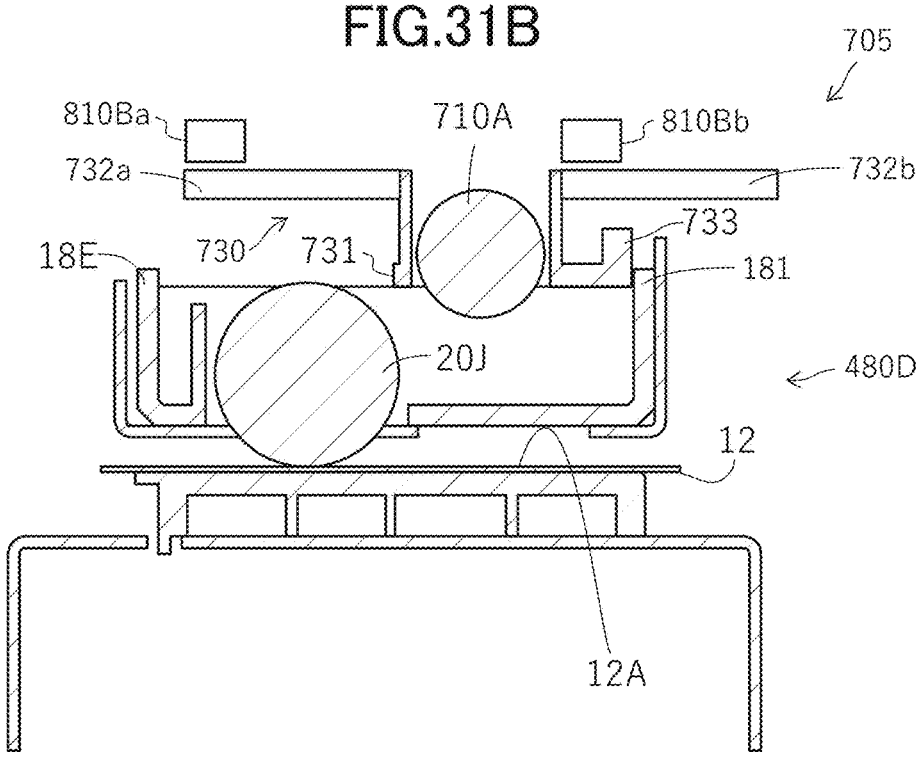
FIG. 31B is a cross-sectional view illustrating a state of a release position in the conveyor belt unit according to the tenth embodiment.

In the seventh and eighth embodiments described above, the magnetic force of the electromagnet 801 is applied to the spheres 20F and 20G. However, an electromagnet 801A may be applied to a holding plate 18D holding spheres 20H as illustrated in FIG. 28. A conveyor belt unit 480C includes a load changing unit 704. The load changing unit 704 changes a load applied from at least some of a plurality of spheres 20H to a sheet.

In the present embodiment, the holding plate 18D serving as a holding portion that holds the spheres 20H at least partially contains a magnetic material. For example, the holding plate 18D is made of a resin containing a magnetic material. The holding plate 18D may be made of metal such as magnetic iron. In the present embodiment, the electromagnet 801A is disposed such that a magnetic force acts on the holding plate 18D, and the load applied from the plurality of spheres 20H to the sheet is changed according to an energized state of the electromagnet 801A. An electromagnetic device 800B of the present embodiment includes a plurality of electromagnets 801A and a power supply 802 capable of energizing the plurality of electromagnets 801A.

In the present embodiment, the electromagnet 801A is disposed above the holding plate 18D, and may be disposed below the holding plate 18D. For example, as in the eighth embodiment, the electromagnet 801A may be disposed on an inner side of a conveyor belt 12. In this case, control performed on the electromagnetic device 800B according to sheet information such as a grammage of the sheet is similar to that in the eighth embodiment.

Tenth Embodiment

In the seventh to ninth embodiments described above, the magnetic force of the electromagnet 801 is applied to the spheres 20F and 20G, or the magnetic force of the electromagnet 801A is applied to the holding plate 18D. However, a position of a pressing portion 710A that presses a sphere 20J may be moved by electromagnets 801Ba and 801Bb as illustrated in FIGS. 29 to 31B.

A conveyor belt unit 480D of the present embodiment includes a load changing unit 705. The load changing unit 705 includes the pressing portion 710A, a pressing force applying portion 730, and the electromagnets 801Ba and 801Bb.

The pressing portion 710A can press at least some of a plurality of spheres 20J toward a conveyance surface 12A of a conveyor belt 12. Further, the pressing portion 710A is disposed on a side opposite to the conveyance surface 12A of the conveyor belt 12 with respect to at least some of the spheres 20J, and is movable to a pressing position and a release position together with the pressing force applying portion 730 described below.

In the present embodiment, for example, when a grammage of the sheet is large and a conveyance force for the sheet is required, energization of the electromagnet 801Ba is turned on to move the pressing portion 710A to the pressing position, and the load applied from the sphere 20J to the sheet is increased. As a result, the conveyance force of the conveyor belt unit 480D for the sheet can be secured, so that the sheet can be stably conveyed. On the other hand, in a case of a sheet having a small grammage, the energization of the electromagnet 801Bb is turned on to move the pressing portion 710A to the release position, and the sphere 20J is brought into contact with the sheet by its own weight. Therefore, conveyance can be performed in a state where a nip pressure applied to the sheet is reduced, and buckling of the sheet due to the load applied from the sphere can be reduced and stable skew correction can be performed at the time of aligning the sheet by regulation guides 14A and 14B.

Eleventh Embodiment

Figure 32:
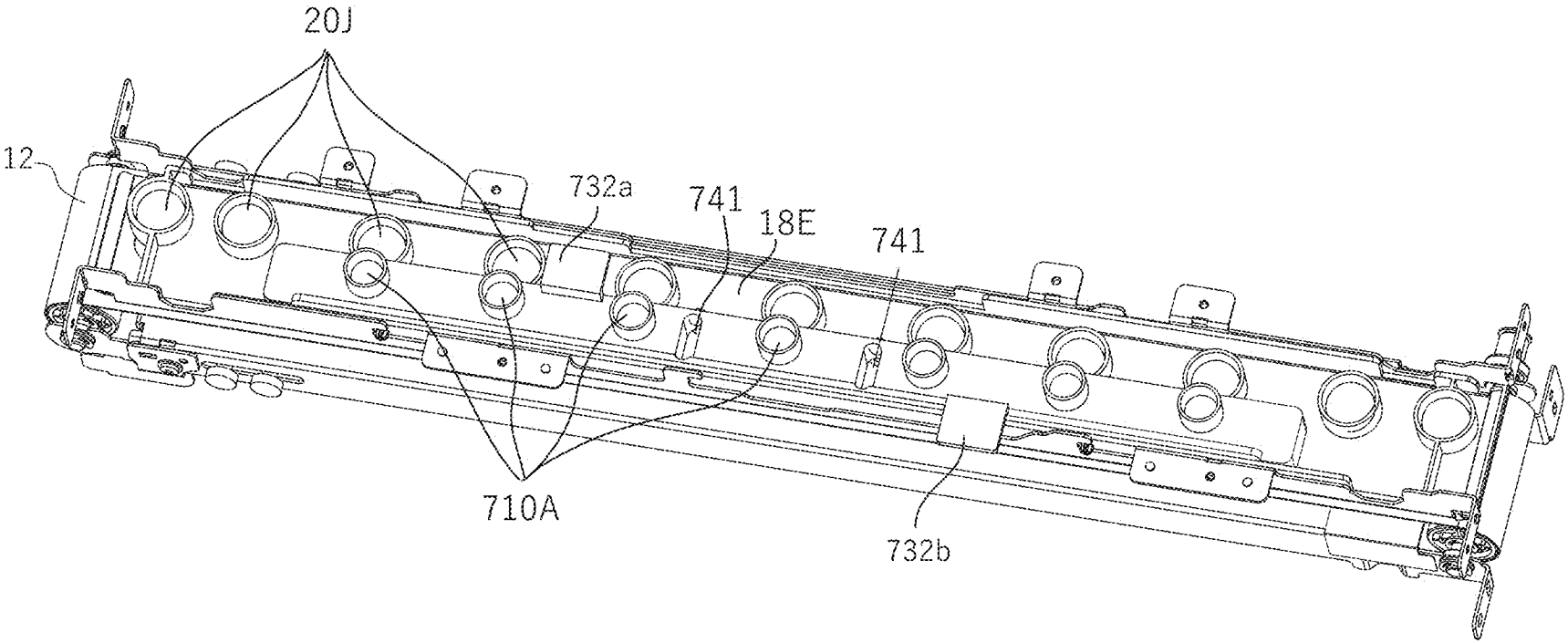
FIG. 32 is a perspective view of a conveyor belt unit according to an eleventh embodiment.
Figure 33A:
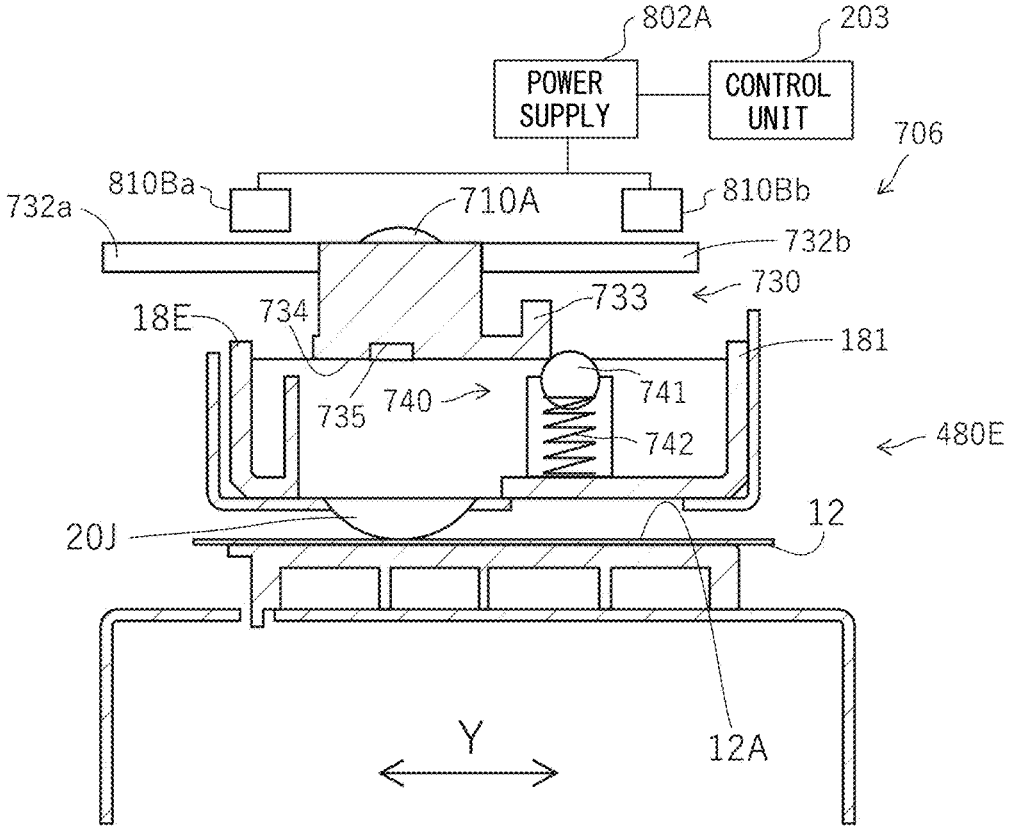
FIG. 33A is a cross-sectional view illustrating a state of a pressing position in the conveyor belt unit according to the eleventh embodiment.
Figure 33B:
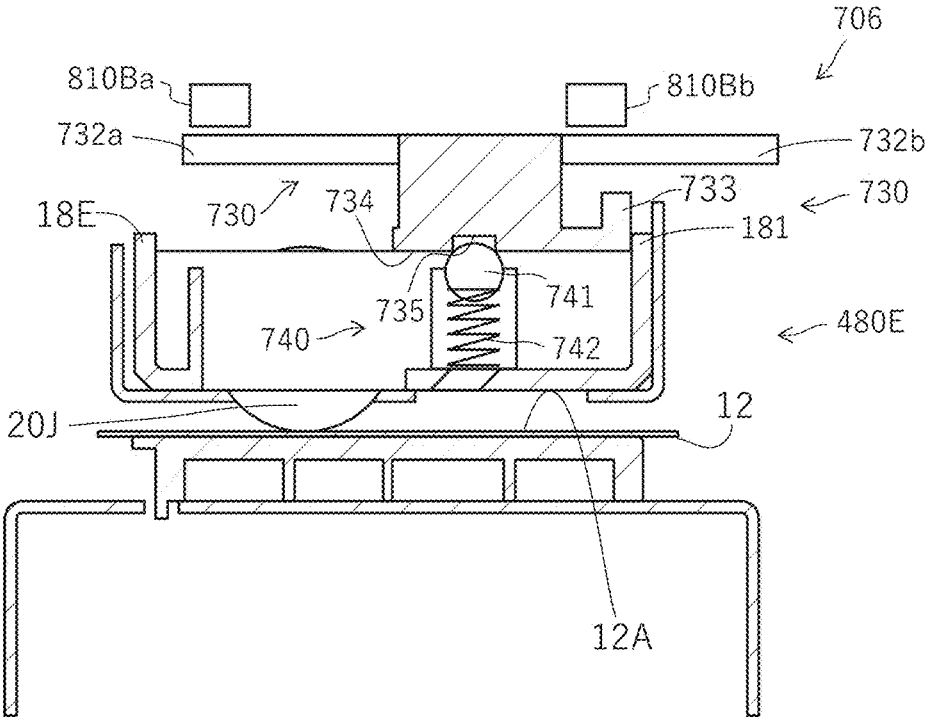
FIG. 33B is a cross-sectional view illustrating a state of a release position in the conveyor belt unit according to the eleventh embodiment.

In the above-described tenth embodiment, a pressing portion 710A is brought into contact with a sphere 20J to apply a pressing force to the sphere 20J. However, a configuration in which the pressing portion 710A can apply a pressing force to a sphere 20J via a holding plate 18E even at a release position as illustrated in FIGS. 32 to 33B may be applied in addition to the configuration of the tenth embodiment. A conveyor belt unit 480E includes a load changing unit 706. Similarly to the load changing unit 705 of the tenth embodiment, the load changing unit 706 includes the pressing portion 710A, a pressing force applying portion 730, and electromagnets 801Ba and 801Bb.

The pressing portion 740 includes a contact member 741 that comes into contact with a contact surface 734 of the pressing force applying portion 730 when the pressing force applying portion 730 moves to the release position, and an urging member 742 such as a spring disposed between the contact member 741 and the holding plate 18E. An engagement recess 735 engageable with the contact member 741 is formed on the contact surface 734 of the pressing force applying portion 730.

Twelfth Embodiment

As in the above-described fourth and seventh to eleventh embodiments, the configuration in which a load applied from a sphere to a sheet is changed using an actuator or an electromagnet has been described. With such a configuration, the load applied from the sphere to the sheet can be changed while a conveyor belt is driven.

For example, in a case where the load applied from the sphere to the sheet is large while misalignment correction for the sheet is being performed, the load applied to the sheet becomes large. On the other hand, in a case where the load applied from the sphere to the sheet is decreased in order to reduce the load applied to the sheet, conveyability of the sheet by the conveyor belt is deteriorated. In the configuration in which the gap between the sphere and the conveyor belt is manually adjusted as in the configuration described in JP 2007-217096 A, the gap cannot be adjusted while the conveyor belt is driven. Therefore, in the present embodiment, the load applied from the sphere to the sheet is changed using the actuator or the electromagnet, so that the load is freely changed during the sheet conveyance by the conveyor belt.

Figure 34:
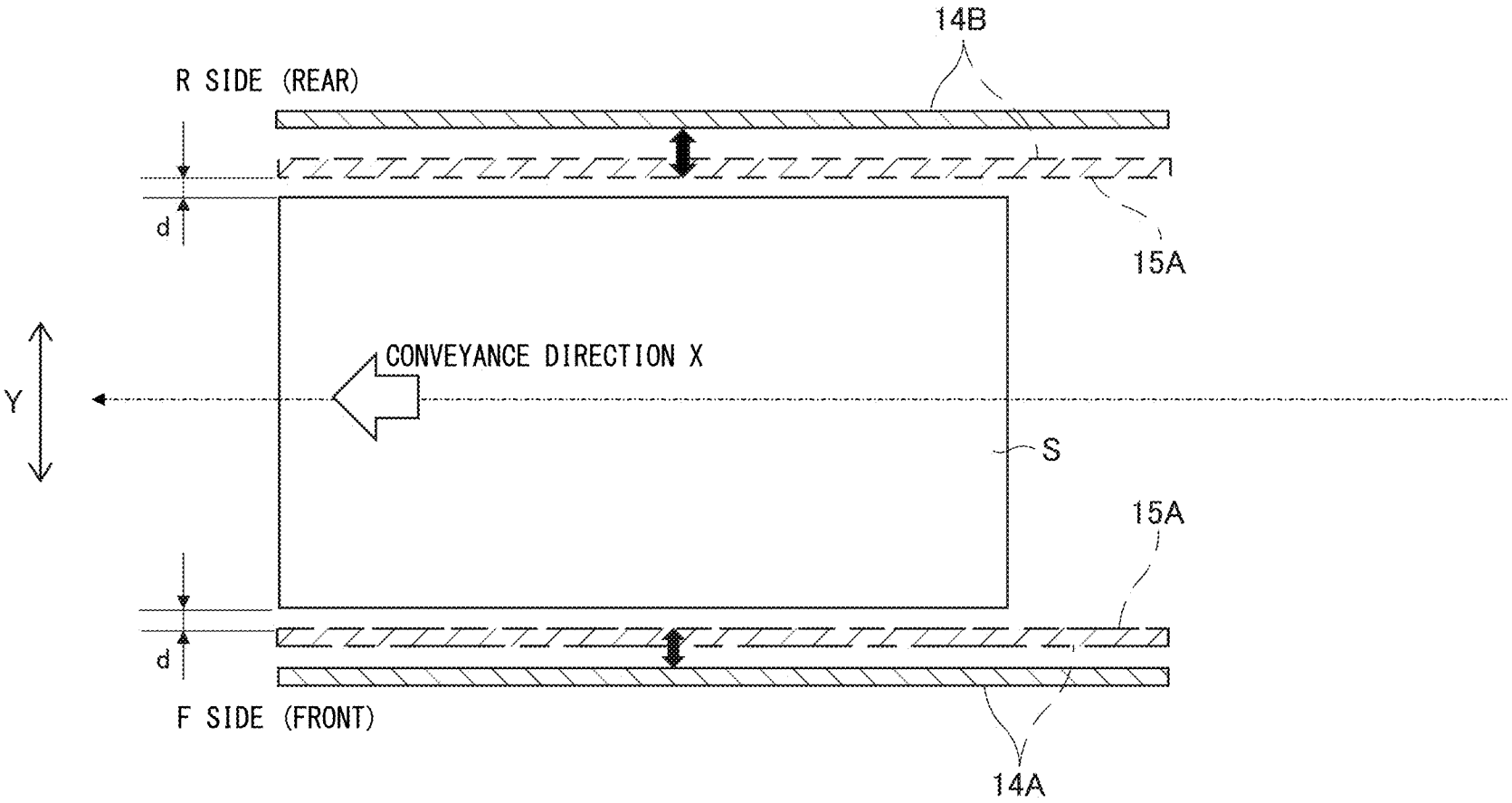
FIG. 34 is a view for describing an operation of a regulation guide according to a twelfth embodiment.
Figure 35:
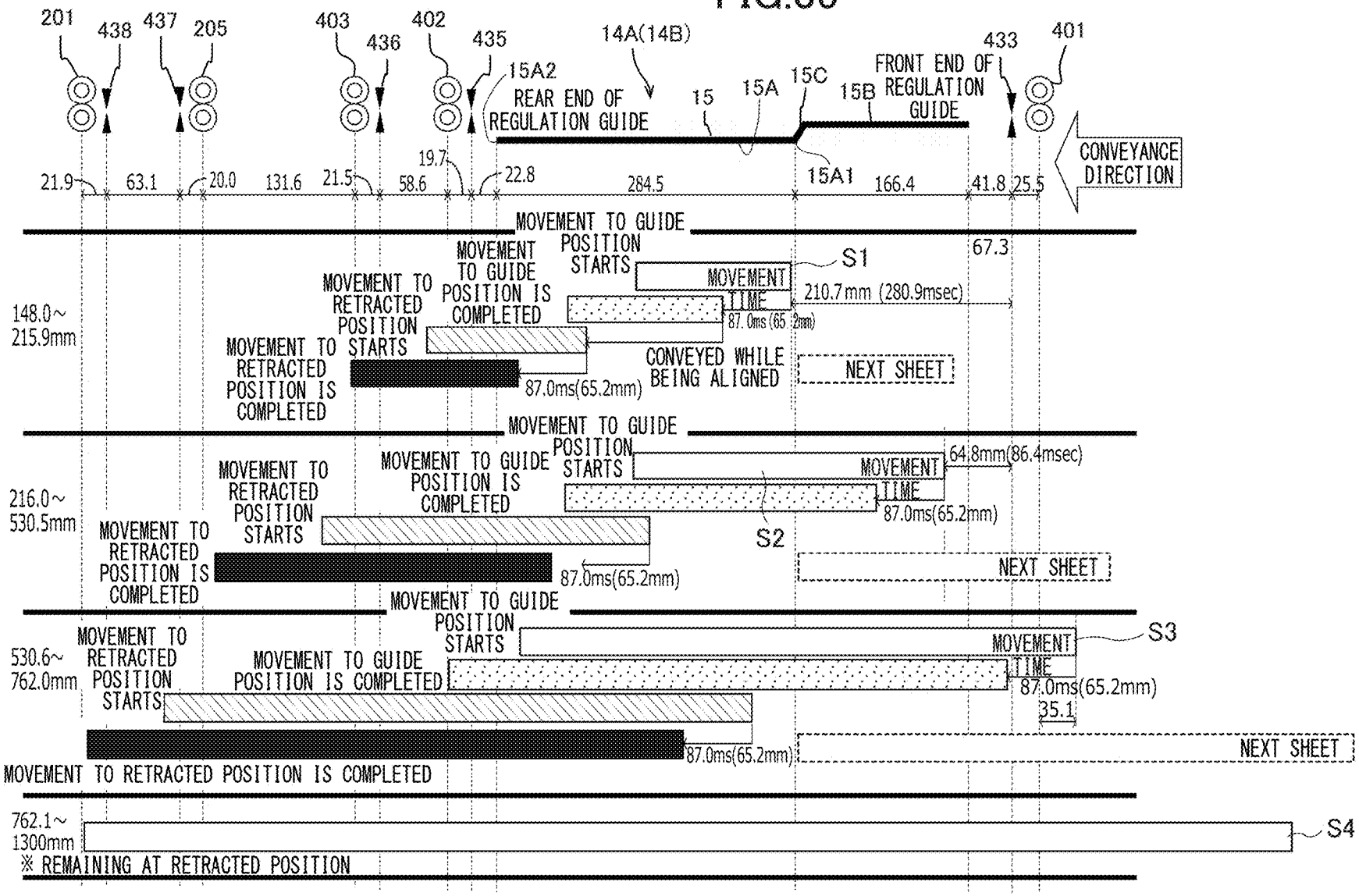
FIG. 35 is a diagram for describing operation timings of the regulation guide according to the twelfth embodiment for sheets with a plurality of types of sheet lengths.

In FIG. 34, a pair of regulation guides 14A and 14B at retracted positions are indicated by a solid line, and the pair of regulation guides 14A and 14B at guide positions are indicated by a broken line. FIG. 35 is a diagram illustrating operation timings of the pair of regulation guides 14A and 14B according to a sheet length. In FIG. 35, a positional relationship of the regulation guide 14A (14B), various conveyance roller pairs, and a sheet detection sensor from a conveyance roller pair 401 positioned upstream of a conveyor belt 12 to a conveyance roller pair 201 (FIG. 1) of a multistage feeding apparatus 200 in a conveyance direction X is schematically illustrated in the uppermost stage. An operation timing of the regulation guide according to the sheet length is schematically illustrated below.

Relationship Between Sheet Alignment and Load Applied from Sphere to Sheet

As described above, in each of the embodiments, correction of side registration, side skew, and the like of the sheet, that is, sheet alignment is performed by the pair of regulation guides 14A and 14B while the sheet is conveyed by the conveyor belt 12. Hereinafter, for example, the seventh embodiment will be described. Here, in a case where a load applied from a sphere 20F to the sheet is large, the sheet is less likely to slip on a conveyance surface 12A at the time of alignment, and the load applied to the sheet increases at the time of sheet alignment. As a result, wrinkles and the like may occur in the sheet. On the other hand, in a case where the load applied from the sphere 20F to the sheet is set to be small in advance in order to reduce the load at the time of sheet alignment, a conveyance force of the sphere 20F and the conveyor belt 12 for the sheet is decreased. Therefore, in the present embodiment, as described below, the load applied from the sphere 20F to the sheet is decreased at the time of sheet alignment, and the load applied from the sphere 20F to the sheet is increased when the sheet alignment is completed.

Relationship Between Waiting of Sheet and Load Applied from Sphere to Sheet

In an image forming system 1000, due to control of the system such as a relationship with a preceding sheet or a subsequent sheet, conveyance of the sheet may be caused to be waited on the conveyor belt 12 of a relay conveyance apparatus 400A based on a command from an image forming apparatus 100 or detection information of a sensor positioned downstream of the relay conveyance apparatus 400A. At this time, the conveyor belt 12 is kept driven, and the sheet waiting on the conveyor belt 12 abuts against a conveyance roller pair 402 positioned downstream in the stopped state and is stopped. Here, the reason why the driving of the conveyor belt 12 is not stopped in a state where the sheet waits is that, in a case where the driving of the conveyor belt 12 is once stopped, it takes time to restart the driving of the conveyor belt 12 to restart the conveyance of the sheet. That is, it takes time to drive the conveyor belt 12 in the stopped state in a state where the sheet can be conveyed. In this case, productivity of the apparatus is lowered. Therefore, in the present embodiment, when the conveyance of the sheet is made to be waited due to the system, the conveyor belt 12 is kept driven.

In a case where the sheet waits on the conveyor belt 12 while the conveyor belt 12 is kept driven in this manner, there is a possibility that the sheet gets dirty by being rubbed by the conveyor belt 12 when the load applied from the sphere 20F to the sheet is large. On the other hand, in a case where the load applied from the sphere 20F to the sheet is set to be small in advance in order to reduce the load at the time of waiting for the conveyance of the sheet, the conveyance force of the sphere 20F and the conveyor belt 12 for the sheet is decreased. Therefore, in the present embodiment, as described below, when the sheet waits on the conveyance surface 12A of the conveyor belt 12, the load applied from the sphere 20F to the sheet is decreased, and when the conveyance of the sheet is resumed, the load applied from the sphere 20F to the sheet is increased.

As described above, in the present embodiment, since the load applied from the sphere 20F to the sheet is decreased when the sheet waits on the conveyor belt 12, it is possible to suppress a surface (back surface) of the sheet that comes into contact with the conveyor belt 12 from becoming dirty. That is, the load applied to the sheet can be decreased. Further, when the conveyance of the sheet is resumed, the load applied from the sphere 20F to the sheet is returned, so that it is possible to suppress deterioration of the sheet conveyance performance.

Relationship Between Sheet Jam and Load Applied from Sphere to Sheet

In the image forming system 1000, a sheet may be jammed in a conveyance path. When the sheet jam occurs, the conveyance of all the sheets in the system is stopped. Therefore, when a jam occurs in a case where the sheet is on the conveyor belt 12, the conveyance of the sheet is stopped in a state where the sheet is on the conveyor belt 12. It is a matter of course that, even when the sheet conveyed by the conveyor belt 12 is jammed, the conveyance of the sheet is stopped in a state where the sheet is on the conveyor belt 12.

Here, when the sheet jam occurs and the load applied from the sphere 20F to the sheet is large, in the former case, the sheet is sandwiched between the sphere 20F and the conveyor belt 12 during processing of the jam, and there is a possibility that the back surface of the sheet becomes dirty. On the other hand, in the latter case, the sheet is removed from the conveyor belt 12 at the time of processing the jam, but it is difficult to remove the sheet in a case where the load applied from the sphere 20F to the sheet is large at this time. For this reason, it is conceivable to manually decrease the load applied from the sphere 20F to the sheet at the time of processing the jam, but in a case where the load applied from the sphere 20F to the sheet can be automatically decreased when the jam occurs, the time and effort at the time of processing the jam can be reduced.

Therefore, in the present embodiment, as described below, when the sheet jam occurs, the load applied from the sphere 20F to the sheet is decreased, and when the conveyance of the sheet is resumed, the load applied from the sphere 20F to the sheet is increased. That is, a control unit 203 controls a load changing unit 702 such that the load applied from the plurality of spheres 20F to the sheet is decreased at a timing when the sheet jam occurs or a timing after the sheet jam occurs. As described above, in the present embodiment, when the sheet jam occurs, the load applied from the sphere 20F to the sheet is decreased, so that it is possible to suppress the back surface of the sheet from becoming dirty. That is, the load applied to the sheet can be decreased. Alternatively, it is possible to reduce the time and effort at the time of handling the sheet jam.

Other Embodiments

Any of the above-described embodiments is common in that the load (including a load of 0) applied from the plurality of rotary members (spheres) to the sheet is changed according to the sheet information described above, and the load may be set in two stages or in a plurality of stages such as three or more stages. Further, the configuration for changing the load applied from the rotary member 301 and 301A to the sheet described in the sixth embodiment may be any of the configurations of the first to fourth and seventh to eleventh embodiments. Furthermore, the control configuration of the above-described fifth embodiment is applicable to any of the above-described embodiments.

In the above-described embodiments, the control unit 203 that controls the relay conveyance apparatuses 400 and 400A is provided in the multistage feeding apparatus 200, but the relay conveyance apparatuses 400 and 400A may also be controlled by the control unit 140 of the image forming apparatus 100. In addition, the relay conveyance apparatuses 400 and 400A may be provided with a control unit that controls each unit of the relay conveyance apparatuses 400 and 400A. Further, the sheet conveyance apparatus may have another configuration as long as the sheet conveyance apparatus can shift the position of the sheet regardless of the relay conveyance apparatus described above.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming system comprising:

a conveyor belt configured to convey a sheet in a conveyance direction;

a plurality of rotary members arranged along the conveyance direction, and configured to be rotationally driven at least in the conveyance direction with the sheet conveyed by the conveyor belt;

a regulation portion having a contact portion configured to come into contact with a side edge that is an edge of the sheet in a sheet width direction, and configured to regulate movement of the sheet in the sheet width direction beyond the contact portion in a case where the side edge of the sheet comes into contact with the contact portion, the sheet being conveyed using the conveyor belt and the rotary members, the sheet width direction being a direction intersecting the conveyance direction;

a load changing unit configured to change a load applied from at least some of the plurality of rotary members to the sheet;

a sheet information recognition unit configured to recognize information regarding a grammage of the sheet to be conveyed;

a control unit configured to control the load changing unit; and an image forming unit configured to form an image on the sheet conveyed by the conveyor belt and the rotary members, wherein the conveyor belt and the plurality of rotary members are configured to allow a predetermined sheet to move in the direction intersecting the conveyance direction in a case where the regulation portion comes into contact with the side edge of the sheet in a state where the sheet is conveyed in the conveyance direction by the conveyor belt and the plurality of rotary members, and the control unit is configured to operate the load changing unit according to the grammage of the sheet recognized by the sheet information recognition unit.

2. The image forming system according to claim 1, wherein the control unit is configured to operate the load changing unit such that the load applied from at least some of the plurality of rotary members to the sheet is larger in a case where the grammage of the sheet recognized by the sheet information recognition unit is a first grammage than in a case where the grammage of the sheet recognized by the sheet information recognition unit is a second grammage smaller than the first grammage.

3. The image forming system according to claim 1, further comprising a second regulation portion, wherein the regulation portion and the second regulation portion are a pair of regulation guides disposed on both sides of the conveyor belt in the sheet width direction, the regulation guides each being configured to move in the sheet width direction, and the load changing unit is operated by movement of the pair of regulation guides.

4. The image forming system according to claim 1, wherein the control unit configured to execute a mode in which the load changing unit is controlled based on user's selection to change the load applied from at least some of the plurality of rotary members to the sheet.

5. The image forming system according to claim 1, wherein the rotary members are spheres configured to rotate in an arbitrary direction.

6. A sheet conveyance apparatus that conveys a sheet toward an image forming apparatus, the sheet conveyance apparatus comprising:

a conveyor belt configured to convey the sheet in a conveyance direction;

a plurality of rotary members arranged along the conveyance direction, and configured to be rotationally driven at least in the conveyance direction with the sheet conveyed by the conveyor belt;

a regulation portion having a contact portion configured to come into contact with a side edge that is an edge of the sheet in a sheet width direction, and configured to regulate movement of the sheet in the sheet width direction beyond the contact portion in a case where the side edge of the sheet comes into contact with the contact portion, the sheet being conveyed using the conveyor belt and the rotary members, the sheet width direction being a direction intersecting the conveyance direction;

a load changing unit configured to change a load applied from at least some of the plurality of rotary members to the sheet;

a sheet information recognition unit configured to recognize information regarding a grammage of the sheet to be conveyed; and a control unit configured to control the load changing unit, wherein the conveyor belt and the plurality of rotary members are configured to allow a predetermined sheet to move in the direction intersecting the conveyance direction in a case where the regulation portion comes into contact with the side edge of the sheet in a state where the sheet is conveyed in the conveyance direction by the conveyor belt and the plurality of rotary members, and the control unit is configured to operate the load changing unit according to the grammage of the sheet recognized by the sheet information recognition unit.

* * * * *